US005705326A

United States Patent [19]

Kawai

[11] Patent Number: 5,705,326

[45] Date of Patent: Jan. 6, 1998

[54] SILVER HALIDE COLOR PHOTOGRAPHIC MATERIAL AND A METHOD FOR FORMING A COLOR IMAGE

[75] Inventor: Kiyoshi Kawai, Minami-ashigara, Japan

[73] Assignee: Fuji Photo Film Co., Ltd., Kanagawa, Japan

[21] Appl. No.: 239,125

[22] Filed: May 6, 1994

[30] Foreign Application Priority Data

May 10, 1993 [JP] Japan ..... 5-130996

[51] Int. Cl.[6] ..... G03C 1/46

[52] U.S. Cl. ..... 430/503; 430/551; 430/557; 430/607; 430/523; 430/531; 430/538

[58] Field of Search ..... 430/505, 503, 430/557, 567, 551, 523, 531, 538, 607

[56] References Cited

U.S. PATENT DOCUMENTS

| | | | |
|---|---|---|---|
| 5,183,731 | 2/1993 | Takahashi et al. | 430/551 |
| 5,194,369 | 3/1993 | Mihayashi et al. | 430/544 |
| 5,213,958 | 5/1993 | Motoki et al. | 430/557 |
| 5,238,803 | 8/1993 | Ichijima et al. | 430/556 |
| 5,252,447 | 10/1993 | Ohtani et al. | 430/538 |
| 5,290,668 | 3/1994 | Ohtani | 430/505 |
| 5,294,530 | 3/1994 | Seto et al. | 430/551 |
| 5,306,609 | 4/1994 | Mihayashi et al. | 430/557 |
| 5,314,797 | 5/1994 | Yoshioka et al. | 430/557 |
| 5,359,080 | 10/1994 | Shimura et al. | 548/317 |

FOREIGN PATENT DOCUMENTS

| | | |
|---|---|---|
| 258042 | 2/1990 | Japan . |
| 3156449 | 7/1991 | Japan . |
| 4256947 | 9/1992 | Japan . |
| 4256948 | 9/1992 | Japan . |

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

There is disclosed a silver halide color photographic material and a method for forming a color image using the photographic material. The photographic material comprises a reflective support made up of a base and two or more waterresisting resin covering layers which contain a white pigment and a silver halide emulsion layer containing a yellow coupler represented by formula (I), (II), or (III) and preferably further containing a compound represented by formula (IV), (V), (VI), (VII), or (VIII), each of which formula is defined in claim, on the reflective support.

22 Claims, No Drawings

SILVER HALIDE COLOR PHOTOGRAPHIC MATERIAL AND A METHOD FOR FORMING A COLOR IMAGE

FIELD OF THE INVENTION

The present invention relates to a silver halide color photographic material, and more particularly to a silver halide color photographic material having a reflective support that is excellent in rapid processability and sharpness; that is inexpensive; that has less processing color contamination after application of pressure to the photographic material; and the invention also relates to a method for forming a color image using the photographic material.

BACKGROUND OF THE INVENTION

In recent years, various means of producing electronic images have been developed, and the image quality of such means is compared with that of silver halide photographic materials. The comparison has come to confirm that silver halide photographic materials are high in image quality and are handy. Therefore, in addition to the use of silver halide photographic materials as photographic print materials, silver halide photographic materials are studied for use as hard copy materials of electronic images. Under these circumstances, to make better use of the features of silver halide photographic materials, studies, for example, for improving the sharpness and color reproduction, to make the image quality high, or for shortening the processing time, or for improving the processing method, to make rapid processing easy, are vigorously under way. In easy rapid processing, owing to the development of easy rapid-development systems, represented by the mini-lab system, printed photographs quite high in image quality are now supplied relatively readily in a short period of time, inexpensively. Further, by using silver halide emulsions high in silver chloride content, the processing time is considerably shortened and the processing fluctuation is improved.

As means of improving sharpness of silver halide photographic materials having a reflective support, various techniques are hitherto known. These techniques include, for example, (1) prevention of irradiation by the use of water-soluble dyes, (2) prevention of halation by the use of colloidal silver, mordant dyes, dyes in the form of solid fine particles, and the lake, and (3) prevention of light from penetrating a paper support by increasing the packing of a white pigment in a laminating resin on the paper support, or by applying further a white pigment dispersed in gelatin onto the paper support.

However, out of these techniques, the techniques (1) and (2) are accompanied with harmful effects, such as a considerable decrease in sensitivity, and also residual color resulting from the processing. On the other hand, as means of (3), application of a white pigment dispersed in gelatin onto a support can considerably improve sharpness, which is disclosed, for example, in U.S. Pat. No. 4,558,002. However, application of a white pigment dispersed in gelatin degrades the storage stability of the photographic material or results in new problems (e.g., degradation of processing fluctuation, lack of rapid processability, resulting from a delay in the drying rate, and higher cost), owing to an increase of the total film thickness, and therefore application of a white pigment dispersed in gelatin is not suitable for practical use under present conditions.

On the other hand, JP-A ("JP-A" means unexamined published Japanese patent application) No. 156452/1991 discloses that the sharpness is improved greatly by increasing the content of a white pigment in a polyolefin laminate on a support. However, this further increase of the content of a white pigment in a polyolefin leads to an increase in cost, which is an hindrance to practical use. On the other hand, for example, in JP-A Nos. 30446/1974, 58042/1990, 142549/1989, 156449/1991, 256947/1992, and 256948/1992, reflective supports having two or more polyolefin layers different in content of a white pigment are disclosed. Thus it became known that the above constitution can decrease the amount of a white pigment to be used, with the sharpness being retained, which is advantageous in view of cost. However, a new problem arose: if pressure due to bending or the like is applied to the photographic material having a support with such resin layers before the processing, processing color contamination occurs in the region where the pressure is applied.

It also became known that the above problem is conspicuous in the case of silver halide emulsion grains that are high in silver chloride content.

SUMMARY OF THE INVENTION

Therefore, an object of the present invention is to provide a high-silver-chloride color photographic material that can provide, inexpensively and rapidly, a color photograph high in image quality.

Another object of the present invention is to provide a color photographic material excellent in sharpness and high in sensitivity, wherein use is made of a multi-layer-resin-covered support, which is advantageous in view of cost, and when a pressure is applied to the photographic material, the color-forming property is not changed at the time of processing The present invention's objects is also to provide a method for forming an image that can rapidly provide a color photograph high in image quality by using the above-described high-silver-chloride color photographic material.

Other and further objects, features, and advantages of the invention will appear more evident from the following drawings.

DETAILED DESCRIPTION OF THE INVENTION

The above objects of the present invention have been achieved by providing the following silver halide color photographic materials and the following method for forming a color image:

(1) A silver halide color photographic material having, on a reflective support, at least three silver halide emulsion layers that are different in color sensitivity, and each layer contains any of couplers capable of forming yellow color, magenta color, or cyan color, wherein the reflective support comprises a base and two or more waterresisting resin covering layers, located on the side of the base where photographic layers are applied, wherein the waterresisting resin covering layers have different contents of a white pigment, and wherein a silver halide emulsion layer containing a yellow color-forming coupler comprises at least one dye-forming coupler represented by the following formula (I) or (II):

formula (I)

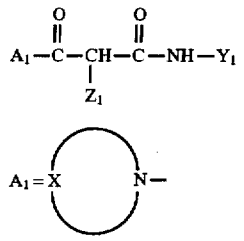

wherein X represents an organic residue required to form a nitrogen-containing heterocyclic ring together with the nitrogen atom, $Y_1$ represents an aromatic group or a heterocyclic group, and $Z_1$ represents a group capable of being released upon coupling reaction of the coupler represented by formula (I) with the oxidized product of a developing agent, formula (II)

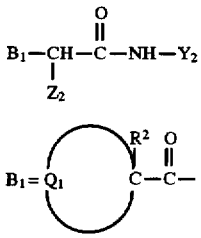

wherein $R_2$ represents a monovalent group other than a hydrogen atom, $Q_1$ represents a group of nonmetallic atoms required to form together with the carbon atom a 3- to 5-membered cyclic hydrocarbon group or a 3- to 6-membered heterocyclic ring that has at least one heteroatom selected from N, O, S, and P in the ring, $R_2$ may be bonded to $Q_1$ to form a bicyclic or a higher polycyclic ring, $Z_2$ represents a hydrogen atom or a group capable of being released upon coupling reaction of the coupler represented by formula (II) with the oxidized product of an aromatic primary amine developing agent, and $Y_2$ has the same meaning as that of $Y_1$ of formula (I);

(2) The silver halide color photographic material as stated in the above (1), wherein, out of the two or more waterresisting resin covering layers that are different in the content of a white pigment, the waterresisting resin covering layer nearest to the base is lower in content of the white pigment than at least one waterresisting resin covering layer located on the same side of the base but further away from the base;

(3) The silver halide color photographic material as stated in the above (2), wherein, out of the two or more waterresisting resin covering layers that are different in content of a white pigment, the waterresisting resin covering layer nearest to the photosensitive layer has the highest content of the white pigment;

(4) The silver halide color photographic material as stated in the above (2), wherein the waterresisting resin covering layers of the reflective support that are different in content of a white pigment are made up of at least three layers and any one of such layers located between the waterresisting resin covering layer that is located nearest to the photographic layer and the waterresisting resin covering layer that is located nearest to the base has the highest content of the white pigment;

(5) The silver halide color photographic material as stated in any one of the above (1) to (4), wherein the white pigment in the waterresisting resin covering layers of the reflective support is titanium oxide, and the weight ratio of the titanium oxide to the resin in the waterresisting resin covering layer having the highest content of the white pigment is 9/91 (titanium oxide/resin) or over;

(6) A silver halide color photographic material having, on a reflective support, at least three silver halide emulsion layers that are different in color sensitivity, and each contains any of couplers capable of forming yellow color, magenta color, or cyan color, wherein the reflective support comprises a base and two or more waterresisting resin covering layers, located on the side of the base where photographic layers are applied, different in content of a white pigment, and wherein a silver halide emulsion layer containing a yellow color-forming coupler comprises at least one yellow-dye-forming coupler represented by the formula (I), or (II) stated in the above (1), or the following formula (III), and at least one compound represented by the following formula (IV), (V), (VI), (VII), or (VIII):

formula (III)

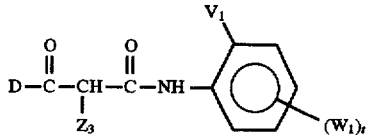

wherein D represents a tertiary alkyl group, $V_1$ represents a fluorine atom, an alkoxy group, an aryloxy group, a dialkylamino group, an alkylthio group, an arylthio group, or an alkyl group, $Z_3$ has the same meaning as that of $Z_1$ in formula (I), $W_1$ represents a group capable of substitution on the benzene ring, and t is an integer of 0 to 4, formula (IV)

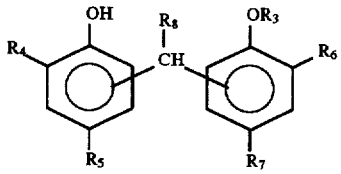

wherein $R_3$ represents a hydrogen atom, an alkyl group, an acyl group, an aryl group, or an alkenyl group, $R_4$, $R_5$, $R_6$, and $R_7$ each represent independently an alkyl group, $R_8$ represents a hydrogen atom or an alkyl group, the methylene group joining the two benzene rings joins them at the ortho position, the meta position, or the para position to the oxygen atom of the respective rings, and if they are joined at the para positions, $R_5$ or $R_7$ represents the linking methylene group itself, and in that case an alkyl group may further be present on the benzene ring, formula (V)

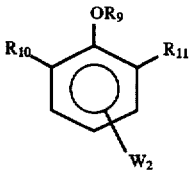

wherein $R_9$ represents a hydrogen atom, an alkyl group, an aryl group, or an acyl group, $R_{10}$ and $R_{11}$ each represent independently a substituted or unsubstituted alkyl group or alkoxy group, and $W_2$ represents a monovalent group capable of substitution on the benzene ring.

formula (VI)

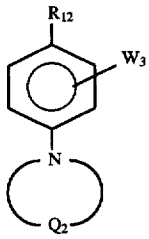

wherein $Q_2$ represents a divalent group for forming a 5- to 7-membered heterocyclic ring together with the nitrogen atom and an alkylene group, $R_{12}$ represents an alkyl group, an alkoxy group, an aryloxy group, or an acyloxy group, and $W_3$ represents a monovalent group capable of substitution on the benzene ring.

formula (VII)

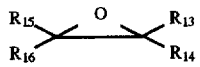

wherein $R_{13}$, $R_{14}$, $R_{15}$, and $R_{16}$ each represent a hydrogen atom, an aliphatic group, an aromatic group, an aliphatic oxycarbonyl group, an aromatic oxycarbonyl group, or a carbamoyl group, provided that all of RiB, $R_{14}$, $R_{15}$, and $R_{15}$ do not represent hydrogen atoms at the same time, and the number of the epoxy groups represented by formula (VII) may be contained in the range of 1 to 60 groups in the same molecule.

formula (VIII)

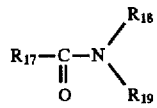

wherein $R_{17}$, $R_{18}$, and $R_{19}$ each represent independently an alkyl group or an aryl group, if $R_{18}$ and $R_{19}$ each represent an alkyl group, they may bond together to form a 5- to 7-membered ring, and one of $R_{18}$ and $R_{19}$ may be a hydrogen atom;

(7) The silver halide color photographic material as stated in the above (6), wherein both a compound represented by formula (IV) and a compound represented by formula (VII) are contained in the yellow-coupler-containing layer;

(8) The silver halide color photographic material as stated in either of the above (6) and (7), wherein both at least one compound represented by formula (IV) or (V), and at least one compound represented by formula (VI) or (VII), are contained in the yellow-coupler-containing layer;

(9) A method for forming a color image, which comprises exposing to light the silver halide color photographic material stated in any one of the above (1) to (8) by a scanning exposure system, wherein the exposure time per picture element is shorter than $10^{-4}$ sec, followed by color development processing.

The present invention is described below in detail.

As the waterresisting resin for use on the reflective support of the present invention, polyolefins, such as polyethylenes, polypropylenes, and polyethylene-type polymers, are used, with particular preference given to polyethylenes. As the polyethylene, high-density polyethylenes, low-density polyethylenes, linear low-density polyethylenes, and blends of these polyethylenes can be used. When the melt flow rate (hereinafter abbreviated as MFR) of the polyolefin resin that has not yet been processed is measured under Condition 4 shown in Table 1 of JIS (Japanese Industrial Standard) K 7210, the MFR of the polyolefin resin is in the range of 1.2 g/10 min to 12 g/10 min. Herein, the MFR of the polyolefin resin that has not been processed refers to the MFR of the resin with which a blueing material and a white pigment have not yet been blended.

As the white pigment to be mixed with and dispersed into the waterresisting resin for use on the reflective support of the present invention, an inorganic pigment, such as titanium dioxide, barium sulfate, lithopone, aluminum oxide, calcium carbonate, silicon oxide, antimony trioxide, titanium phosphate, zinc oxide, white lead, and zirconium oxide, and an organic finely pulverized powder, such as polystyrene and styrene/divinylbenzene copollnner, can be mentioned.

Among these pigments, titanium dioxide is particularly effectively used. Although the titanium dioxide may be either of the rutile type or of the anatase type, if whiteness is preferred, the anatase type is preferable, while if sharpness is preferred, the rutile type is preferred. Taking both whiteness and sharpness into consideration, the rutile type and the anatase type may be blended and used. It is also preferable to use the anatase type in some layers of waterresisting resin layers and the rutile type in other layers. These titanium dioxides may be produced by either the gulfate process or the chloride process. Specific trade names thereof include, for example, KA-10 and KA-20, manufactured by Titan Kogyo K.K. and A-220, manufactured by Ishihara Sangyo K.K.

The titanium dioxide to be used can be generally one that has been subjected to surface treatment with an inorganic substance, such as aluminum hydroxide and silicon hydroxide; or to surface treatment with an organic substance, such as a polyhydric alcohol, a polyvalent amine, a metallic soap, an alkyl titanate, and a polysiloxane; or to surface treatment with a combination of an inorganic treatment and an organic treatment, in order to suppress the activity of the titanium dioxide, to prevent yellowing. The amount of the surface-treatment agent is preferably 0.2 to 2.0 wt % in the case of an inorganic surface treatment, and 0.1 to 1.0 wt % in the case of an organic surface treatment, based on the amount of the titanium dioxide.

Preferably, the average particle diameter of the titanium dioxide to be used is 0.1 to 0.8 μm. If the average particle diameter is too small, it is not preferable because it is difficult to mix and disperse uniformly the titanium dioxide into the resin. If the average particle diameter is too large, a satisfactory whiteness cannot be obtained, and also the coated surface will have projections that will adversely affect the image quality.

In the present invention, the number of waterresisting resin covering layers located on the side of the base where photographic layers are applied is usually 2 to 7, and preferably 2 to 5. In the reflective support for use in the present invention, preferably the content of the white pigment in the waterresisting resin covering layer nearest to the base is lower than that of at least one waterresisting resin covering layer located over the nearest-to-the-base layer. As a more preferable mode can be mentioned a reflective support in which the content of the white pigment in the waterresisting resin covering layer nearest to the photosensitive layer is highest, or a reflective support in which the reflective support comprises at least three waterresisting resin covering layers, and the content of the white pigment in the intermediate layer between the waterresisting resin layers is the highest.

The content of the white pigment in each of the waterresisting resin layers is 0 to 45 wt %, preferably 0 to 40 wt %.

The content of the white pigment in the waterresisting resin layer that has the highest white-pigment content is 9 to 45 wt %, preferably 15 to 40 wt %, more preferably 20 to 40 wt %. If the content of the white pigment in that layer is less than 9 wt %, the effect of increasing the sharpness of an image is low, while if that content exceeds 45 wt %, the film that is melt-extruded is liable to break. The ratio of white pigment content (wt %) in the layer having the highest white pigment content to the white pigment content (wt %) in the layer of lowest content is preferably 1.2 or more.

The mixing of the waterresisting resin and the white pigment is carried out in such a manner that the white pigment and a dispersing agent, such as a metal salt of a higher fatty acid, a higher fatty acid ethyl ester, a higher fatty acid amide, and a higher fatty acid, are mixed into the resin by a mixer, such as a two-roll, a three-roll, a kneader, and a Banbury mixer; and the mixture is used as a masterbatch in the form of molded pellets. The concentration of the white pigment is generally about 30 to 75 wt % in the pellets, and the concentration of the dispersing agent is generally about 0.5 to 10 wt % based on the white pigment.

In the waterresisting resin layer, preferably, a blueing material is contained, in order to make the white background of a color photograph look whiter. As the blueing material, ultramarine, cobalt blue, oxidized cobalt phosphate, a quinacridrone-system pigment, or the like, or a mixture thereof that is generally known, is used. There is no particular restriction on the particle diameter of the blueing material; the particle diameter of commercially available blueing materials is generally about 0.3 to 10 μm, and if the particle diameter of the blueing material to be used falls within that range, the blueing material can be used without hindrance. The amounts of the blueing material to be contained in the waterresisting resin layers of the reflective support used in the present invention are preferably such that the content of the blueing material in the uppermost waterresisting resin layer is equal to or higher than the contents of the blueing material in the lower layers. Preferable contents of the blueing material are such that the content of the blueing material in the uppermost layer is 0.2 to 0.4 wt %, and the content of the blueing material in the layers below it is 0 to 0.15 wt %.

The blueing material is blended into the waterresisting resin by a mixer, such as a two-roll, a three-roll, a kneader, and a Banbury mixer, and the mixture is molded into pellets, which serve as a masterbatch. The concentration of the blueing material in the pellets is 1 to 30 wt %.

In producing the pellets of the blueing material, the white pigment can also be mixed together and a dispersing agent, such as a low-molecular-weight waterresisting resin, a metal salt of a higher fatty acid, a higher fatty acid ester, a higher fatty acid amide, and a higher fatty acid, can be used, to aid dispersion of blueing material.

Further, an antioxidant can be contained in the waterresisting resin, and the content of the antioxidant is suitably 50 to 1,000 ppm based on the waterresisting resin.

The thus produced masterbatch containing the white pigment and/or the blueing material can be used after it is suitably diluted with a waterresisting resin.

As a method for forming waterresisting resin layers of the present invention can be mentioned, for example, a method wherein the above pellets containing the white pigment and/or the blueing material are heated and melted, and if necessary they are diluted with a heat-resisting resin, to form waterresisting resin layers on a running base, which base is made of paper or synthetic paper by any of the successive-laminating method or the laminating method using a multi-layer-extruding die of the feet block type, the multi-manifold type, or the multi-slot type. The multi-layer-extruding die is generally, for example, in the shape of a T-die or a coat-hanger die, and the shape is not particularly restricted. The outlet temperature when the waterresisting resin is heated and melt-extruded is generally 280° to 340 ° C., particularly preferably 310° to 330° C. Further, before the base is covered with the resin, preferably the base is subjected to activation treatment, such as corona discharge treatment, flame treatment, and glow discharge treatment.

The total thickness of the waterresisting resin layers (white pigment compositions) of the reflective support for use in the present invention, which layers cover the raw paper on the side to which emulsions are applied, is preferably 5 to 100 μm, more preferably 5 to 80 μm, and further more preferably 10 to 50 μm. If the total thickness is too large, the brittleness of the resin is emphasized, leading to problems related to physical properties, and, for example, the resin may break. If the total thickness is too small, not only the waterresistance, which is the fundamental purpose of the covering, is impaired but also the whiteness and the surface smoothness cannot be satisfied simultaneously, and regarding the physical properties, the support is unpreferably too soft.

Further, the thickness of each of the waterresisting resin layers is preferably 0.5 to 50 μm. For example, when the waterresisting resin layers are two in number, preferably the thickness of each layer is 0.5 to 50 μm and the total thickness of the layers is in the range mentioned above. When the waterresisting resin layers are three in number, preferably the thickness of the uppermost layer is 0.5 to 10 μm, the thickness of the intermediate layer is 5 to 50 μm, and the thickness of the lower layer (the layer nearest to the base) is 0.5 to 10 μm. If the thicknesses of the uppermost layer and the lowermost layer are too small, die slip streaks are apt to occur, due to the action of the white pigment highly packed in the intermediate layer. On the other hand, if the thicknesses of the uppermost layer and the lowermost layer, particularly the uppermost layer, are too large, the sharpness is dropped.

Preferably the thickness of the resin or resin composition for covering the surface of the raw paper to which emulsions are not applied is 5 to 100 μm, more preferably 10 to 50 μm; and if the thickness is too large, the brittleness of the resin is emphasized, leading to problems related to physical properties, and, for example, the resin may break. If the thickness is too small, the waterresisting property, which is the fundamental purpose of the covering, is impaired, and with respect to the physical properties, the support is unpreferably too soft.

The surface of the uppermost layer of the waterresisting resin layers on the side to which emulsions will be applied is a glossy surface or a fine surface, as described in JP-A No. 26507/1980, or it is embossed into a matte surface or a silk surface, and the back surface is, for example, embossed into a matte surface. The embossed surface may be subjected to activation treatment, such as corona discharge treatment and flame treatment, and then may be subjected to undercoating treatment, as described in JP-A No. 84643/1986.

Although the base to be used for the reflective support of the present invention may be made of any of natural pulp paper, whose major raw material is natural pulp; paper of mixed natural pulp and synthetic fiber; synthetic fiber paper, whose major component is synthetic fiber; and so-called bogus synthetic paper made of synthetic resin film of polystyrene, polypropylene, or the like, for the base of the waterresisting-resin-covered paper for photographic printing paper, natural pulp paper (hereinafter referred to as raw paper) is particularly preferably advantageously used. As chemical additives, a filler, such as clay, talc, calcium carbonate, and urea resin finely divided particles; a sizing agent, such as rosin, an alkylketene dimer, a higher fatty acid, an epoxidized fatty amide, paraffin wax, and an alkenyl succinate; a paper-strength-strengthening agent, such as starch, a polyamide polyamine epichlorohydrin, and a polyacrylamide; and a fixing agent, such as aluminum sulfate and a cationic polymer, can be added. In addition, as required, a dye, a fluorescent dye, a slime-controlling agent, an antifoaming agent, and the like may be added. Further, as required, softening agents given below can be added.

The softening agents are described, for example, in "Shin-Kamikako Benran" (edited by Shigyo Times-sha, published in 1980), pages 554 to 555. Particularly preferred is one having a molecular weight of 200 or over; that is, one having a hydrophobic group with 10 or more carbon atoms and an amine salt or a quaternary ammonium salt that can be self-fixed to cellulose. Specific examples that can be mentioned are: a reaction product of a maleic anhydride copolymer with a polyalkylene polyamine, a reaction product of a higher fatty acid with a polyalkylene polyamine, a reaction product of a urethane alcohol with an alkylating agent, as well as a quaternary ammonium salt of a higher fatty acid, with particular preference given to a reaction product of a maleic anhydride copolymer with a polyalkylene polyamine, and a reaction product of a urethane alcohol with an alkylating agent.

The pulp surface can be subjected to surface sizing treatment with a film-forming polymer, such as gelatin, starch, carboxymethylcellulose, polyacrylamide, polyvinyl alcohol, and a denatured product of polyvinyl alcohol. In this case, the denatured product of polyvinyl alcohol includes, for example, a carboxyl-group-denatured product, a silanol-denatured product, and a copolymer with acrylamide. In the case wherein the surface sizing treatment with a film-forming polymer is carried out, the coating amount of the film-forming polymer is 0.1 to 5.0 g/m$^2$, preferably 0.5 to 2.0 g/m$^2$. To the film-forming polymer may be added an antistatic agent, a fluorescent brightener, a pigment, an antifoamer, etc., as required.

The raw paper is produced by making paper from a pulp slurry of the above pulp to which have been added, as required, a filler, a sizing agent, a paper-strength-strengthening agent, a fixing agent, etc., using a paper machine, such as a Fourdrinier paper machine, followed by drying and winding the paper. Preferably, either before or after the drying, the above-mentioned surface sizing treatment is carried out and the calendering treatment is carried out between the drying and the winding. When the surface sizing treatment is carried out after the drying, although the calendering treatment may be carried out before or after the surface sizing treatment, preferably the calendering treatment is carried out in the final finishing step after various treatments. In the calendering treatment, any known metals and elastic rolls that are generally used in the papermaking may be used.

Although there is no particular restriction on the thickness of the raw paper for the support used in the present invention, desirably the basis weight is 50 to 250 g/m$^2$ and the thickness is 50 to 250 μm.

The support for use in the present invention may be provided with various back-coating layers in order, for example, to prevent electrification and curling. The back-coating layers may contain inorganic antistatic agents, organic antistatic agents, hydrophilic binders, latexes, hardening agents, pigments, surface-active agents, and the like, as described, for example, in JP-B ("JP-B" means examined Japanese patent publication) Nos. 18020/1987, 9059/1982, 53940/1982, and 56859/1983, and in JP-A Nos. 214849/1984 and 184144/1983, with these contents being suitably combined.

As the support for photographic printing paper, it is preferable to use one that is excellent in smoothness of the surface on the side to which photographic layers are applied. The "smoothness" is expressed in terms of the surface roughness of the support.

Now the surface roughness of the support of the present invention is described. As the surface roughness, the surface roughness of the center line average surface roughness is used as a scale. The center line average surface roughness is defined and calculated as follows: The part of an area SM is extracted from the central surface of the roughness curved surface; then, rectangular coordinates: an X-axis and a Y-axis, are placed on the center line of the extracted part; the axis orthogonal to the center line is defined as a Z-axis; and the value given by the following formula is defined as the center line average surface roughness (SRa) in μm.

$$SRa = \frac{1}{SM} \int_0^{L_X} \int_0^{L_Y} |f(X,Y)| d \times dY$$

wherein $L_X L_Y$=SM and Z=f(X, Y).

The center line average surface roughness and the value of the height of the projection from the center line can be determined by measuring an area of 5 mm$^2$ by using, for example, a three-dimensional surface roughness tester (SE-30H) manufactured by Kosaka Kenkyu-sho (KK), using a 4-μm-diameter diamond needle with the cut-off value being 0.8, the magnification in the horizontal direction being 20, and the magnification in the vertical direction being 2,000. Preferably, at that time, the tracing speed of the measuring needle is about 0.5 mm/sec.

Preferably, the support has a value of 0.15 μm or below, more preferably 0.10 μm or below, measured in this way. By using a support having such a surface roughness (smoothness), a color print having a surface excellent in smoothness can be obtained.

The yellow couplers used in the present invention will now be further described in detail.

The yellow coupler represented by formula (I) will be described in detail.

The nitrogen-containing heterocyclic ring represented by $A_1$ may be a saturated or unsaturated, monocyclic or condensed ring having one or more carbon atoms, preferably 1 to 20 carbon atoms, and particularly preferably 2 to 12 carbon atoms, which may be substituted or unsubstituted. Besides the nitrogen atom, the ring may have, for example, an oxygen atom(s), a sulfur atom(s), or a phosphorus atom (s) in the ring. The ring is a 3-membered ring or more higher membered ring, preferably a 3-membered to 12-membered ring, and particularly preferably a 5- to 6-membered ring.

Specific examples of the nitrogen-containing heterocyclic group represented by $A_1$ include pyrrolidino, piperidino, morpholino, 1-imidazolidinyl, 1-pyrazolyl, 1-piperazinyl, 1-indolinyl, 1,2,3,4-tetrahydroquinoxalin-1-yl, 1-pyrrolinyl, pyrazolidin-1-yl, 2,3-dihydro-1-indazolyl, isoindolin-2-yl, 1-indolyl, 1-pyrrolyl, benzothiazin-4-yl, 4-thiazinyl, benzodiazin-1-yl, aziridin-1-yl, benzooxadin-4-yl, 2,3,4,5-tetrahydroquinolyl, and phenoxazin-10-yl.

When $Y_1$ in formula (I) represents an aromatic group, it is a substituted or unsubstituted aromatic group having 6 or more carbon atoms, preferably 6 to 10 carbon atoms, and particularly preferably it is phenyl or naphthyl.

When $Y_1$ in formula (I) represents a heterocyclic group, it is a saturated or unsaturated, substituted or unsubstituted heterocyclic group having 1 or more carbon atoms, preferably 1 to 10 carbon atoms, and particularly preferably 2 to 5 carbon atoms. The heteroatom is preferably, for example, a nitrogen atom, a sulfur atom, or an oxygen atom. The ring is preferably a 5- to 6-membered ring, but the number of the members may be other number. The ring may be a monocyclic or condensed ring. When $Y_1$ represents a heterocyclic ring, specific examples thereof are 2-pyridyl, 4-pyrimidinyl, 5-pyrazolyl, 8-quinolyl, 2-furyl, and 2-pyrrolyl.

If the group represented by $A_1$ and the group represented by $Y_1$ in formula (I) each have a substituent, examples of the substituent include a halogen atom (e.g., fluorine and chlorine), an alkoxycarbonyl group (having 2 to 30 carbon atoms, preferably 2 to 20 carbon atoms, e.g., methoxycarbonyl, dodecyloxycarbonyl, and hexadecyloxycarbonyl), an acylamino group (having 2 to 30 carbon atoms, preferably 2 to 20 carbon atoms, e.g., acetamido, tetradecaneamido, 2-(2,4-di-t-amylphenoxy) butaneamido, and benzamido), a sulfonamido group (having 1 to 30 carbon atoms, preferably 1 to 20 carbon atoms, e.g., methanesulfonamido, dodecanesulfonamido, hexadecanesulfonamido, and benzenesulfonamido), a carbamoyl group (having 2 to 30 carbon atoms, preferably 2 to 20 carbon atoms, e.g., N-butylcarbamoyl and N,N-diethylcarbamoyl), a sulfamoyl group (having 1 to 30 carbon atoms, preferably 1 to 20 carbon atoms, e.g., N-butylsulfamoyl, N,N-diethylsulfamoyl, N-dodecylsulfamoyl, N-hexadecylsulfamoyl, and N-3-(2,4-di-t-aminophenoxy)butylsulfamoyl), an alkoxy group (having 1 to 30 carbon atoms, preferably 1 to 20 carbon atoms, e.g., methoxy and dodecyloxy), an N-acylsulfamoyl group (having 2 to 30 carbon atoms, preferably 2 to 20 carbon atoms, e.g., N-propanoylsulfamoyl and N-tetradecanoylsulfamoyl), a sulfonyl group (having 1 to 30 carbon atoms, preferably 1 to 20 carbon atoms, e.g., methanesulfonyl, octanesulfonyl, and dodecanesulfonyl), an alkoxycarbonylamino group (having 1 to 30 carbon atoms, preferably 1 to 20 carbon atoms, e.g., methoxycarbonylamino and tetradecyloxycarbonylamino), a cyano group, a nitro group, a carboxyl group, an aryloxy group (having 6 to 20 carbon atoms, preferably 6 to 10 carbon atoms, e.g., phenoxy and 4-chlorophenoxy), an alkylthio group (having 1 to 30 carbon atoms, preferably 1 to 20 carbon atoms, e.g., methylthio and dodecylthio), a ureido group (having 1 to 30 carbon atoms, preferably 1 to 20 carbon atoms, e.g., phenylureido), an aryl group (having the same meaning as that where $Y_1$ represents an aromatic group), a heterocyclic group (having the same meaning as that where $Y_1$ represents a heterocyclic ring), a sulfo group, an alkyl group (having 1 to 30 carbon atoms, preferably 1 to 20 carbon atoms, that may be a straight-chain, branched-chain, or cyclic, saturated or unsaturated, and substituted or unsubstituted alkyl group, e.g., methyl, ethyl, isopropyl, cyclopropyl, trifluoromethyl, cyclopentyl, dodecyl, and 2-hexyloctyl), an acyl group (having 1 to 30 carbon atoms, preferably 2 to 20 carbon atoms, e.g., acetyl and benzoyl), an arylthio group (having 6 to 20 carbon atoms, preferably 6 to 10 carbon atoms, e.g., phenylthio), a sulfamoylamino group (having 0 to 30 carbon atoms, preferably 0 to 20 carbon atoms, e.g., N-butylsulfamoylamino and N-dodecylsulfamoylamino), an N-acylcarbamoyl group (having 2 to 30 carbon atoms, preferably 2 to 20 carbon atoms, e.g., N-dodecanoylcarbamoyl), an N-sulfonylcarbamoyl group (having 1 to 30 carbon atoms, preferably 2 to 20 carbon atoms, e.g., N-hexadecanesulfonylcarbamoyl, N-benzenesulfonylcarbamoyl, and N-(2-octyloxy-5-t-octylbenzenesulfonyl)carbamoyl), an N-sulfamoylcarbamoyl group (having 1 to 30 carbon atoms, preferably 1 to 20 carbon atoms, e.g., N-(ethylsulfamoyl) carbamoyl, N-{3-(2,4-di-t-amylphenoxy) propylsulfamoyl}carbamoyl), an N-sulfonylsulfamoyl group (having 0 to 30 carbon atoms, preferably 1 to 20 carbon atoms, e.g., N-dodecanesulfonylsulfamoyl and N-benzenesulfonylsulfamoyl), an N-carbamoylsulfamoyl group (having 1 to 30 carbon atoms, preferably 1 to 20 carbon atoms, e.g., N-(ethylcarbamoyl)sulfamoyl and N-{3-(2,4-di-t-amylphenoxy)propylcarbamoyl}sulfamoyl), an N-(N-sulfonylcarbamoyl)sulfamoyl group (having 1 to 30 carbon atoms, preferably 1 to 20 carbon atoms, e.g., N-(dodecanesulfonylcarbamoyl)sulfamoyl and N-(2-octyloxy-5-t-octylbenzenesulfonylcarbamoyl)sulfamoyl), a 3-sulfonylureido group (having 1 to 30 carbon atoms, preferably 1 to 20 carbon atoms, e.g., 3-hexadecanesulfonylureido and 3-benzenesulfonylureido), a 3-acylureido group (having 2 to 30 carbon atoms, preferably 2 to 20 carbon atoms, e.g., 3-acetylureido and 3-benzoylureido), a 3-acylsulfamido group (having 1 to 30 carbon atoms, preferably 1 to 20 carbon atoms, e.g., 3-propionylsulfamido and 3-(2,4-dichlorobenzoyl) sulfamido), a 3-sulfonylsulfamido group (having 0 to 30 carbon atoms, preferably 1 to 20 carbon atoms, e.g., 3-methanesulfonylsulfamido and 3-(2-methoxyethoxy-5-t-octylbenzenesulfonyl)sulfamido), a hydroxyl group, an acyloxy group (having 1 to 30 carbon atoms, preferably 1 to 20 carbon atoms, e.g., propanoyloxy and tetradecanoyloxy), a sulfonyloxy group (having 0 to 30 carbon atoms, preferably 0 to 20 carbon atoms, e.g., dodecanesulfonyloxy and 2-octyloxy-5-t-octylbenzenesulfonyloxy), and an aryloxycarbonyl group (having 7 to 20 carbon atoms, preferably 7 to 10 carbon atoms, e.g., phenoxycarbonyl).

When the group represented by $A_1$ is substituted, preferable examples of the substituent among the above-mentioned ones are a halogen atom, an alkoxy group, an acylamino group, a carbamoyl group, an alkyl group, a sulfonamido group, and a nitro group, but it is also preferable if the group represented by $A_1$ is not substituted.

When the group represented by $Y_1$ is substituted, preferable examples of the substituent are a halogen atom, an alkoxycarbonyl group, a sulfamoyl group, a carbamoyl group, a sulfonyl group, a sulfonamido-group, an acylamino group, an alkoxy group, an aryloxy group, an N-acylcarbamoyl group, an N-sulfonylcarbamoyl group, an N-sulfamoylcarbamoyl group, an N-sulfonylsulfamoyl group, an N-acylsulfamoyl group, an N-carbamoylsulfamoyl group, and an N-(N-sulfonylcarbamoyl)sulfamoyl group.

The group represented by $Z_1$ in formula (I) may be any of the conventionally known coupling-off groups. Preferably $Z_1$ represents a nitrogen-containing heterocyclic group that bonds to the coupling position through the nitrogen atom, an aromatic oxy group, an aromatic thio group, a heterocyclic oxy group, a heterocyclic thio group, an acyloxy group, a carbamoyloxy group, an alkylthio group, or a halogen atom. These coupling-off groups may be any of photographically useful groups or their precursors (e.g., development inhibitors, development accelerators, desilvering accelerators, fogging agents, dyes, hardening agents, couplers, developing agent oxidized product scavengers, fluorescent dyes, developing agents, or electron transfers), or nonphotographically useful groups.

When $Z_1$ represents a nitrogen-containing heterocyclic group, particularly it is a monocyclic or condensed, substituted or unsubstituted heterocyclic group. Examples thereof include succinimido, maleinimido, phthalimido, diglycolimido, pyrrolino, pyrazolyl, imidazolyl, 1,2,4-triazol-1-yl (or -4-yl), 1-tetrazolyl, indolyl, benzopyrazolyl, benzimidazolyl, benzotriazolyl, imidazolidine-2,4-dione-3-yl (or -1-yl), oxazolidine-2,4-dione-3-yl, thiazolidine-2,4-dione-3-yl, imidazoline-2-one-1-yl, oxazoline-2-one-3-yl, thiazoline-2-one-3-yl, benzoxazoline-2-one-3-yl, 1,2,4-triazolidine-3,5-dione-4-yl, 2-pyridone-1-yl, morpholine-3,5-dione-4-yl, 1,2,3-triazol-1-yl and 2-imidazoline-5-one.

When these heterocyclic rings are substituted, examples of the substituent are those mentioned as the substituents which the group $A_1$ may have.

When $Z_1$ represents a nitrogen-containing heterocyclic group, preferably it is 1-pyrazolyl, imidazolyl, 1,2,3-triazol-1-yl, benzotriazoly, 1,2,4-triazol-1-yl, oxazolidine-2,4-dione-3-yl, 1,2,4-triazolidine-3,5-dione-4-yl, or imidazolidine-2,4-dione-3-yl, which may be substituted.

When $Z_1$ represents an aromatic oxy group, preferably it is a substituted or unsubstituted phenoxy group. If the aromatic oxy group is substituted, examples of the substituent include the groups mentioned above by which the group represented by $Y_1$ may be substituted. Preferable substituents possessed by the phenoxy group are cases wherein at least one of the substituents is an electron-attracting group, such as a sulfonyl group, an alkoxy carbonyl group, a sulfamoyl group, a halogen atom, a carboxyl group, a carbamoyl group, an acyl group, or a nitro group.

When $Z_1$ represents an aromatic thio group, it is preferably a substituted or unsubstituted phenylthio group. When the aromatic thio group is substituted, examples of the substituent are those groups mentioned above by which the group represented by $Y_1$ may be substituted. Preferable substituents possessed by the phenylthio group are cases wherein at least one of the substituents is an alkyl group, an alkoxy group, a sulfonyl group, an alkoxycarbonyl group, a sulfamoyl group, a halogen atom, a carbamoyl group, or a nitro group.

When $Z_1$ represents a heterocyclic-oxy group, the part of the heterocyclic group has the same meaning as that wherein $Y_1$ represents a heterocyclic ring.

When $Z_1$ represents a heterocyclic-thio group, a preferable example is a 5- to 6-membered unsaturated heterocyclic thio group, such as a tetrazolythio group, a 1,3,4-thiadiazolylthio group, a 1,3,4-oxadiazolylthio group, a 1,3,4-triazolylthio group, a benzoimidazolylthio group, a benzothiadiazolylthio group, and a 2-pyridylthio group. When the heterocyclic thio group is substituted, examples of the substituent are those groups mentioned above by which the heterocyclic group represented by $Y_1$ may be substituted. Out of these, particularly preferable groups are an aromatic group, an alkyl group, an alkylthio group, an acylamino group, an alkoxycarbonyl group, and an aryloxycarbonyl group.

When $Z_1$ represents an acyloxy group, particularly it is an aromatic acyloxy group (having 7 to 11 carbon atoms, preferably benzoyloxy) or an aliphatic acyloxy group (having 2 to 20 carbon atoms, preferably 2 to 10 carbon atoms), which may be substituted. Specific examples of the substituent are the groups mentioned above by which the aromatic group represented by $Y_1$ may be substituted. Preferable substituents are cases wherein at least one of the substituents is a halogen atom, a nitro group,an aryl group, an alkyl group, or an alkoxy group.

When $Z_1$ represents a carbamoyloxy group, it is an aliphatic, aromatic, heterocyclic, or unsubstituted carbamoyloxy group having 1 to 30 carbon atoms, preferably 1 to 20 carbon atoms. Examples thereof include N,N-diethylcarbamoyloxy, N-phenylcarbamoylmorpholinocarbonyloxy, 1-imidazolylcarbonyloxy, and N,N-dimethylcarbamoyloxy. The alkyl group, the aromatic group, and the heterocyclic group have the same meanings as those defined in the description of $Y_1$.

When $Z_1$ represents an alkylthio group, it is an alkylthio group having 1 to 30 carbon atoms, preferably 1 to 20 carbon atoms. In particular the alkyl group has the same meaning as those defined in the description of $Y_1$.

Preferable groups represented by $Z_1$ in formula (I) include 5- to 6-membered nitrogen-containing heterocyclic groups (bonded to the coupling position through the nitrogen atom), aromatic oxy groups, 5- to 6-membered heterocyclic oxy groups, or 5- to 6-membered heterocyclic thio groups.

A preferable group represented by $Y_1$ in formula (I) is an aromatic group, particularly preferably a phenyl group having at least one substituent in the ortho position. The substituent includes those groups mentioned above by which the aromatic group represented by $Y_1$ may be substituted.

When the group represented by $Y_1$ in formula (I) is a phenyl group having at least one substituent in the ortho position, particularly preferably the substituent in the ortho position is a halogen atom, an alkoxy group, an alkyl group, or an aryloxy group.

Particularly preferable couplers out of the yellow couplers represented by formula (I) are represented by the following formula (I-A):

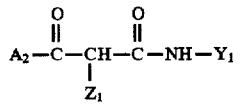

formula (I-A)

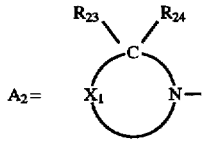

wherein $Y_1$ and $Z_1$ have the same meanings as those described in formula (I), $X_1$ represents $>C(R_{23})(R_{24})$ or an organic residue required to form a nitrogen-containing heterocyclic ring together with >N-, and $R_{23}$ and $R_{24}$ each represent a hydrogen atom or a substituent. Preferable ranges and specific examples of $Y_1$ and $Z_1$ are the same as those described for formula (I).

Specific examples of the heterocyclic group represented by $A_2$ in formula (I-A) and specific examples of the substituent on the heterocyclic group include those mentioned as examples described for $A_1$ in formula (I). Preferable ranges thereof are the same as those described for $A_1$ in formula (I). Particularly preferably, the nitrogen-containing heterocyclic group is a ring condensed with a benzene.

Out of the couplers represented by formula (I-A), more preferable couplers are those represented by the following formula (I-B):

formula (I-B)

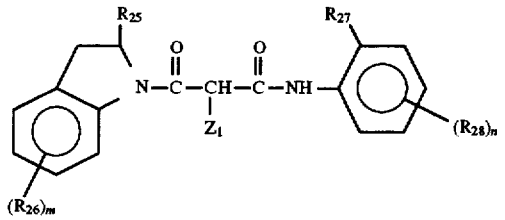

wherein $R_{25}$ represents a hydrogen atom or a substituent, $R_{26}$, $R_{27}$, and $R_{28}$ each represent a substituent, $Z_1$ has the same meaning as that described in formula (I), m and n are each an integer of 0 to 4, and when m and n are each an integer of 2 or more, $R_{26}$'s and $R_{28}$'s are the same or different or bond together to form a ring.

When $R_{25}$ and $R_{26}$ in formula (I-B) each represent a substituent, examples of the substituent are the same as those of the substituent which may be possessed by the group represented by formula $A_1$ in formula (I). A preferable example of $R_{25}$ is a hydrogen atom, an alkyl group, or an aryl group, and a preferable example of $R_{26}$ is a halogen atom, an alkoxy group, an acylamino group, a carbamoyl group, an alkyl group, a sulfonamido group, a cyano group, or a nitro group. m is preferably an integer of 0 to 2, particularly preferably 0 or 1.

Examples of the substituents represented by $R_{27}$ and $R_{28}$ in formula (I-B) are the same as those of the substituent which may be possessed by the group represented by $Y_1$ in formula (I). Preferably $R_{27}$ represents a halogen atom, an alkoxy group, an alkyl group, or an aryloxy group, and preferable examples of $R_{28}$ are the same as those mentioned as preferable examples of the substituent which may be possessed by the group represented by $Y_1$ in formula (I). n is an integer of 0 to 2, and more preferably 1 or 2.

The couplers represented by formulas (I), (I-A), and (I-B) may form a dimer or more higher polymer by bonding through a divalent group or more higher polyvalent group at $X_1$, $Y_1$, and $Z_1$. In that case, the range of the number of carbon atoms may fall outside the above defined range shown in each of the above substituents.

Specific examples of the coupler represented by formula (I) are shown below, but the present invention is not restricted to them:

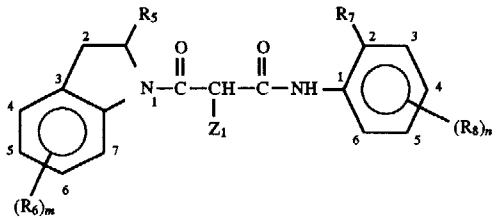

| No. | $R_5$ | m | $R_6$ | $R_7$ | n | $R_8$ | $Z_1$ |
|---|---|---|---|---|---|---|---|
| 1 | H | 0 | — | $-OCH_3$ | 1 | $-5-SO_2NHCO\underset{\vert}{C}HC_9H_{19}$ (C7H15) | 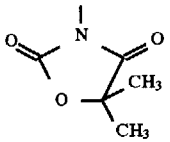 |
| 2 | " | " | — | $-OC_{18}H_{37}(n)$ | 1 | $-5-SO_2NHCO\underset{\vert}{C}HC_4H_9$ ($C_2H_5$) | " |
| 3 | " | " | — | $-OC_{12}H_{25}(n)$ | 1 | $-5-SO_2NHCON(C_3H_7)_2$ | " |
| 4 | " | " | — | $-O-CH_2\underset{\vert}{C}H-C_8H_{17}(n)$ ($C_6H_{13}(n)$) | 1 | $-5-SO_2NHCO\underset{\vert}{C}HC_4H_9$ ($C_2H_5$) | " |
| 5 | H | 0 | — | $-O-\underset{\vert}{C}HCOOC_{12}H_{25}(n)$ ($CH_3$) | 1 | $-5-SO_2NHCOC_2H_5$ | 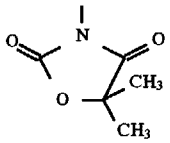 |
| 6 | " | " | — | $-OCH_2\underset{\vert}{C}H$ ($CH(CH_3)CH_2C(CH_3)_3$; $(CH_2)_2CH(CH_3)CH_2C(CH_3)_3$) | 1 | $-5-SO_2NHCOC_2H_5$ | " |
| 7 | " | " | — | $-OCH_2COOCH_2\underset{\vert}{C}HC_8H_{17}$ ($C_{10}H_{21}$) | 1 | $-5-SO_2NHCOCH_3$ | " |
| 8 | " | " | — | 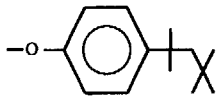 | 1 | $-5-SO_2NHCO\underset{\vert}{C}HC_4H_9$ ($C_2H_5$) | " |

-continued
| | | | | | | | |
|---|---|---|---|---|---|---|---|
| 9 | " | " | — | 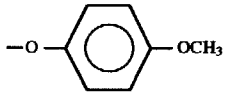 | 1 | 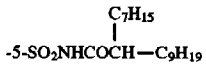 | " |
| 10 | H | 0 | — | 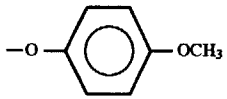 | 1 | -5-$CONHSO_2C_{12}H_{25}$ | 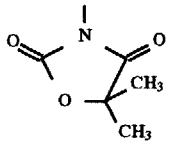 |
| 11 | " | " | — | 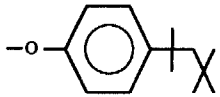 | 1 | -4-$SO_2NHCOC_9H_{19}$ | " |
| 12 | " | " | — | " | 2 | -4-Cl-5-$CONHSO_2C_{16}H_{33}$(n) | " |
| 13 | " | " | — | " | 2 | -3-Cl-5-$CONHCOC_{11}H_{23}$ | " |
| 14 | " | " | — | $-OCH_3$ | 2 | -3-Cl-5-$CONHSO_2C_{12}H_{25}$(n) | " |
| 15 | H | 0 | — | $-OC_{16}H_{33}$(n) | 1 | 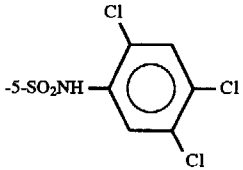 | 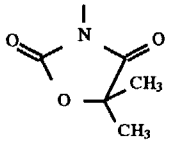 |
| 16 | " | " | — | 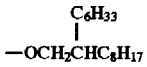 | 1 | 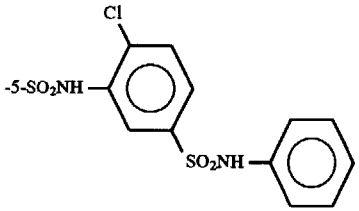 | " |
| 17 | " | " | — | $-OCH(CH_3)_2$ | 1 | 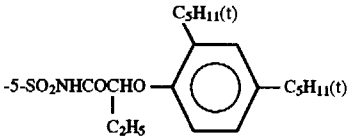 | " |

-continued
| | | | | | | | |
|---|---|---|---|---|---|---|---|
| 18 | " | " | — | $-OC_{18}H_{37}(n)$ | 1 | 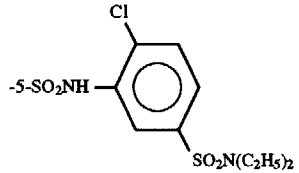 | " |
| 19 | H | 0 | — | 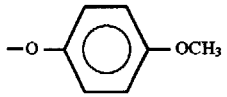 | 1 | 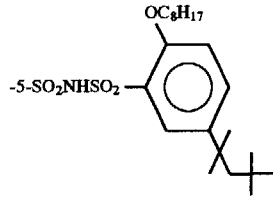 | 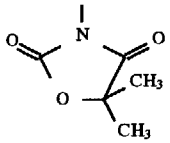 |
| 20 | " | " | — | $-OC_2H_5$ | 1 | " | 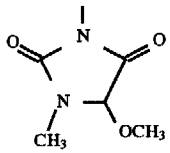 |
| 21 | " | " | — | $-OC_{18}H_{37}(n)$ | 2 | -4-Cl-5-$CONHSO_2C_{12}H_{25}$ | 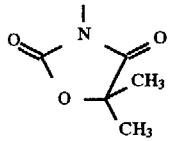 |
| 22 | " | " | — | " | 1 | 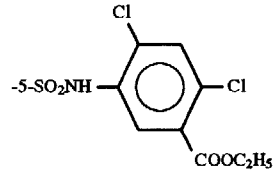 | " |
| 23 | H | 0 | — | 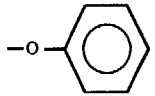 | 1 | 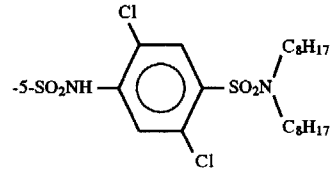 | 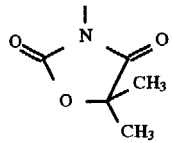 |

-continued
| | | | | | | | |
|---|---|---|---|---|---|---|---|
| 24 | " | " | — | $-OCH(CH_3)_2$ | 1 | 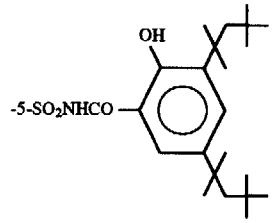 | " |
| 25 | $CH_3$ | " | — | $-OC_2H_5$ | 1 | $-5\text{-}SO_2NHCO\text{-}C_7H_{15}\text{-}CHC_9H_{19}$ | " |
| 26 | H | " | — | $-OC_{18}H_{37}(n)$ | 1 | 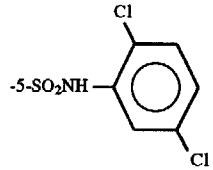 | 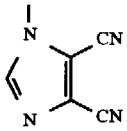 |
| 27 | H | 0 | — | 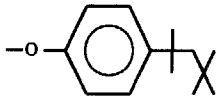 | 1 | 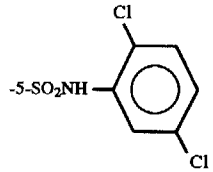 | 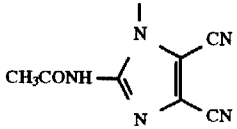 |
| 28 | " | 0 | — | $-OC_{16}H_{33}(n)$ | 1 | $-5\text{-}SO_2NHCOC_2H_5$ | 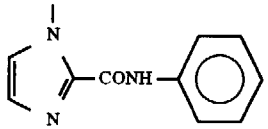 |
| 29 | " | 0 | — | $-Cl$ | 1 | $-5\text{-}CONHSO_2-C_{16}H_{33}(n)$ | 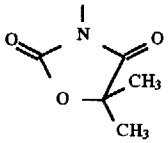 |

-continued
| | | | | | | | |
|---|---|---|---|---|---|---|---|
| 30 | " | 0 | — | " | 1 | -5-NHCO$\underset{\underset{CH_3}{\vert}}{C}$HCH$_2$SO$_2$C$_{12}$H$_{25}$ | 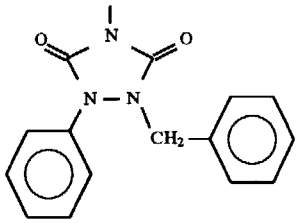 |
| 31 | H | 0 | — | −Cl | 1 | 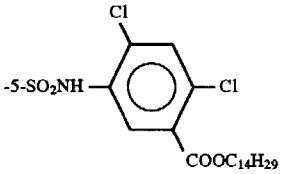 | 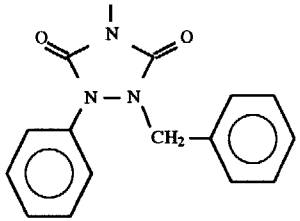 |
| 32 | " | 0 | — | " | 2 | -4-Cl-5-COOC$_{12}$H$_{25}$ | 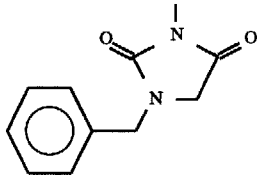 |
| 33 | " | 0 | — | " | 2 | 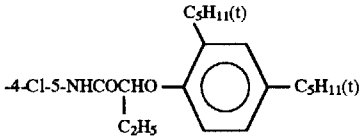 | 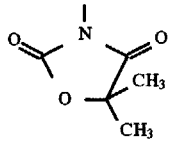 |
| 34 | " | 0 | — | " | 1 | -5-SO$_2$NHC$_{12}$H$_{25}$ | " |
| 35 | " | 0 | — | " | 1 | -5-SO$_2$NHSO$_2$C$_{16}$H$_{33}$(n) | 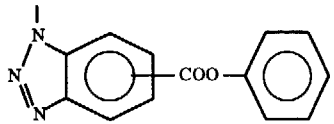 |

-continued
| | | | | | | | |
|---|---|---|---|---|---|---|---|
| 36 | H | 1 | 5-$NO_2$ | $-Cl$ | 1 | -5-NHCOCH($C_4H_9$)O-C$_6$H$_4$-$C_5H_{11}$(t) (2-$C_5H_{11}$(t)) | 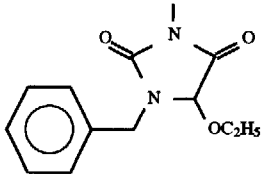 |
| 37 | " | 2 | 5,7-Br | " | 1 | -5-$NHSO_2C_{16}H_{33}$(n) | " |
| 38 | " | 0 | — | $-C_{18}H_{37}$(n) | 1 | -5-$SO_2NH$-C$_6$H$_4$-Cl | 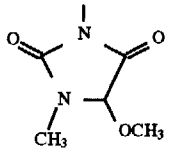 |
| 39 | " | 0 | — | " | 1 | " | 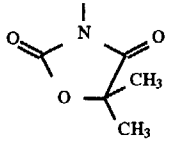 |
| 40 | " | 0 | — | $-OCH_2CH(C_8H_{17})-C_{10}H_{21}$ | 1 | -5-$SO_2NH$-C$_6$H$_5$ | " |
| 41 | H | 1 | 5-Cl | $-Cl$ | 1 | -5-$NHSO_2C_{16}H_{33}$ | 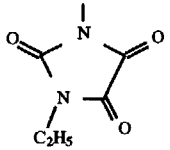 |
| 42 | 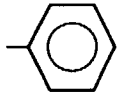 | 1 | 5-$NO_2$ | $-C_{14}H_{29}$ | 1 | -5-$SO_2NH$-C$_6$H$_3$(2-Cl)-Cl | 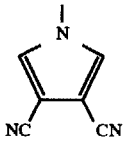 |

-continued
| | | | | | | | |
|---|---|---|---|---|---|---|---|
| 43 | H | 1 | 5-Br | —Cl | 1 | -5-COOCH(CH$_3$)—COOC$_{12}$H$_{25}$ | 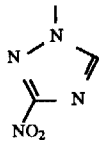 |
| 44 | " | 1 | " | " | 1 | " | 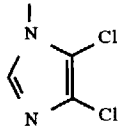 |
| 45 | " | 1 | 5-Cl | " | 1 | -5-NHSO$_2$C$_{12}$H$_{25}$ | 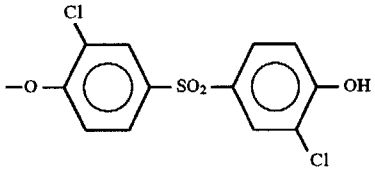 |
| 46 | H | 1 | 5-NO$_2$ | —Cl | 1 | -5-NHSO$_2$C$_{12}$H$_{25}$ | 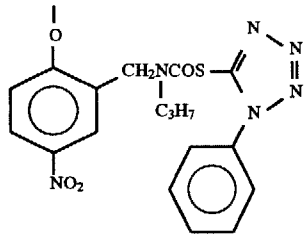 |
| 47 | " | 0 | — | " | 1 | 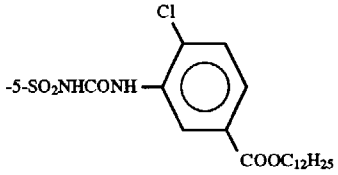 | 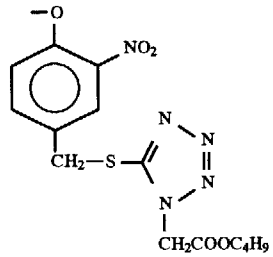 |

-continued
| | | | | | | | |
|---|---|---|---|---|---|---|---|
| 48 | " | 1 | 5-$OCH_3$ | " | 2 | -4-Cl-5-$COOC_{12}H_{25}$ | 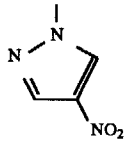 |
| 49 | " | 1 | 5-$NO_2$ | $-CF_3$ | 1 | 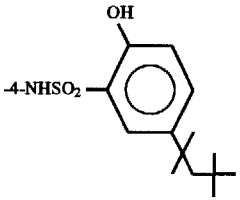 | 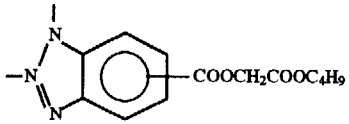 |
| 50 | H | 0 | — | $-OC_2H_5$ | 1 | -5-$SO_2C_{12}H_{25}$ | 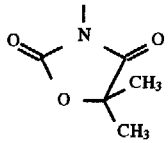 |
| 51 | " | 0 | — | $-Cl$ | 1 | 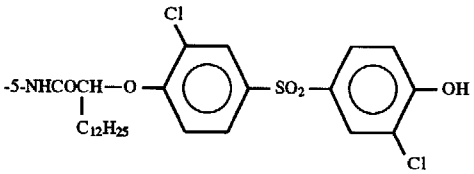 | " |
| 52 | $C_2H_5$ | 0 | — | " | 1 | 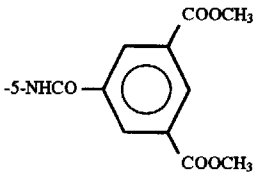 | 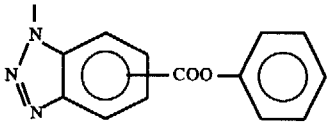 |
| 53 | H | 0 | — | " | 1 | 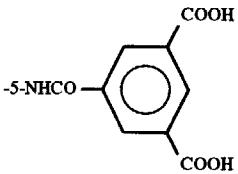 | 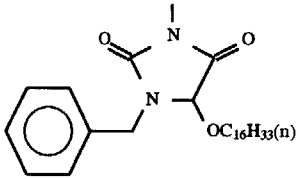 |

-continued
| | | | | | | | |
|---|---|---|---|---|---|---|---|
| 54 | H | 0 | — | —Cl | 1 | -5-$SO_2NHCOC_{11}H_{23}$ | 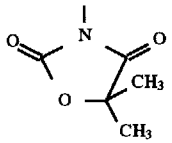 |
| 55 | H | 0 | — | 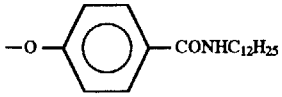 | 1 | 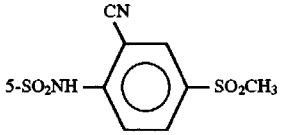 | 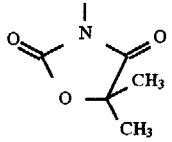 |
| 56 | H | 1 | Br | 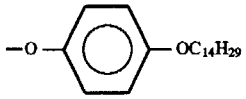 | 1 | 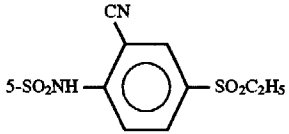 | " |
| 57 | H | 0 | — | 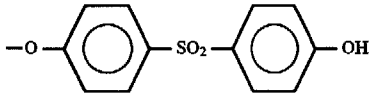 | 1 | 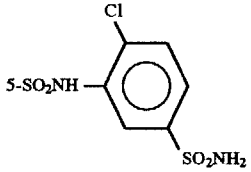 | " |
| 58 | H | 0 | — | 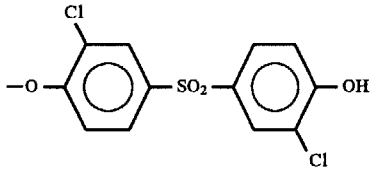 | 1 | 5-$SO_2NHC_{14}H_{29}$ | 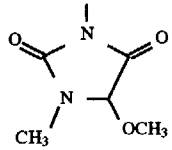 |
| 59 | " | 0 | — | 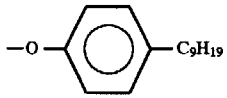 | 1 | 5-$SO_2NHCONHC_{12}H_{25}$ | 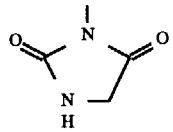 |

-continued
| | | | | | | | |
|---|---|---|---|---|---|---|---|
| 60 | " | 0 | — | 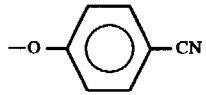 | 1 | 5-$NHSO_2C_{16}H_{33}$(n) | 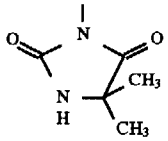 |
| 61 | " | 0 | — | 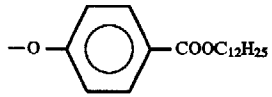 | 1 | 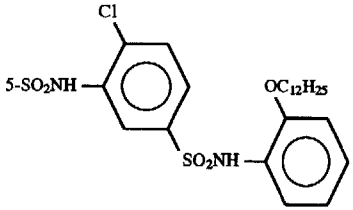 | 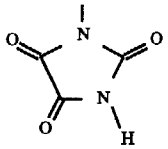 |
| 62 | H | 0 | — | 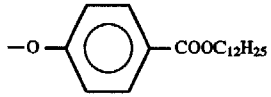 | 1 | 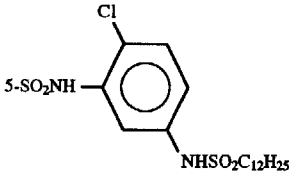 | 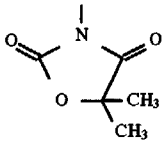 |
| 63 | " | 1 | 5-$NO_2$ | " | 1 | " | 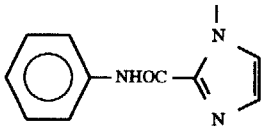 |
| 64 | " | 1 | 5-$NHSO_2CH_3$ | 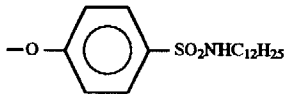 | 1 | 5-$SO_2NH_2$ | 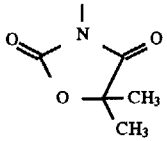 |
| 65 | " | 0 | — | 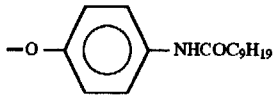 | 2 | 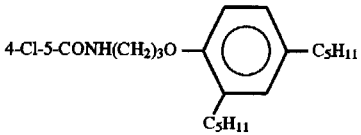 | " |

-continued
| | | | | | | | |
|---|---|---|---|---|---|---|---|
| 66 | $-CH_3$ | 1 | 5-Br | 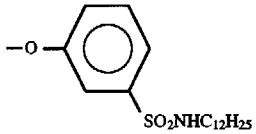 | 1 | 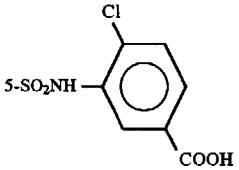 | 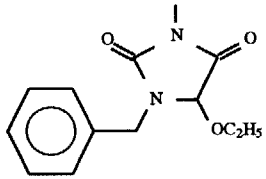 |
| 67 | H | 0 | — | 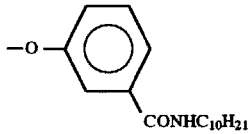 | 1 | 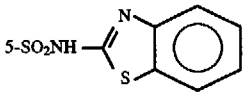 | 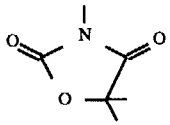 |
| 68 | " | 1 | 5-Br | $-OC_{12}H_{25}$ | 1 | 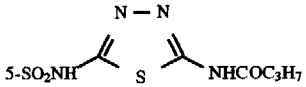 | " |
| 69 | " | 0 | — | 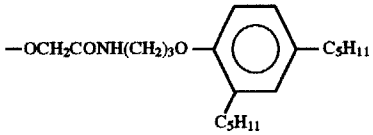 | 1 | 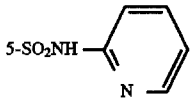 | " |
| 70 | " | 0 | — | 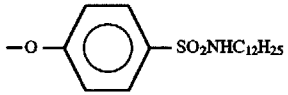 | 1 | 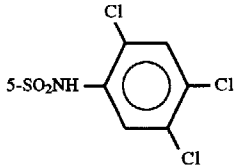 | 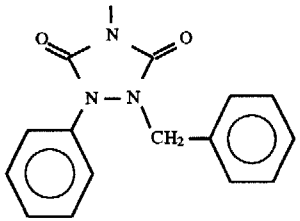 |

-continued
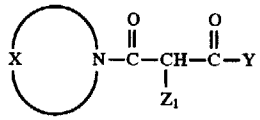
| No. | 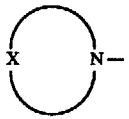 | $Y_1$ | $Z_1$ |
|---|---|---|---|
| 71 | 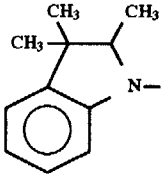 | 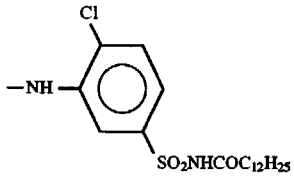 | 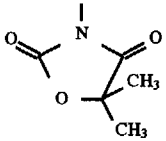 |
| 72 | 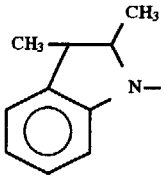 | 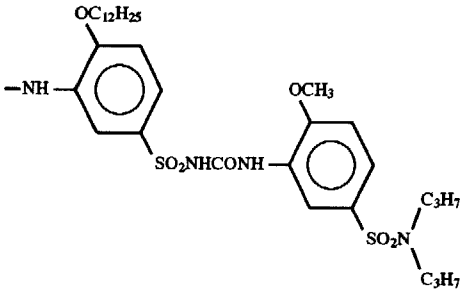 | " |
| 73 | 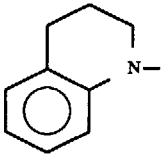 | 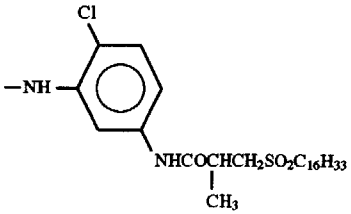 | 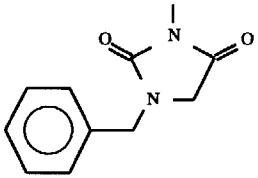 |

-continued
| | | | |
|---|---|---|---|
| 74 | 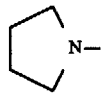 | 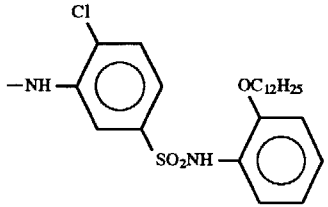 | 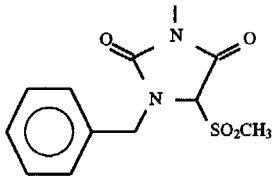 |
| 75 | 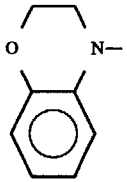 | 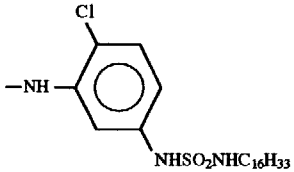 | 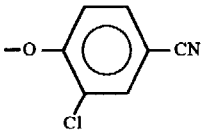 |
| 76 | 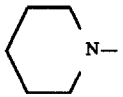 | 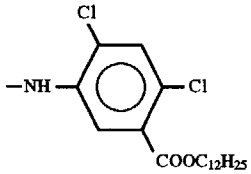 | 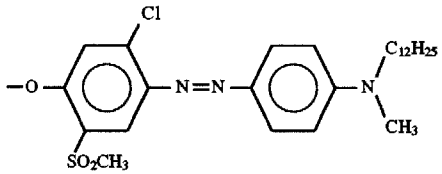 |
| 77 | 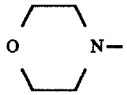 | 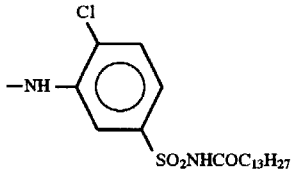 | 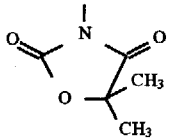 |

-continued
| | | | |
|---|---|---|---|
| 78 | 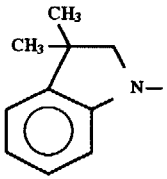 | 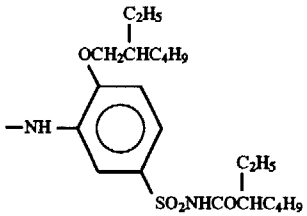 | $SCH_2COOH$ |
| 79 | 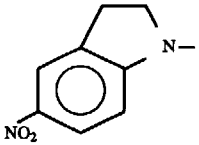 | " | 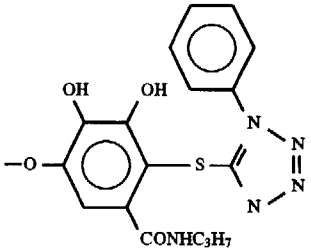 |
| 80 | 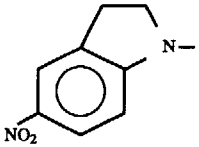 | 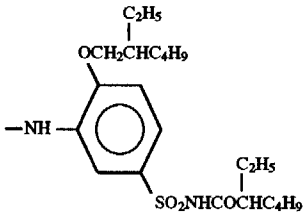 | 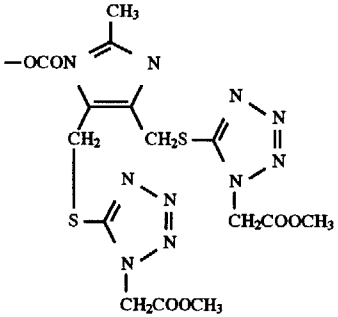 |

-continued
(81)
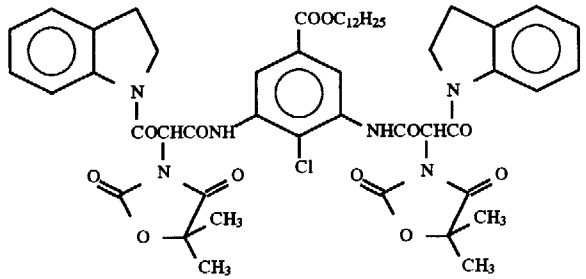
(82)
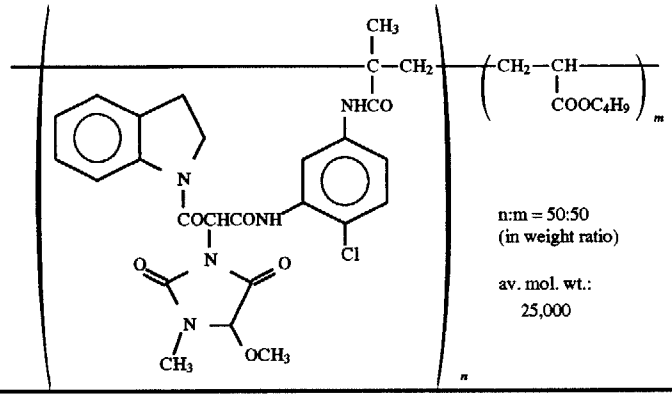

As the synthetic method of the compound of the present invention, the conventional known method, such as a method described in European Patent No. 482552A1, or a method similar to it can be used.

Now, the yellow coupler represented by formula (II) is described in detail.

In formula (II), $Z_2$ represents a hydrogen atom or a group capable of being released upon coupling reaction of the coupler represented by formula (II) with the oxidized product of an aromatic primary amine developing agent (hereinafter referred to as a coupling-off group), and $Y_2$ has the same meaning as that of $Y_1$ of formula (I).

The yellow coupler represented by formula (II) of the present invention is preferably represented by the following formula (II-A):

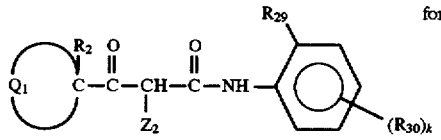

formula (II-A)

wherein $R_2$ represents a monovalent substituent excluding a hydrogen atom, $Q_1$ represents a group of nonmetallic atoms required to form with the carbon atom a 3- to 5-membered cyclic hydrocarbon group or a 3- to 6-membered heterocyclic ring containing at least one heteroatom selected from N, S, O, and P in the ring, $R_{29}$ represents a hydrogen atom, a halogen atom (e.g., fluorine, chlorine, bromine, and iodine, which is applied to the description of formula (II-A)), an alkoxy group, an aryloxy group, an alkylthio group, an arylthio group, an alkyl group, or an amino group, $R_{30}$ represents a group capable of substitution on the benzene ring, $Z_2$ represents a hydrogen atom or a coupling-off group, k is an integer of from 0 to 4, when k is an integer of 2 to 4, $R_{30}$'s are the same or different, or $R_2$ bonds to $Q_1$ to form a bicyclo ring or more higher polycyclo ring.

Examples of $R_{30}$ are a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, a ureido group, a sulfamoylamino group, an alkoxycarbonylamino group, an aryloxysulfonyl group, an acyloxy group, a nitro group, a heterocyclic group, a cyano group, an acyl group, an acyloxy group, an alkylsulfonyloxy group, and an arylsulfonyloxy group, and examples of the coupling-off group represented by $Z_2$ are a heterocyclic group that bonds to the coupling active position through the nitrogen atom, an aryloxy group, an arylthio group, an acyloxy group, an alkylsulfonyloxy group, an arylsulfonyloxy group, a heterocyclic oxy group, a heterocyclic-thio group, and a halogen atom.

Substituents preferably used in formula (II-A) are now described below.

In formula (II-A), $R_2$ preferably represents a halogen atom, a cyano group, a substituted or unsubstituted monovalent group having 1 to 30 carbon atoms (e.g., an alkyl group, an alkoxy group, and an alkylthio group), or a substituted or unsubstituted monovalent group having 6 to 30 carbon atoms (e.g., an aryl group, an aryloxy group, and an arylthio group) and examples of the substituent are a halogen atom, an alkyl group, an alkoxy group, a phenyl group, a nitro group, an amino group, a carbonamido group, a sulfonamido group, and an acyl group.

In formula (II-A), preferably $Q_1$ represents a group of nonmetallic atoms required to form with the carbon atom a substituted or unsubstituted 3- to 5-membered cyclic hydrocarbon ring having 3 to 30 carbon atoms or a substituted or unsubstituted 3- to 6-membered heterocyclic ring containing at least one heteroatom selected from N, S, O, and P in the ring and having 2 to 30 carbon atoms. The ring formed by $Q_1$ together with the carbon may contain a unsaturated bond in the ring. Examples of the ring formed by $Q_1$ together with the carbon are a cyclopropane ring, a cyclobutane ring, a cyclopentane ring, a cyclopropene ring, a cyclobutene ring, a cyclopentene ring, an oxetane ring, an oxolane ring, a 1,3-dioxolane ring also, a thietane ring, a thiolane ring, a pyrrolidine ring, a tetrahydropyran ring, a 1,3-dioxane ring, a 1,4-dioxane ring, a tetrahydrothiopyran ring, an oxathiane zing, and a morpholine ring. Examples of the substituent are a halogen atom, a hydroxyl group, an alkyl group, an aryl group, an acyl group, an alkoxy group, an aryloxy group, a cyano group, an alkoxycarbonyl group, an alkylthio group, and an arylthio group.

$Q_1$ may bond to $R_2$, to form a bicyclo alkyl group or more higher polycyclo alkyl group together with the carbon atom bonded to $Q_1$. Examples of such a group are a bicyclo(2.1.0)pentane-1-yl group, a bicyclo(2.2.0)hexane-1-yl group, a bicyclo(3.1.0)hexane-1-yl group, a bicyclo(3.2.0)heptane-1-yl group, a bicyclo(3.3.0)octane-1-yl group, a bicyclo(4.1.0)heptane-1-yl group, a bicyclo(4.2.0)octane-1-yl group, a bicyclo(4.3.0)nonane-1-yl group, a bicyclo(5.1.0)octane-1-yl group, a bicyclo(5.2.0)nonane-1-yl group, a bicyclo(1.1.1)pentane-1-carbonyl group, a bicyclo(2.1.1)hexane-1-carbonyl group, a bicyclo(2.2.1)heptane-1-carbonyl group, a bicyclo(2.2.2)octane-1-carbonyl group, a tricyclo(3.1.1.03,6)heptane- 6-carbonyl group, a tricyclo(3.3.0.03,7)octane-1-carbonyl group, and a tricyclo(3.3.1.03,7)nonane-3-carbonyl group, each of which groups may be substituted. Examples of the substituent are those substituents mentioned in the description of $Q_1$, and the substituents are desirably in positions excluding the β-position to the bonded carbonyl group.

In the present invention, out of the acyl groups represented by $B_1$ of formula (II), a 1-alkylcyclopropane-1-carbonyl group, a bicyclo(2.1.0)pentane-1-carbonyl group, a bicyclo(3.1.0)hexane-1-carbonyl group, a bicyclo(4.1.0)heptane-1-carbonyl group, a bicyclo(2.2.0)hexane-1-carbonyl group, a bicyclo(1.1.1)pentane-1-carbonyl group, a bicyclo(2.1.1)hexane-1-carbonyl group, and a tricyclo(3.1.1.03,6)heptane-6-carbonyl group are more preferable.

Out of them, a 1-alkylcyclopropane-1-carbonyl group is most preferable. Preferably the 1-position alkyl group of the 1-alkylcyclopropane-1-carbonyl group is a substituted or unsubstituted alkyl group having 2 to 18 carbon atoms, more preferably a substituted or unsubstituted alkyl group having 2 to 12 carbon atoms that is not branched at the Q-position. Particularly, an ethyl group, a propyl group, a butyl group, a benzyl group, and a phenethyl group are preferable.

In formula (II-A), $R_{29}$ is preferably a halogen atom, an alkoxy group having 1 to 30 carbon atoms, an aryloxy group having 6 to 30 carbon atoms, an alkyl group having 1 to 30 carbon atoms, or an amino group having 0 to 30 carbon atoms, each of which groups may be substituted, and examples of the substituent are a halogen atom, an alkyl group, an alkoxy group, and an aryloxy group.

In formula (II-A), $R_{30}$ preferably represents a halogen atom, an alkyl group having 1 to 30 carbon atoms, an aryl group having 6 to 30 carbon atoms, an alkoxy group having 1 to 30 carbon atoms, an alkoxycarbonyl group having 2 to 30 carbon atoms, an aryloxycarbonyl group having 7 to 30 carbon atoms, a carbonamido group having 1 to 30 carbon atoms, a sulfonamido group having 1 to 30 carbon atoms, a carbamoyl group having 1 to 30 carbon atoms, a sulfamoyl group having 0 to 30 carbon atoms, an alkylsulfonyl group having 1 to 30 carbon atoms, an arylsulfonyl group having 6 to 30 carbon atoms, a ureido group having 1 to 30 carbon atoms, a sulfamoylamino group having 0 to 30 carbon atoms, an alkoxycarbonylamino group having 2 to 30 carbon atoms, a heterocyclic group having 1 to 30 carbon atoms, an acyl group having 1 to 30 carbon atoms, an alkylsulfonyloxy group having 1 to 30 carbon atoms, or an arylsulfonyloxy group having 6 to 30 carbon atoms, each of which groups may be substituted, and examples of the substituent are a halogen atom, an alkyl group, an aryl group, a heterocyclic group, an alkoxy group, an aryloxy group, a heterocyclic-oxy group, an alkylthio group, an arylthio group, a heterocyclic-thio group, an alkylsulfonyl group, an arylsulfonyl group, an acyl group, a carbonamido group, a sulfonamido group, a carbamoyl group, a sulfamoyl group, an alkoxycarbonylamino group, a sulfamoylamino group, a ureido group, a cyano group, a nitro group, an acyloxy group, an alkoxycarbonyl group, an aryoxycarbonyl group, an alkylsulfonyloxy group, and an arylsulfonyloxy group.

In formula (II-A), k is preferably an integer of 1 or 2, and the position of the substitution of $R_{30}$ is preferably the meta position or the para position to the acylacetamido group.

In formula (II-A), $Z_2$ preferably represents an aryloxy group or a heterocyclic group bonded with the nitrogen atom to the coupling active site.

When $Z_2$ represents a heterocyclic group, the heterocyclic group may be substituted and preferably is a group selected from an imidazolidine-2,4-dione-3-yl group, an oxazolidine-2,4-dione-3-yl group, a 1,2,4-triazolidine-3,5-dione-4-yl group, a succinimido group, a 1-pyrazolyl group, and a 1-imidazolyl group.

When $Z_2$ represents an aryloxy group, preferably the aryloxy group is substituted by at least one electron-attracting substituent (e.g., halogen, cyano, nitro, trifuloromethyl, acyl, alkylsulfonyl, arylsulfonyl, alkoxycarbonyl, carbamoyl, and sulfamoyl).

$Z_2$ is particularly preferably the above mentioned 5-membered heterocyclic group.

The coupler represented by formula (II-A) may form a dimer or more higher polymer by bonding through a bond or a divalent or more higher polyvalent group at the substituent $R_2$, $R_{29}$, $R_{30}$, $Q_1$ or $Z_2$. In that case, the range of the number of carbon atoms may fall outside the above defined range shown in each of the above substituents.

Specific examples of the yellow coupler represented by formula (II) are shown below:

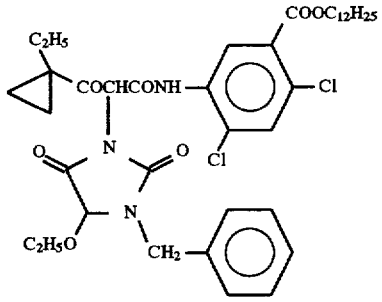

Y-1

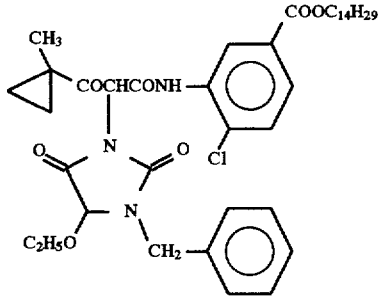

Y-2

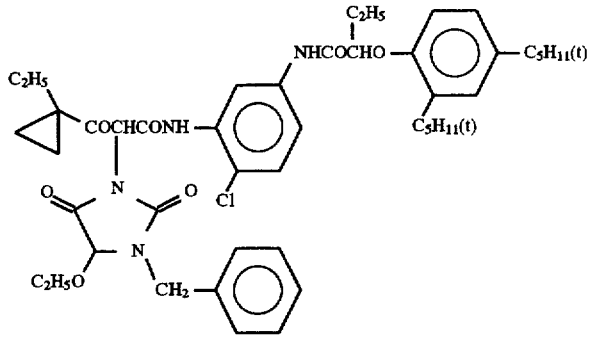

Y-3

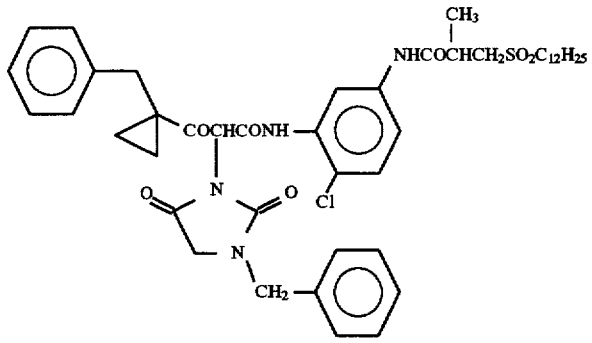

Y-4

-continued
Y-5
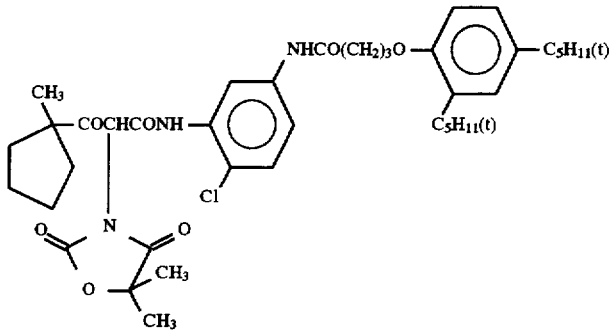
Y-6
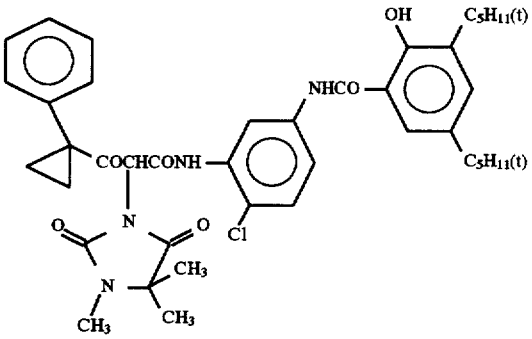
Y-7
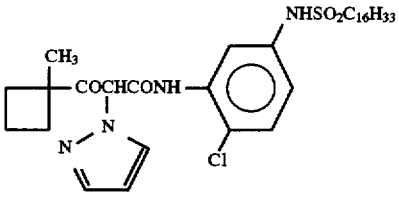
Y-8
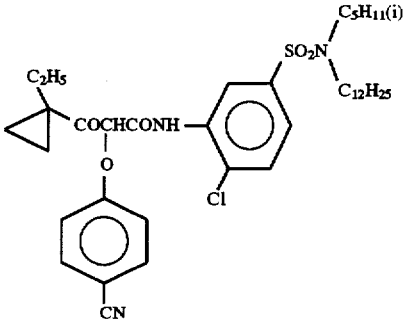
Y-9
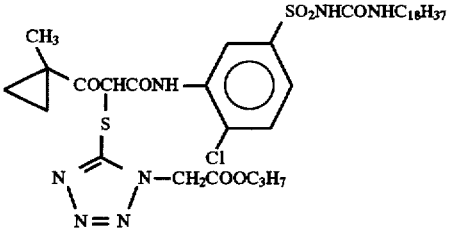
Y-10
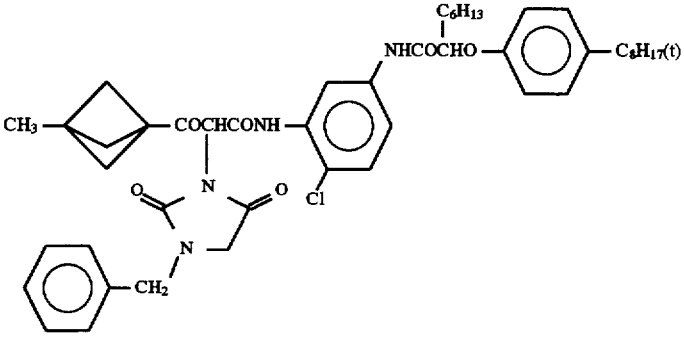

-continued
Y-11
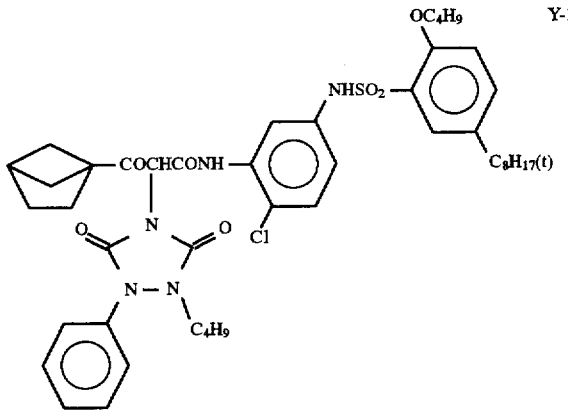
Y-12
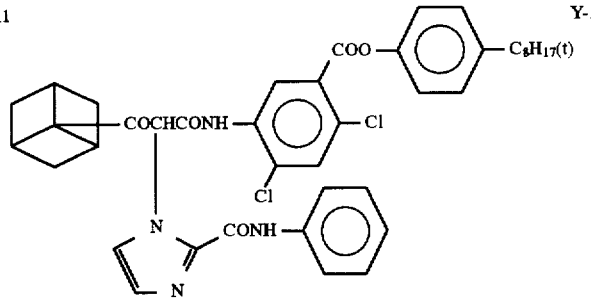
Y-13
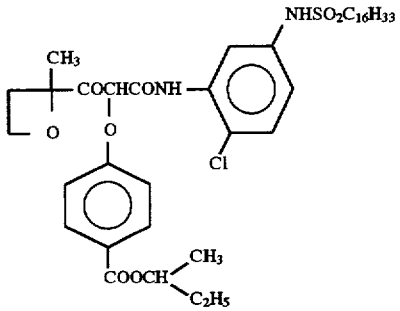
Y-14
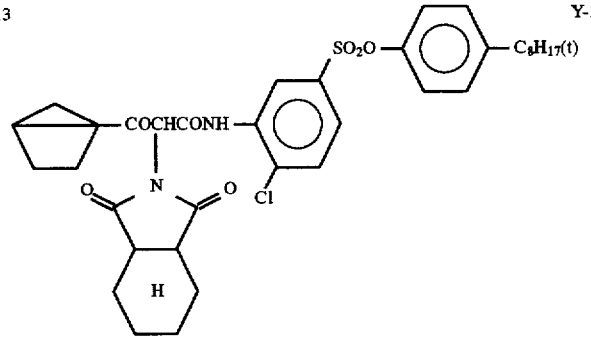
Y-15
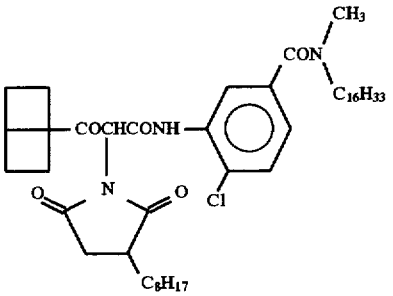
Y-16
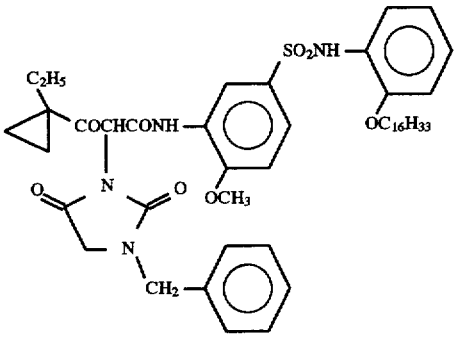
Y-17
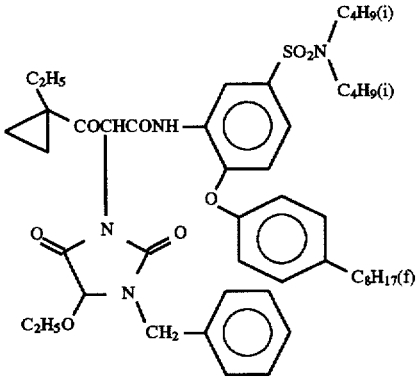

-continued
Y-18
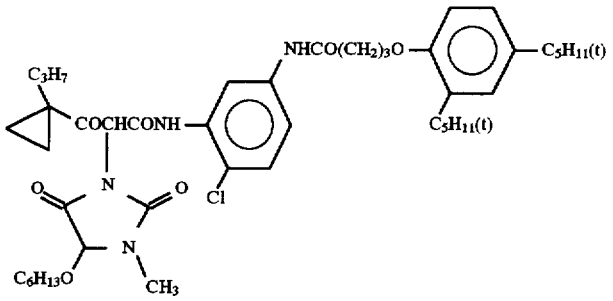
Y-19
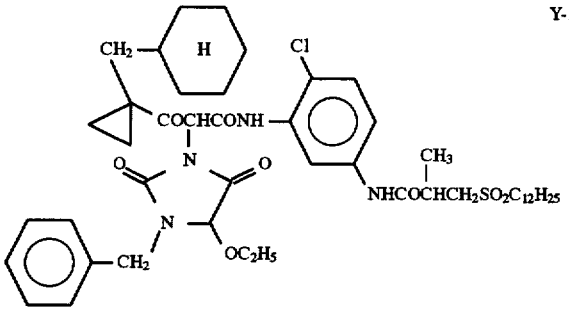
Y-20
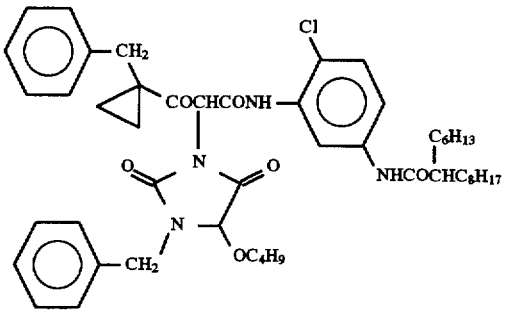
Y-21
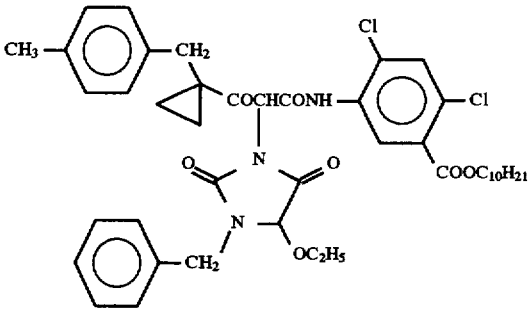
Y-22
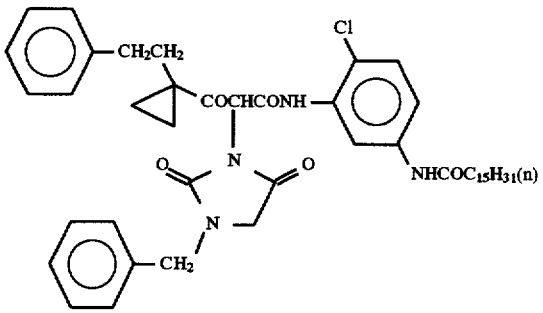
Y-23
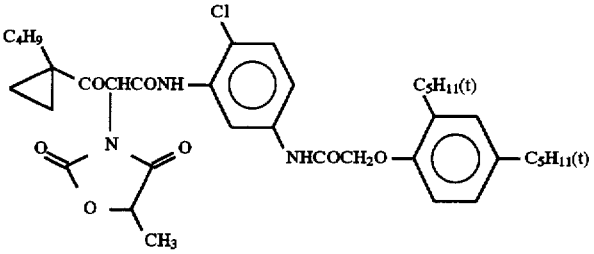
Y-24
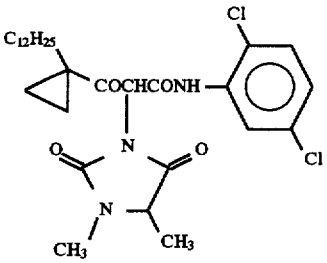
Y-25
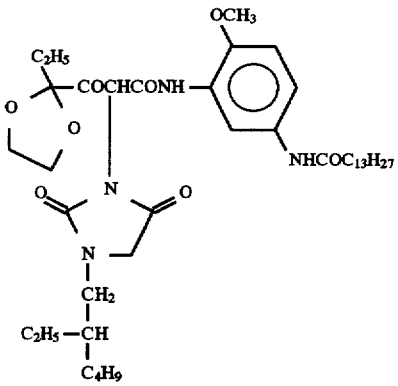

-continued
Y-26
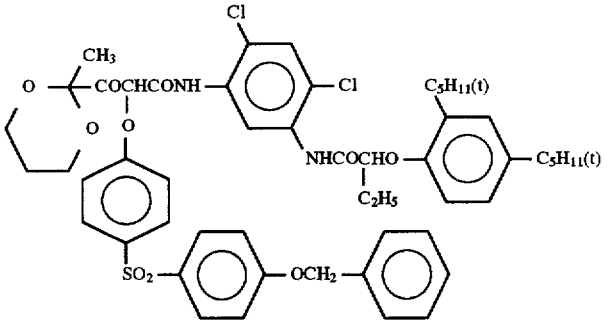
Y-27
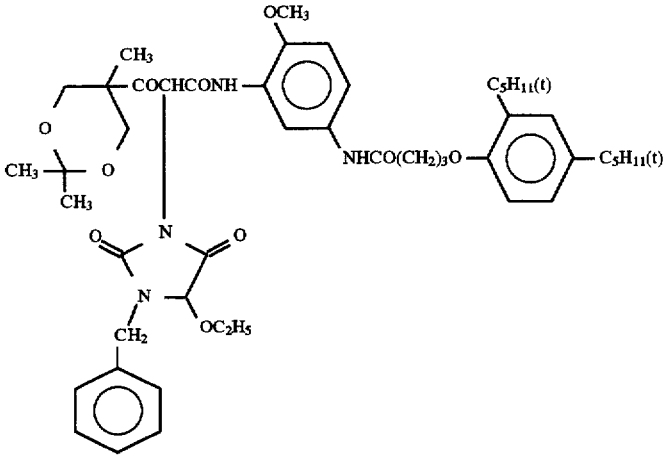
Y-28
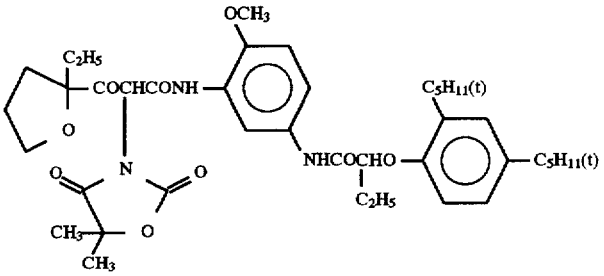
Y-29
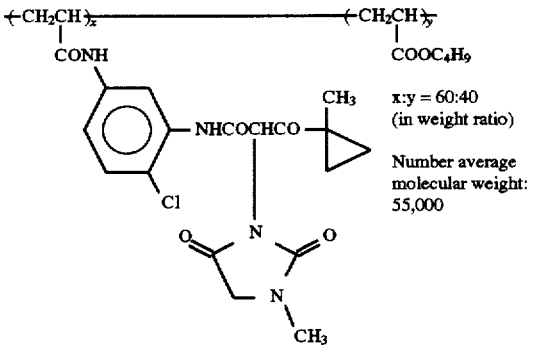
x:y = 60:40
(in weight ratio)
Number average
molecular weight:
55,000

-continued

Y-30

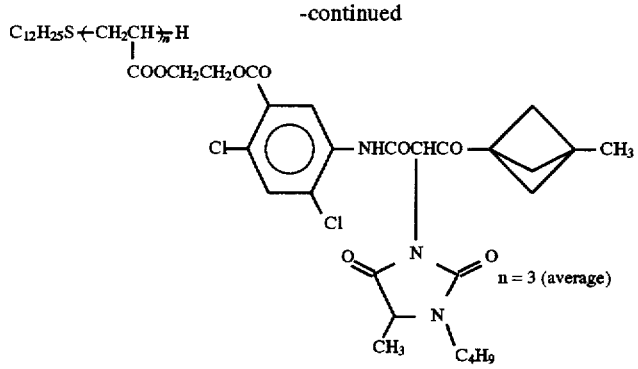

Y-31

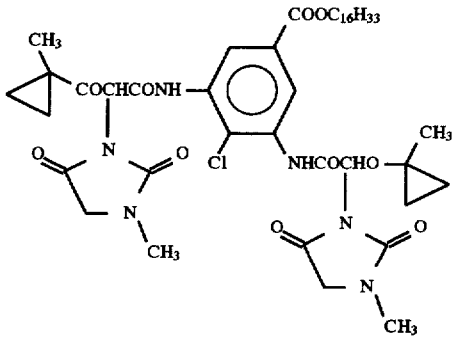

Y-32

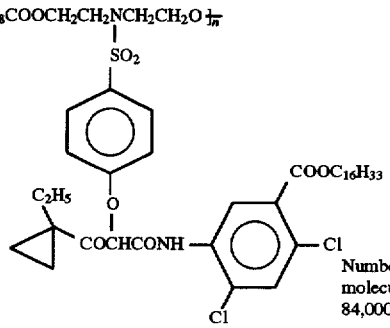

Y-33

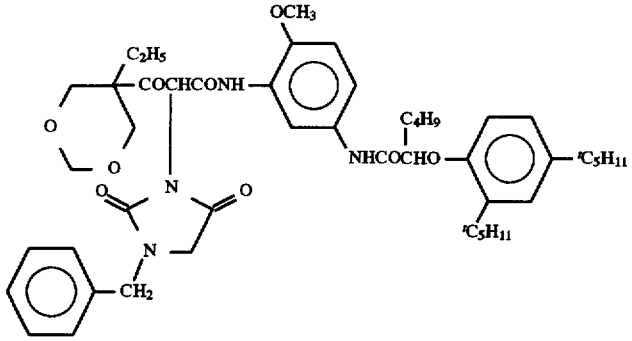

Y-34

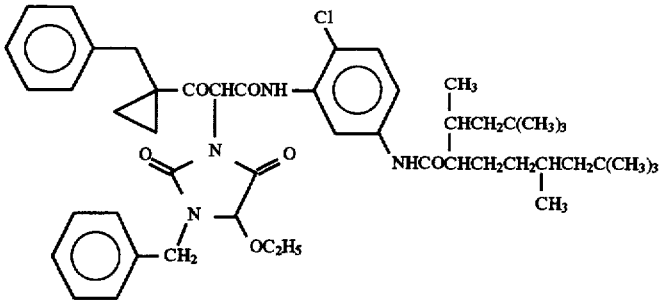

Examples of the acylacetoamido-type yellow coupler of the present invention that are not shown above and the synthetic method for the yellow couplers are described in European Patent Application Publication (EP) No. 447,969A and JP-A Nos. 344640/1992 and 80469/1993.

Now, the yellow coupler represented by formula (III) is described in detail.

In formula (III), D represents a tertiary alkyl group. $Z_3$ has the same meaning as that of $Z_1$ of formula (I). $V_1$ represents a fluorine atom, an alkoxy group, an aryloxy group, a dialkylamino group, an alkylthio group, an arylthio group, or an alkyl group.

In formula (III), $W_1$ represents a group capable of substitution on the benzene ring and more specifically has the same meaning as that of $R_{30}$ of formula (II-A). t is an integer of 1 to 4 and when t is an integer of 2 to 4, $W_1$'s are the same or different.

Preferable substituents of the coupler represented by formula (III) are now described below.

In formula (III), D is preferably a tertiary alkyl group having 4 to 8 carbon atoms, particularly preferably a tert-butyl group.

In formula (III), $V_1$ preferably is an alkoxy group having 1 to 24 carbon atoms or an aryloxy group having 1 to 30 carbon atoms. These alkoxy group and aryloxy group may be substituted by a suitable group, and preferable substituents are a halogen atoms, an alkyl group, an alkoxy group, an aryloxy group, an alkoxycarbonyl group, an acyloxy group, an alkylsulfonyl group, an acylamino group, a carbamoyl group, a sulfonylamino group, and a sulfamoyl group, with particular preference given to an alkoxy group or aryloxy group substituted by a branched-chain or straight-chain alkyl group, alkoxy group, alkoxycarbonyl group, and an alkylsulfonyl group.

In the coupler represented by formula (III), preferably $Z_3$ is the same group as the substituent that is preferable as $Z_2$ of the coupler represented by formula The coupler represented by formula (III) may form a dimer or polymer in the same manner as that of the coupler represented by formula (II).

Specific examples of the yellow coupler represented by formula (III) are shown below, but the present invention is not restricted to them.

YO-1

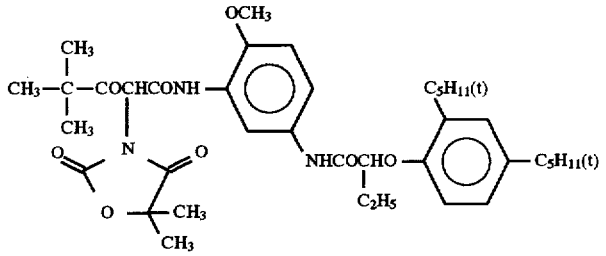

YO-2

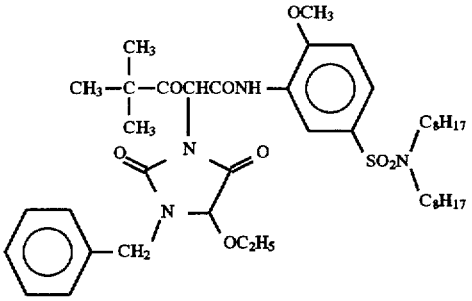

YO-3

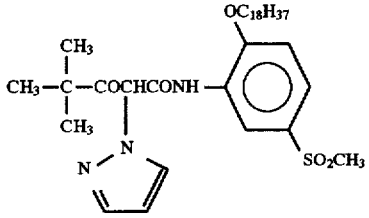

YO-4

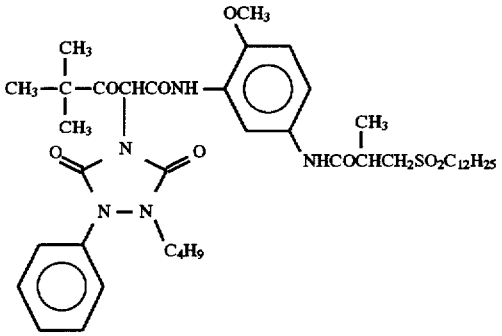

YO-5

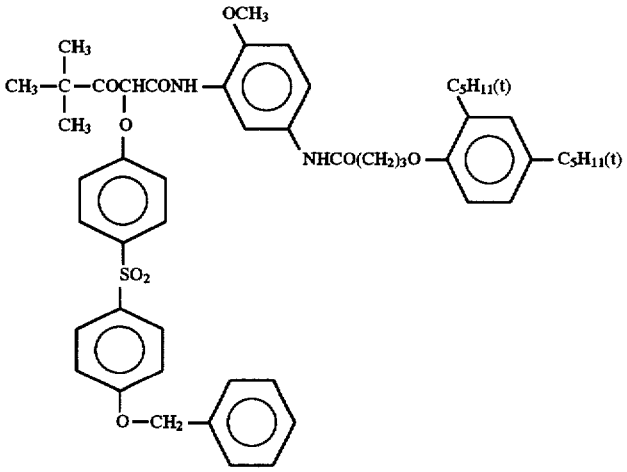

-continued

YO-6

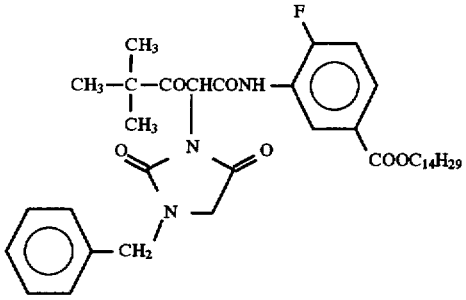

YO-7

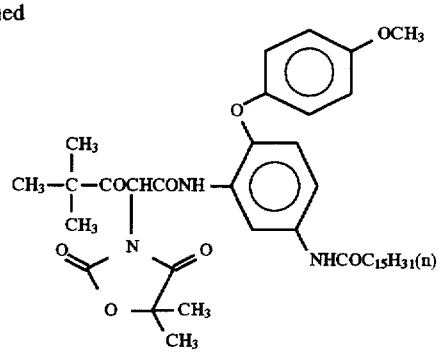

YO-8

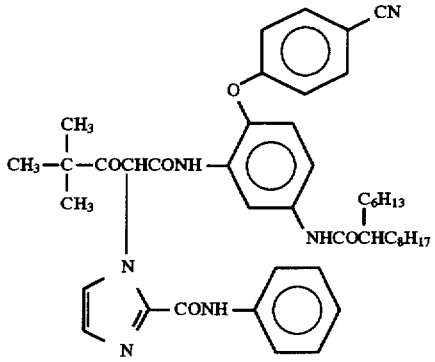

YO-9

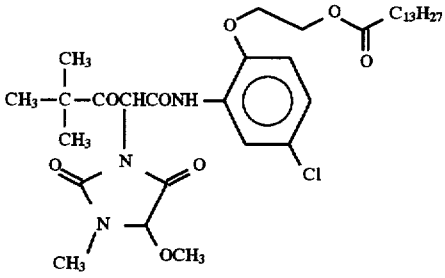

YO-10

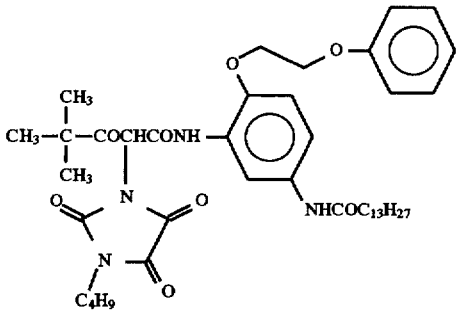

YO-11

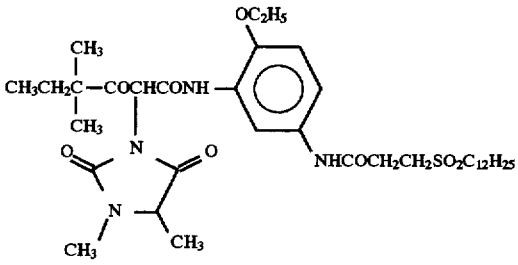

YO-12

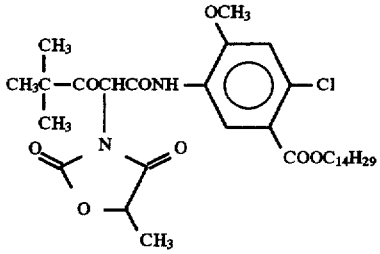

YO-13

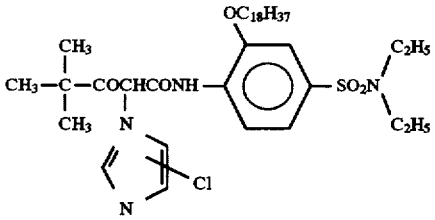

When the yellow coupler of the present invention is applied to a silver halide color photographic material, the support is recommended to have on it at least one layer containing a yellow coupler of the present invention. The layer containing a coupler of the present invention may be any hydrophilic colloid layer on the support, but preferably it is used in a-blue-sensitive silver halide emulsion layer. When it is used for a photographic material for scanning exposure, it can be used in any of photosensitive layers having a spectral sensitivity maximum that matches the wavelength of the laser luminous flux.

A preferable amount of the yellow coupler represented by formula (I), (II), or (III) of the present invention to be used in a silver halide color photographic material is in the range of 0.01 to 10 mmol/m$^2$, more preferably 0.05 to 5 mmol/m$^2$, and most preferably 0.1 to 2 mmol/m$^2$. Of course, two or more couplers of formula (I), (II), or (III) may be used in combination. In that case, the couplers may be those represented by the same formula or different formulas. The couplers represented by formulas (I), (II), and (III) may be used in combination with other couplers that are not represented by formulas (I), (II), or (III). In that case, the ratio of the coupler of the present invention to be used is desirably 30 mol % or more. In these cases, a preferable amount of the coupler represented by formula (I), (II), or (III) of the present invention to be used is the same amount as that mentioned above.

A preferable amount of the silver halide emulsion to be used in the silver halide emulsion layer in which the coupler of the present invention is used is 0.5 to 50 times, more preferably 1 to 20 times, and most preferably 2 to 10 times, the amount of the coupler in terms of mols.

In the present invention, as the method for adding the above coupler to a hydrophilic colloid layer, various known methods can be used. Generally the addition is carried out by an oil-in-water dispersion method that is well known as the oil-protect method. That is, after the coupler is dissolved in a high-boiling organic solvent, such as a phosphate and a phthalate, combined with a low-boiling co-solvent, it is dispersed in an aqueous gelatin solution that contains a surface-active agent. Alternatively, water or an aqueous gelatin solution may be added to a coupler solution containing a surface-active agent, to form an oil-in-water dispersion with a phase inversion. When the coupler is soluble in an alkali, a dispersion method known as the Fischer dispersion method can be used. To remove the low-boiling organic solvent from the obtained dispersion, such a technique as distillation, noodle washing, or ultrafiltration is preferably carried out.

As the dispersion medium for such a coupler, a high-boiling organic solvent having a dielectric constant of 2 to 20 (25° C.) and a refractive index of 1.4 to 1.7 and/or a water-insoluble polymer compound described in U.S. Pat. No. 4,857,449, columns 7 to 15, and in International Publication Patent No. WO 88/00723, pages 12 to 30, can be preferably used. In the present invention, the weight ratio of the dispersing medium to the coupler is from 0.1 to 10, more preferably from 0.3 to 3.

The compound represented by formula (IV) is now described in detail.

In formula (IV), $R_3$ represents a hydrogen atom, an alkyl group, an acyl group, an aryl group, or an alkenyl group. $R_4$, $R_5$, $R_6$, and $R_7$ each represent, independently, an alkyl group having 1 to 12 carbon atoms. $R_8$ represents a hydrogen atom or an alkyl group having 1 to 20 carbon atoms. The methylene group linking the two benzene rings is connected at the ortho position, the meta position, or the para position to the oxygen atoms of the respective rings, and when the methylene group is connected to the para position, $R_5$ or $R_7$ is the linking methylene group itself. In this case, an alkyl group may be present on the benzene ring.

Preferable substituents of the compound represented by formula (IV) are described below.

Preferably the methylene group linking the two benzene rings is connected at the ortho position or the para position to the oxygen atoms.

Preferably $R_3$ is a hydrogen atom, an alkyl group (e.g., methyl, butyl, and benzyl), or an acyl group (e.g., acetyl and acryloyl).

When $R_8$ is not a hydrogen atom, $R_4$ and $R_6$ each are preferably a primary or secondary alkyl group (e.g., methyl, ethyl, isopropyl, cyclohexyl, and benzyl), and preferably $R_5$ and $R_7$ each are a primary alkyl group (e.g., methyl, ethyl, and decyl). When $R_8$ is a hydrogen atom, preferably $R_4$ and $R_6$ each are a secondary or tertiary alkyl group, and $R_5$ and $R_7$ each are a tertiary alkyl group.

When $R_8$ is not a hydrogen atom, preferably $R_8$ is a branched-chain alkyl group having 3 to 12 carbon atoms.

Specific examples of the compound represented by formula (IV) are shown below, but the present invention is not restricted to them.

B-1

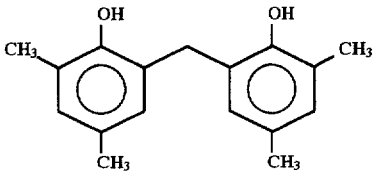

B-2

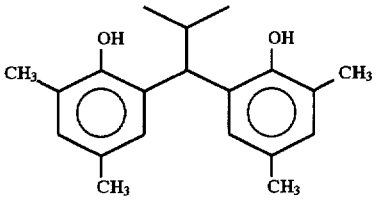

B-3

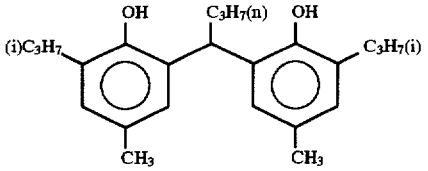

B-4

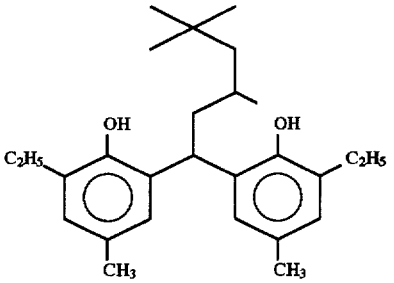

B-5

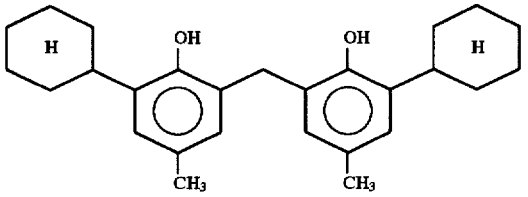

B-6

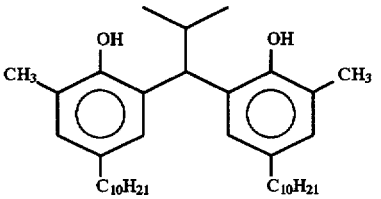

B-7

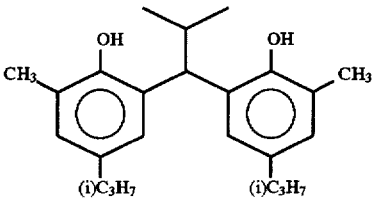

-continued

B-8

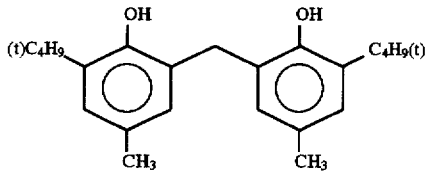

B-9

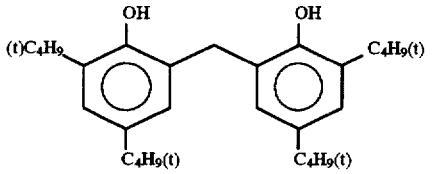

B-10

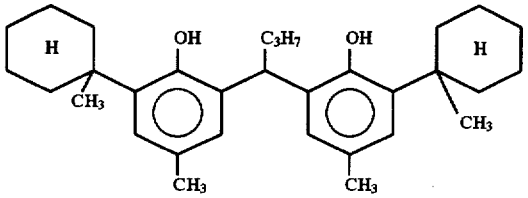

B-11

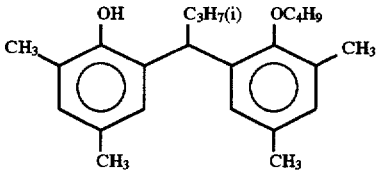

B-12

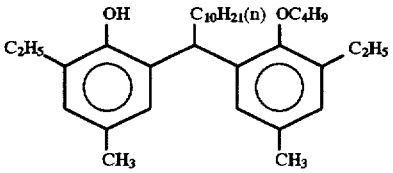

B-13

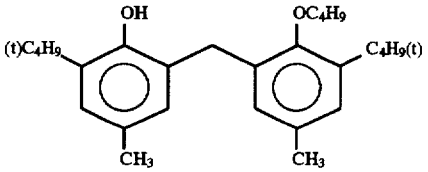

B-14

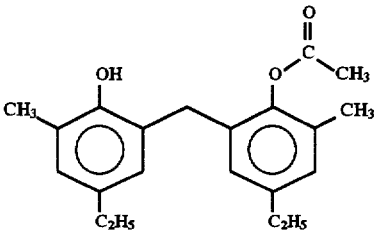

B-15

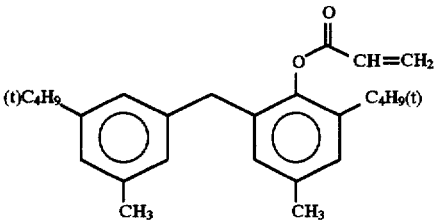

-continued

B-16

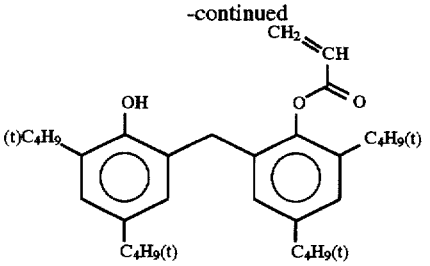

B-17

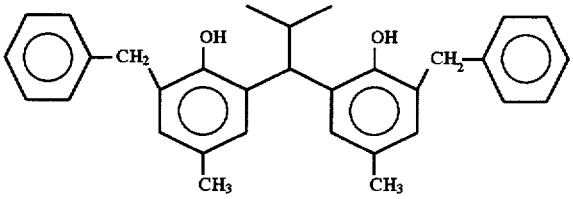

B-18

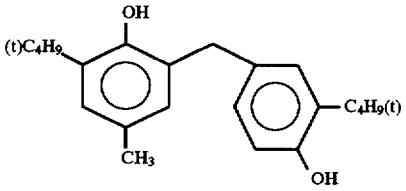

B-19

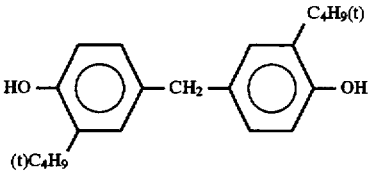

B-20

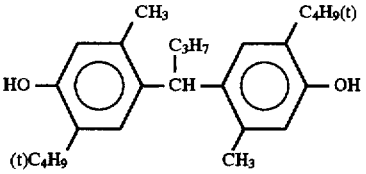

The compound represented by formula (V) is described below in detail.

In formula (V), $R_9$ represents a hydrogen atom, an alkyl group, an aryl group, or an acyl group. $R_{10}$ and $R_{11}$ each represent independently a substituted or unsubstituted alkyl group or alkoxy group. $W_2$ represents a monovalent group capable of substitution on the benzene ring, and examples thereof are the same groups as those of $W_1$ in formula (III).

In formula (V), preferably $R_{10}$ and $R_{11}$ each represent a secondary or tertiary alkyl group, with preference given to a tertiary alkyl group. Preferably $R_9$ represents a hydrogen atom. Preferably $W_2$ represents a substituted or unsubstituted alkoxycarbonyl group, aryloxycarbonyl group, alkyl group, carbonyl group, or sulfamoyl group.

Specific examples of the compound represented by formula (V) are shown below, but the present invention is not restricted to them.

H-1

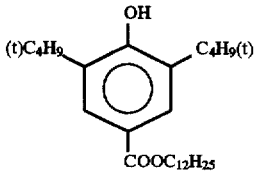

-continued

H-2

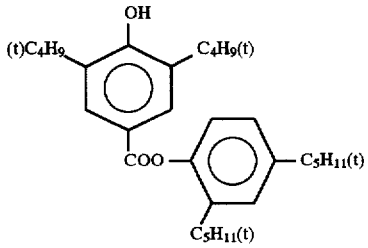

H-3

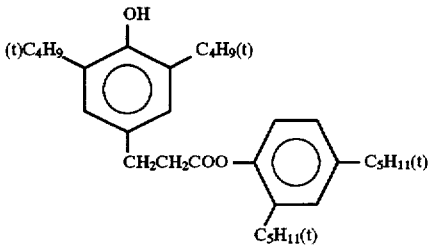

H-4

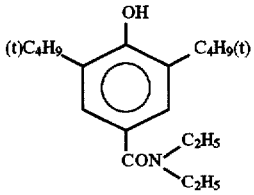

H-5

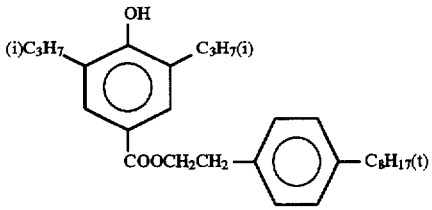

H-6

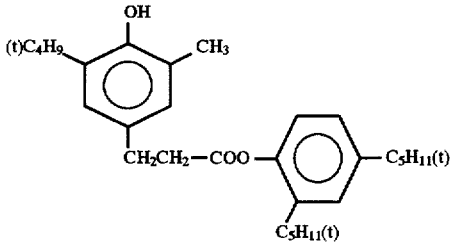

H-7

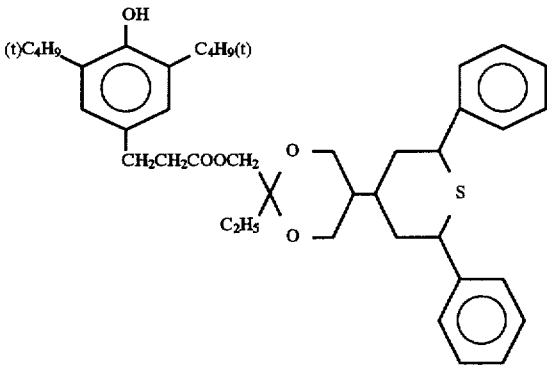

-continued

H-8

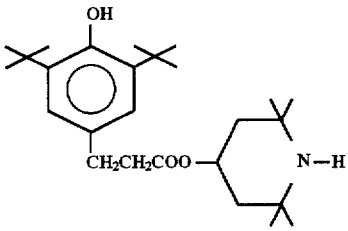

H-9

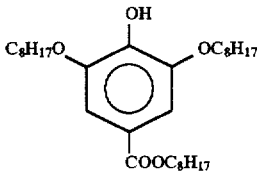

H-10

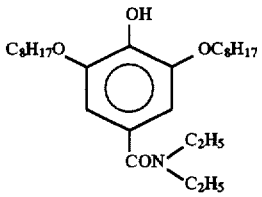

H-11

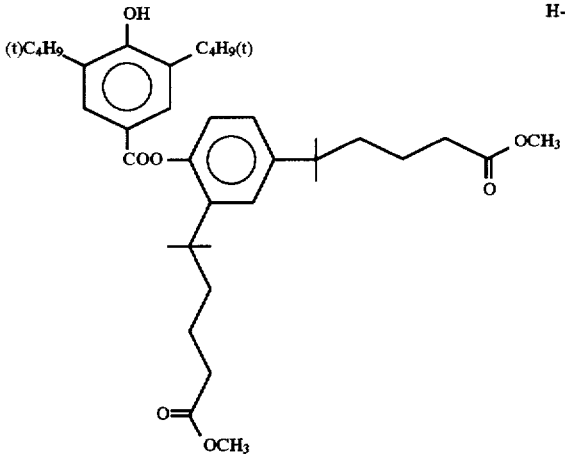

The compound represented by formula (VI) is described further in detail below.

In formula (VI), $Q_2$ represents a divalent group to form a 5- to 7-membered heterocyclic ring together with the nitrogen atom and the alkylene group, and specific examples are groups —$CH_2$—, —O—, —$NR^1$—, —S—, —SO—, $SO_2$—, —$PR^1$—, and —$PO(R^1)$—. Preferably $Q_2$ represents a group —SO—, —$SO_2$—, or —$PO(R^1)$—, more preferably a group —$SO_2$—. $R^1$ represents an alkyl group.

$R_{12}$ represents an alkyl group having 1 to 20 carbon atoms, an alkoxy group, an aryloxy group, or an acyloxy group, which may be substituted.

$W_3$ represents a monovalent group capable of substitution on the benzene ring and examples thereof are those groups mentioned for $W_1$ of formula (III).

Specific examples of the compound represented by formula (VI) are shown below, but the present invention is not restricted to them.

P-1
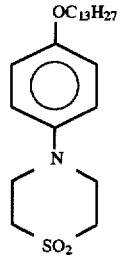
P-2
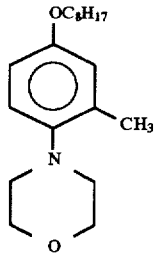
P-3
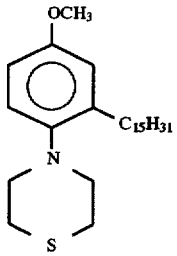
P-4
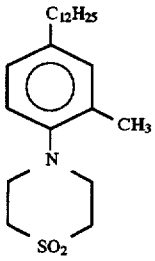
P-5
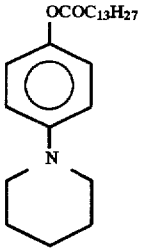
P-6
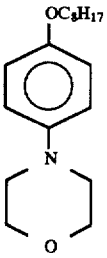
-continued
P-7
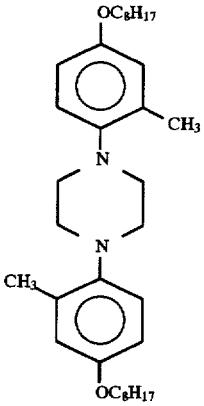
P-8
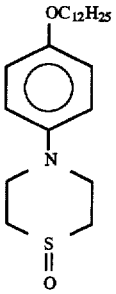
P-9
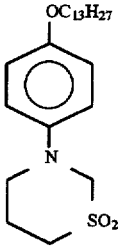
P-10
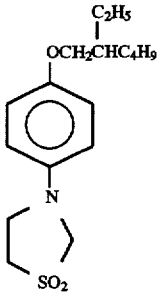
P-11
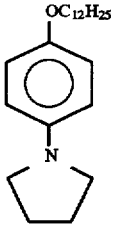

-continued

P-12

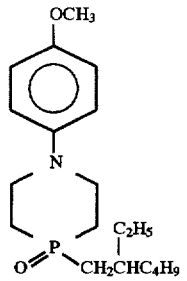

P-13

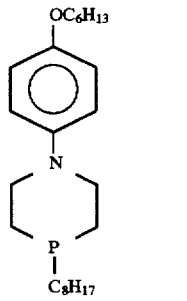

P-14

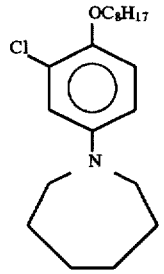

The epoxy compound represented by formula (VII) of the present invention is now described in detail.

In formula (VII), $R_{13}$, $R_{14}$, $R_{15}$, and $R_{16}$ each represent a hydrogen atom, an aliphatic group, an aromatic group, an aliphatic oxycarbonyl group (e.g., dodecyloxycarbonyl and allyloxycarbonyl), an aromatic oxycarbonyl group (e.g., phenoxycarbonyl), or a carbamoyl group (e.g., tetradecylcarbamoyl and phenylmethylcarbamoyl), provided with that $R_{13}$, $R_{14}$, $R_{15}$, and $R_{16}$ do not represent hydrogen atoms respectively at the same time. The number of the epoxy groups represented by formula (VII) may be in the range of 1 to 60 in the same molecule.

Herein, the term "aliphatic group" refers to a straight-chain, branched-chain, or cyclic aliphatic hydrocarbon group and includes saturated and unsaturated aliphatic groups, such as an alkyl group, an alkenyl group, and an alkynyl group. Typical examples thereof are methyl, ethyl, butyl, dodecyl, octadecyl, iso-propyl, tert-butyl, tert-octyl, cyclohexyl, cyclopentyl, 1-methylcyclohexyl, allyl, vinyl, 2-hexadecenyl, and propargyl.

The term "aromatic group" refers to a substituted or unsubstituted phenyl group and naphthyl group having 6 to 42 carbon atoms.

These aliphatic groups and aromatic groups may be substituted further by a group selected from the group consisting of an alkyl group, an aryl group, a heterocyclic group, an alkoxy group (e.g., methoxy and 2-methoxyethoxy), an aryloxy group (e.g., 2,4-di-tert-amylphenoxy, 2-chlorophenoxy, and 4-cyanophenoxy), an alkenyloxy group (e.g., 2-propenyloxy), an acyl group (e.g., acetyl and benzoyl), an ester group (e.g., butoxycarbonyl, phenoxycarbonyl, acetoxy, benzoyloxy, butoxysulfonyl, and toluenesulfonyloxy), an amido group (e.g., acetylamino, ethylcarbamoyl, dimethylcarbamoyl, methanesulfonamido, and butylsulfamoyl), a sulfamido group (e.g., dipropylsulfamoylamino), an imido group (e.g., succinimido and hydantoinyl), a ureido group (e.g., phenylureido and dimethylureido), an aliphatic or aromatic sulfonyl group (e.g., methanesulfonyl and benzenesulfonyl), an aliphatic or aromatic thio group (e.g., ethylthio and phenylthio), a hydroxyl group, a cyano group, a carboxyl group, a nitro group, a sulfo group, and a halogen atom.

Out of the epoxy compounds represented by formula (VII), more preferable ones are epoxy compounds having the group represented by the following formula (VII-A):

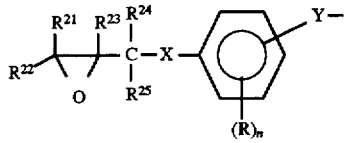

formula (VII-A)

wherein $R^{21}$, $R^{22}$, $R^{23}$, $R^{24}$ and $R^{25}$, which are the same or different, each represent a hydrogen atom, an alkyl group, or an aryl group, R represents a substituent, n is an integer of 0 to 4, —Y— represents a divalent linking group, —X— represents —O—, —S—, or —N($R^2$)—, $R^2$ represents a hydrogen atom, an acyl group, an alkylsulfonyl group, an arylsulfonyl group, an aryl group, a heterocyclic group, or —C($R^{26}$)($R^{27}$)($R^{28}$), wherein $R^{26}$, $R^{27}$ and $R^{28}$ which are the same or different, each represent an alkyl group or a group represented by the following formula (VII-B), $R^{26}$ and $R^{27}$ each may also represent a hydrogen atom.

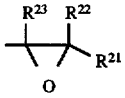

formula (VII-B)

When n is from 2 to 4, Rs are the same or different, and any two of $R^{21}$ to $R^{25}$, or $R^2$ and R, or two $R_2$s may bond together to form a 5- to 7-membered ring, provided that when —X— is —S—, the total number of carbon atoms in the compound is 15 or more, when —X— is —O— and —Y— is —$SO_2$— or phenylene, n is an integer of 1 to 4 or at least one of $R^{21}$ to $R^{25}$ is an alkyl group or an aryl group, and when —X— is —O— and —Y— is —O—$CO_2$—, the total number of carbon atoms of $R^{21}$ to $R^{25}$ and R is 10 or more.

$R^{21}$, $R^{22}$, and $R^{23}$ represented by formula (VII-B) each represent the groups defined in formula (VII-A).

The atom to which the group represented by formula (VII-A) is bonded may be any of a hydrogen atom, a carbon atom, a nitrogen atom, a sulfur atom, and an oxygen atom.

Out of the epoxy compounds having the groups represented by formula (VII-A), compounds having 3 or more groups, more preferably 4 or more groups, and further more preferably 5 or more groups, represented by formula (VII-A) are preferable in consideration of the effect of the present invention.

On the other hand, the epoxy compound having a group represented by formula (VII-A) has two or more benzene rings, more preferably 3 or more benzene rings, and further more preferably 4 or more benzene rings, in all.

Out of the epoxy compounds having the groups represented by formula (VII-A) of the present invention, more preferable epoxy compounds are represented by the following formula (VII-C):

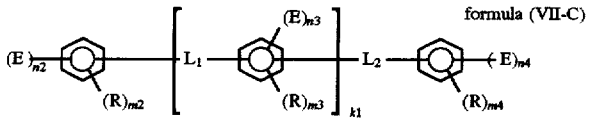

formula (VII-C)

wherein E represents the following formula (VII-D):

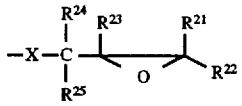

formula (VII-D)

wherein $R^{21}$ to $R^{25}$ and X each represent those groups defined in formula (VII-A).

In formula (VII-C), R represents those groups defined in formula (VII-A).

$L_1$ and $L_2$, which are the same or different, each represent a divalent linking group.

Preferably $L_1$ and $L_2$ each represent an alkylene group which may be substituted, for example, having the structure:

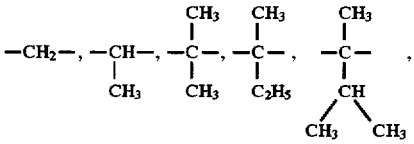

-continued

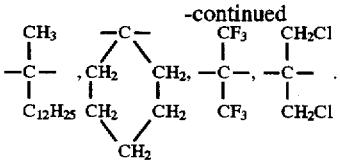

$n_2$ is an integer of 1 to 5, $n_3$ is an integer of to 4, $n_4$ is an integer of 1 to 5, $m_2$ is an integer of 0 to 4, $m_3$ is an integer of 0 to 3, $m_4$ is an integer of 0 to 4, $k_1$ is an integer of 0 to 20. When there are two or more E's, they are the same or different, and when there are two or more R's, they are the same or different.

A mixture of the compounds represented by formula (VII-C) wherein $k_1$ varies is acceptable.

Out of the compounds represented by formula (VII-C), those are preferable wherein —X— represented in the formula (VII-D) is represented by —O—; $k_1$ is 1 to 20, more preferably 2 to 20, further more preferably 3 to 20, and most preferably 4 to 20; $n_2$ to $n_4$ are 1 to 2; $m_2$ to $m_4$ are 0 to 3, most preferably 1 to 2; and R represents an alkyl group, a halogen atom, or an alkoxy group.

It is preferable that a compound represented by formula (VII-A) is used in combination with a compound represented by formula (VII) different from the former compound.

Specific examples of the present compound represented by formula (VII) are shown below, but the present invention is not restricted to them.

E-1

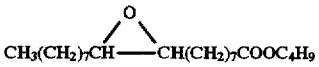

E-2

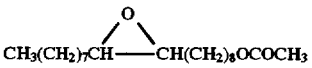

E-3

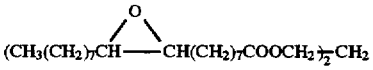

E-4

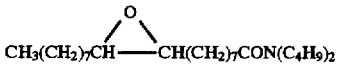

E-5

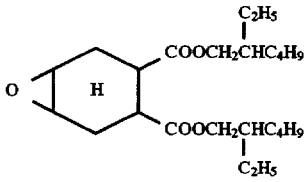

E-6

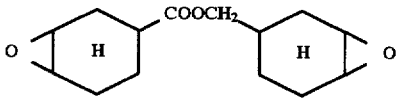

E-7

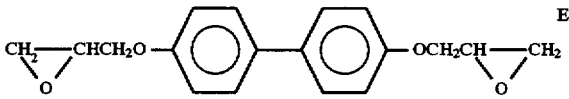

E-8

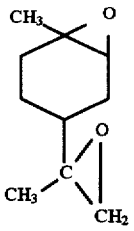

E-9

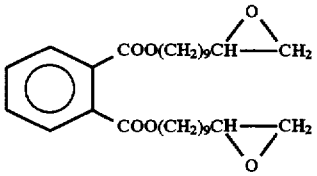

E-10

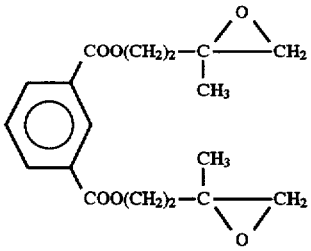

-continued
E-11
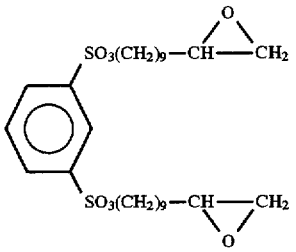
E-12
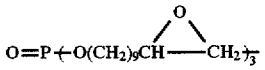
E-13
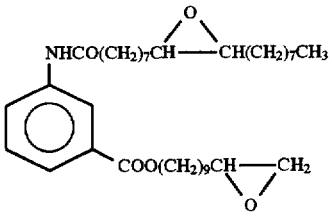
E-14
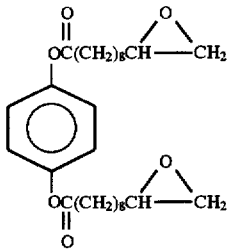
E-15
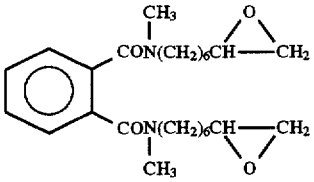
E-16
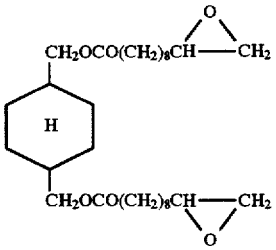
E-17
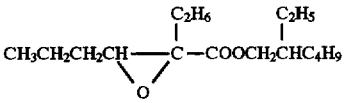
E-18
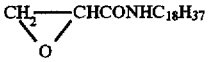
E-19
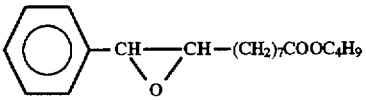
E-20
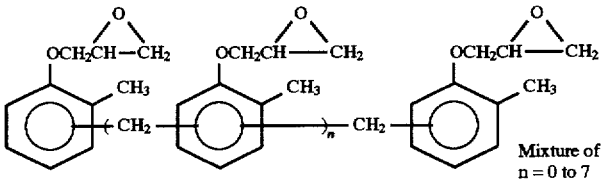
E-21
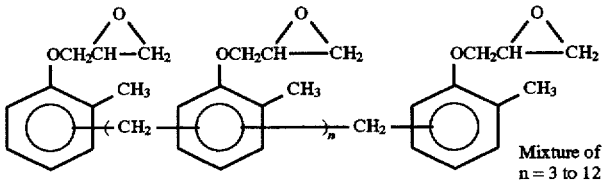
E-22
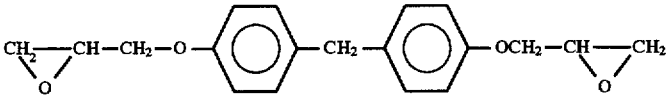
E-23
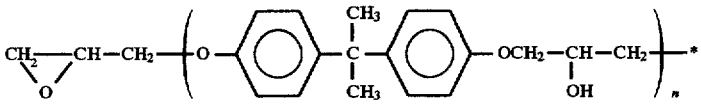

-continued
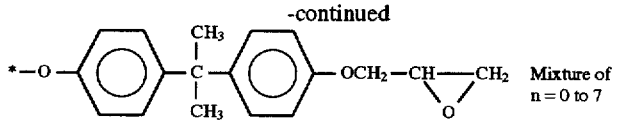
E-24
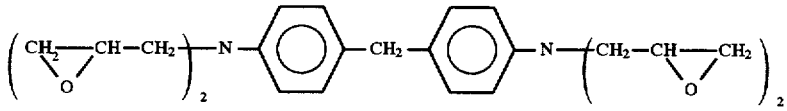
E-25
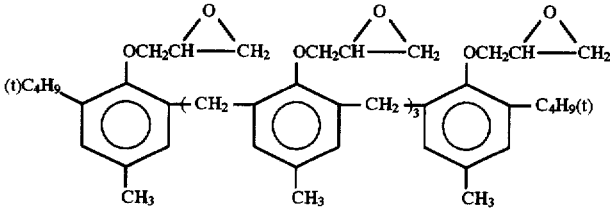
E-26
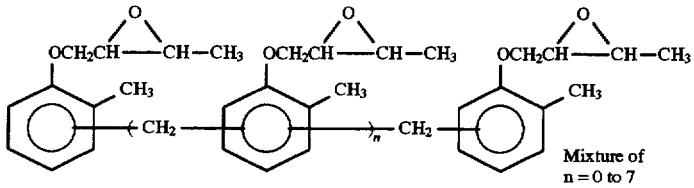
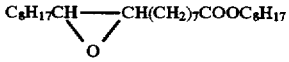
E-27
E-28
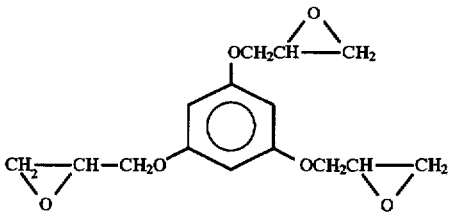
E-29
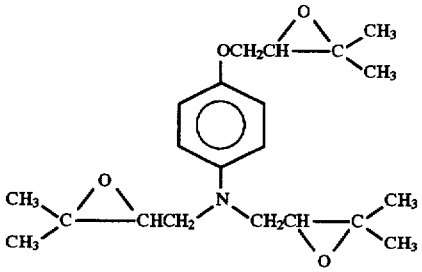
E-30
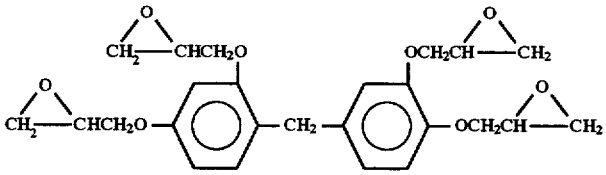
E-31
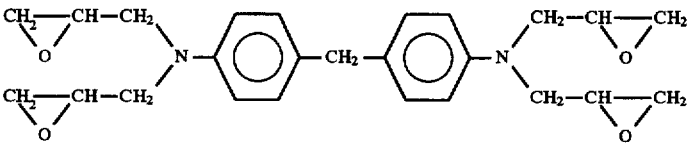
E-32
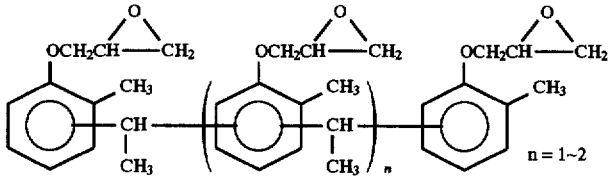

-continued

E-33

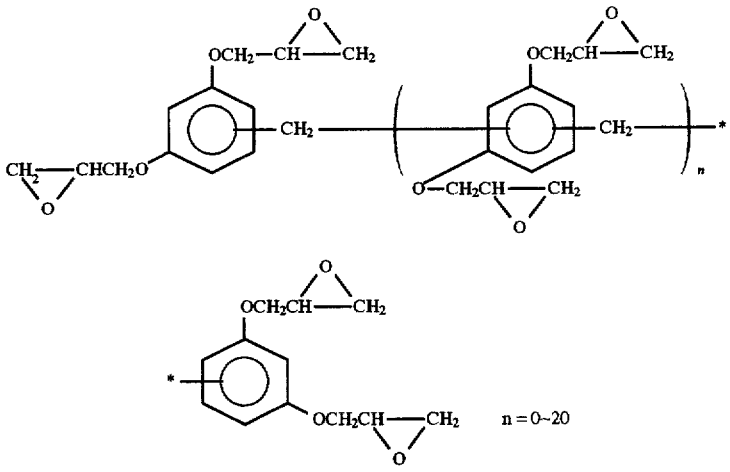

E-34

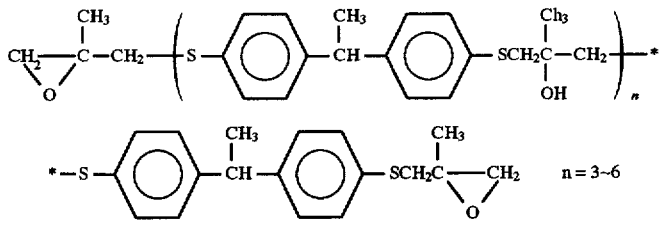

E-35

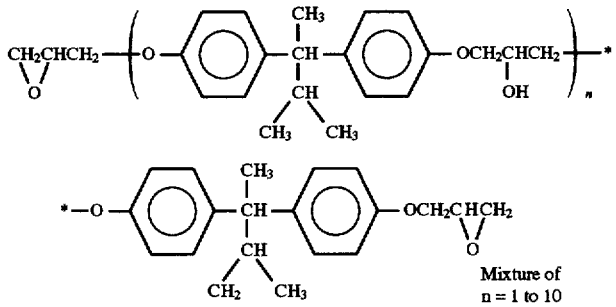

The amide compound represented by formula (VIII) is now described in detail.

In formula (VIII), $R_{17}$, $R_{18}$, and $R_{19}$ each represent preferably an alkyl group having 1 to 36 carbon atoms or an aryl group having 6 to 36 carbon atoms, each of which groups may be substituted by an substituent, such as a halogen atom, an alkyl group, an alkoxy group, an aryl group, an aryloxy group, an alkylsulfonyl group, an arylsulfonyl group, an alkoxycarbonyl group, and a carbamoyl group. When $R_{18}$ and $R_{19}$ each represent an alkyl group, they may bond together to form a 5- to 7-membered ring. The ring may contain one or more heteroatoms of O, S, N, and P in the ring. Further, one of $R_{18}$ and $R_{19}$ may be a hydrogen atom.

Out of the compounds represented by formula (VIII), compounds represented by the following formula (VIII-A) are particularly preferable:

formula (VIII-A)

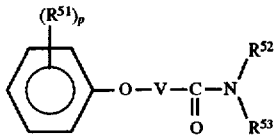

wherein $R^{51}$ represents a halogen atom (e.g., fluorine, chlorine, bromine, and iodine), an alkyl group having 1 to 24 carbon atoms (e.g., methyl, ethyl, isopropyl, tert-butyl, tert-pentyl, cyclopentyl, cyclohexyl, 1,1,3,3-tetramethylpropyl, n-decyl, n-pentadecyl, and tert-pentadecyl), or an alkoxy group having 1 to 24 carbon atoms (e.g., methoxy, ethoxy, butoxy, octyloxy, benzyloxy, and dodecyloxy), $R^{52}$ and $R^{53}$ each represent independently a hydrogen atom or an alkyl group having 1 to 24 carbon atoms (e.g., methyl, ethyl, iso-propyl,-tert-butyl, methoxyethyl, benzyl, 2-ethylhexyl, n-hexyl, n-decyl, and n-dodecyl), V represents an alkylene group having 1 to 24 carbon atoms (e.g., methylene, ethylene, trimethylene, ethylidene, and propylidene), p is an integer of 1 to 3, when p is an integer of 2 to 3, R51's are the same or different, $R^{52}$ and $R^{53}$ may bond together to form a 5- to 7-membered ring, which may contain one or more heteroatoms of O, S, N, and P.

Specific examples of the amide compound represented by formula (VIII) are shown below, but the present invention is not restricted to them.

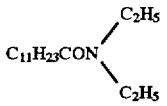
A-1
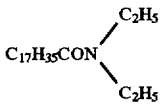
A-2
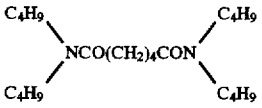
A-3
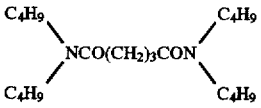
A-4
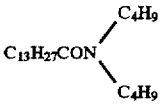
A-5
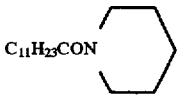
A-6
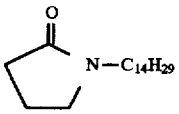
A-7
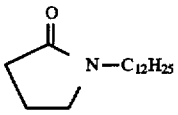
A-8
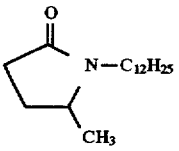
A-9
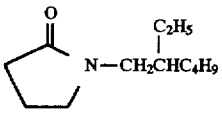
A-10
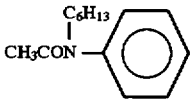
A-11
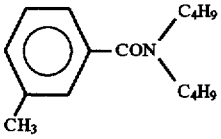
A-12
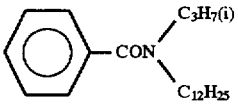
A-13
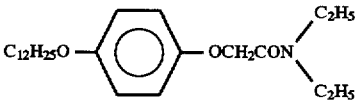
A-14
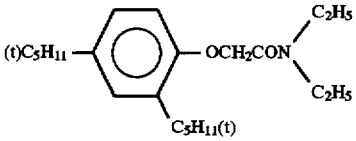
A-15
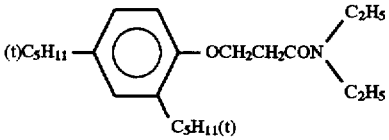
A-16
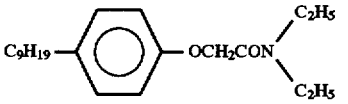
A-17
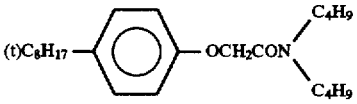
A-18
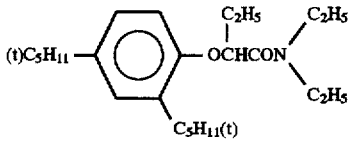
A-19
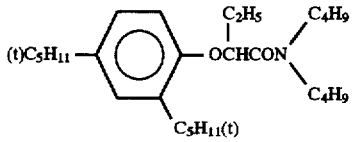
A-20
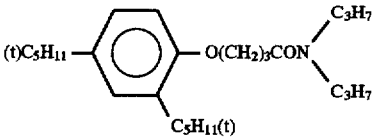
A-21
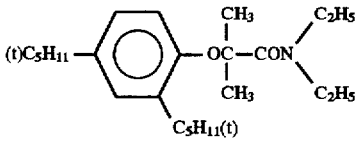
A-22

-continued

A-23

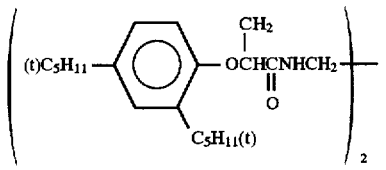

A-24

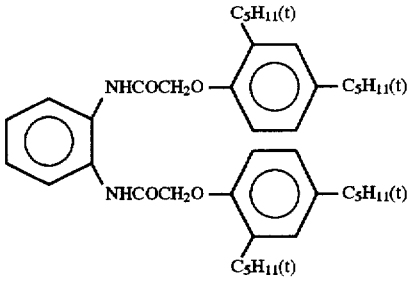

A-25

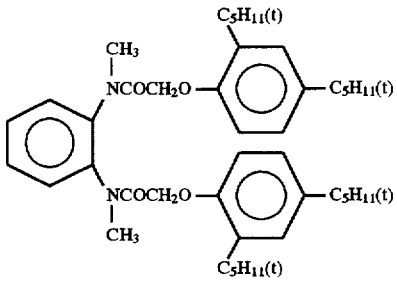

A-26

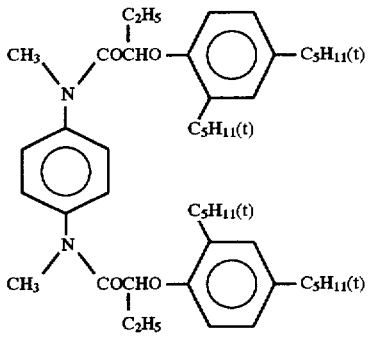

A-27

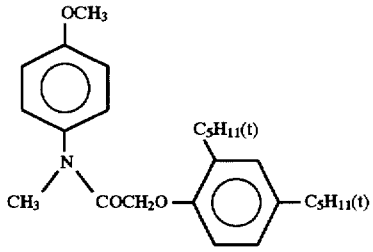

A-28

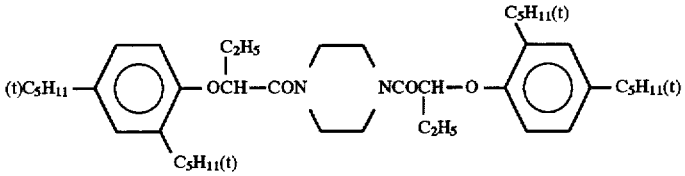

A-29

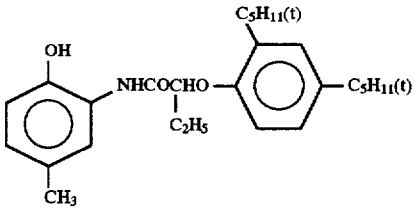

A-30

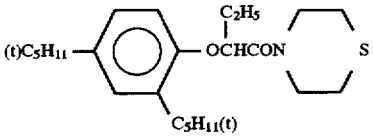

These amide compounds can be synthesized by the conventionally known process; for example, by a condensation reaction of a carboxylic anhydride or a carboxyl chloride with an amine, and specific synthetic examples are described, for example, in JP-B No. 25260/1983, JP-A No. 254149/1987, and U.S. Pat. No. 4,171,975. The function of compounds represented by formulas (IV) to (VIII) for use in the present invention is to prevent processing color contamination caused by folding of photographic material. Each of compounds represented by formulas (IV) to (VIII) can be used singly or in combination thereof. By combination use thereof, the above function can be revealed more remarkably. Preferable combination is at least one of compound represented by formula (IV) or (V) and at least one of compound represented by formula (VI) or (VII), with more preference given to the combination of at least one compound represented by formula (IV) and at least one compound represented by formula (VII).

Any of the compounds represented by formulas (IV) to (VIII) can be used together with a coupler by dissolving them in a high-boiling organic solvent combined with a co-solvent and then emulsifying and dispersing them into gelatin. The amount to be added is in the range of 1 to 200 wt %, preferably 5 to 100 wt %, and more preferably 10 to 50 wt %, based on the coupler.

The color photographic material of the present invention can be composed by applying at least one yellow-color-forming silver halide emulsion layer, at least one magenta-color-forming silver halide emulsion layer, and at least one cyan-color-forming silver halide emulsion layer on a reflective support. In the usual color photographic print paper, the contained color couplers are capable of forming dyes complementary to the lights to which the silver halide emulsions are sensitive, and the colors are reproduced by the subtractive color process. In the usual color photographic print paper, the silver halide emulsion grains may be spectral sensitized with a blue-sensitive spectral sensitizing dye, a green-sensitive spectral sensitizing dye, and a red-sensitive spectrally sensitizing dye, respectively in the order of the above-mentioned color-forming layers, and the layers may be applied on a support in the above order. However the order may be changed. That is, in some cases, preferably the photosensitive layer containing silver halide grains that are largest in average grain size is the uppermost layer, in view of rapid processing, and in some cases preferably the lowermost layer is a magenta-color-forming photosensitive layer, in view of the preservability under exposure to light.

The photosensitive layers and the color-forming hues may be composed so as not to have the above correspondence, and at least one infrared-sensitive silver halide emulsion layer can be used.

In the present invention, as the silver halide grains, silver chloride grains, silver chlorobromide grains, or silver chloroiodobromide grains containing 95 mol % or more of silver chloride are preferably used. In particular, in the present invention, in order to shorten the development processing time, preferably, silver bromochloride grains or silver chloride grains substantially free from silver iodide can be used. Herein the expression "substantially free from silver iodide" means that the silver iodide content is 1 mol % or less, preferably 0.2 mol % or less. On the other hand, for the purpose of increasing high-intensity sensitivity, spectral sensitization sensitivity, or long-term stability of the photographic material, there is a case wherein high-silver-chloride grains containing 0.01 to 3 mol % of silver iodide on the emulsion surface is preferably used as described in JP-A No. 84545/1991. Although the halogen composition of the emulsion may be different or uniform from grain to grain, when an emulsion having a halogen composition uniform from grain to grain is used, the properties of the grains can be easily made homogeneous. With respect to the halogen composition distribution in the silver halide emulsion grains, for example, grains having the so-called uniform-type structure, wherein the halogen composition is uniform throughout the grains; grains having the so-called layered-type structure, wherein the halogen composition of the core in the silver halide grains is different from that of the shell (consisting of a layer or layers) surrounding the core; or grains having a structure wherein non-layered parts different in halogen composition are present in the grains or on the surface of the grains (if the non-layered parts different in halogen composition are present on the surface of the grains, they may be joined to the edges, corners, or planes of grains) may suitably be chosen to use. To secure a high sensitivity, it is more advantageous to use one of the latter two than to use grains having a uniform-type structure and the latter two are also preferable in view of pressure-resistance properties. If the silver halide grains have the above structure, the boundary of parts different in halogen composition may be a clear boundary, an obscure boundary formed by a mixed crystal due to the difference of the composition, or a boundary wherein the structure is continuously changed positively.

In the high-silver-chloride emulsion for use in the present invention, preferably the silver bromide localized phase is layered or non-layered in the silver halide grains and/or on the surface of the grains as described above. The halogen composition of the above localized phase preferably has a silver bromide content of at least 10 mol %, more preferably the content is more than 20 mol %. The silver bromide content of the silver bromide localized layer can be analyzed, for example, by using the X-ray diffraction method (described, for example, in *Shin-jikkenkagaku-koza 6, Kozokaiseki*, edited by Nihonkagakukai, published by Maruzen). The localized phase may be present in the grains or on the edges, corners, or planes of the grains and one preferable example is one wherein the localized phase is grown epitaxially on the corners of the grains.

For the purpose of decreasing the replenishing amount of the development processing solution, it is effective to increase further the silver chloride content of the silver halide emulsion. In that case, an emulsion comprising nearly pure silver chloride, for example an emulsion having a silver chloride content of 98 to 100 mol %, is also preferably used.

The average grain size (the number average value of grain sizes calculated by assuming the diameters of circles equivalent to the projected areas of the grains) of the silver halide grains contained in the silver halide emulsion for use in the present invention is preferably 0.1 to 2 μm.

The grain size distribution of them is preferably a monodisperse distribution wherein the deviation coefficient (which is obtained by dividing the standard deviation of the grain size distribution by the average grain size) is preferably 20% or less, desirably 15% or less, and more preferably 10% or less. At that time, for the purpose of obtaining a wide latitude, it is also preferably carried out that such monodisperse emulsions are blended in one layer or are applied in layers.

With respect to the form of the silver halide grains contained in the photographic emulsion, a regular crystal form, such as a cubic form, a tetradecahedral form, or an octahedral form; an irregular crystal form, such as a sphere form or a tabular form; or a composite of these can be used. Also a mixture of various crystal forms can be used. In the present invention, out of these, ones containing the above regular crystal form amounts to 50% or more, preferably 70% or more, and more preferably 90% or more, are preferable.

Besides these, an emulsion wherein tabular grains having an average aspect ratio (the diameter/thickness in terms of circles) of 5 or more, preferably 8 or more, amount to over 50% in all the grains in terms of projected areas can be preferably used.

The silver (bromo)chloride emulsion for use in the present invention can be prepared by processes described, for example, by P. Glafkides in *Chimie et Phisique Photographique* (published by Paul Montel, 1967), by G. F. Duffin in *Photographic Emulsion Chemistry* (published by Focal Press, 1966), and by V. L. Zelikman et al. in *Making and Coating Photographic Emulsion* (published by Focal Press, 1964). That is, any of the acid process, the neutral process, the ammonia process, and the like can be used, and as a method to react a soluble silver salt with a soluble halide, any of the single-jet method, the double-jet method, a combination of these, and the like can be used. A method wherein grains are formed in an atmosphere of excess silver ions (so-called reverse precipitation method) can also be used. As one type of the reverse precipitation method, a method wherein the pAg in the liquid phase wherein the silver halide will be formed is kept constant, that is, the so-called controlled double-jet method can be used. According to this method, a silver halide emulsion wherein the crystal form is regular and the grain size is nearly uniform can be obtained.

The localized phase of the silver halide grains or its substrate, of the present invention, preferably contains different metal ions or their complex ions. Preferable metal ions are selected from ions of metals belonging to Groups VIII and IIb of the Periodic Table, their complex ions, lead ions, and thallium ions. Mainly, in the localized phase, ions selected from iridium ions, rhodium ions, and iron ions, and their complex ions, can be used; and mainly, in the substrate, ions of metals selected from osmium, iridium, rhodium, platinum, ruthenium, palladium, cobalt, nickel, iron, etc., and their complex ions can be used in combination. The localized phase and the substrate may be different in their kind of the metal ions and the concentration of the metal ions. Several of these metals can be used. Particularly, it is preferable to allow an iron compound and an iridium compound to be present in the silver bromide localized phase.

These metal-ion-providing compounds are incorporated in the localized phase of the silver halide grains of the present invention and/or some other grain part (substrate) at the time of the formation of silver halide grains by means, for example, of adding them into an aqueous gelatin solution, an aqueous halide solution, an aqueous silver salt solution, or other aqueous solution serving as a dispersing medium, or by adding silver halide fine grains already containing the metal ions and dissolving the fine grains.

The metal ions for use in the present invention may be incorporated in emulsion grains before, during, or immediately after the formation of the grains, which time will be selected depending on their position in the grains.

Generally the silver halide emulsion for use in the present invention is chemically and spectrally sensitized.

With respect to the chemical sensitization, a chemical sensitization that uses a chalcogen sensitizer (specifically, sulfur sensitization, which typically includes the addition of an unstable sulfur compound; selenium sensitization, which uses a selenium compound, or tellurium sensitization, which uses a tellurium compound), noble metal sensitization, typically such as gold sensitization, and reduction sensitization can be used alone or in combination. With respect to compounds used in chemical sensitization, those described in JP-A No. 215272/1987, page 18 (the right lower column) to page 22 (the right upper column), are preferably used.

The effect of the constitution of the photographic material of the present invention is more remarkable when use is made of a high-silver-chloride emulsion that has been sensitized with gold.

The emulsion for use in the present invention is a so-called surface latent image-type emulsion, wherein a latent image is mainly formed on the grain surface.

To the silver halide emulsion for use in the present invention, various compounds or their precursors can be added for the purpose of preventing fogging during the production process, storage, or the processing of the photographic material, or for the purpose of stabilizing the photographic performance. Specific examples of these compounds are described in the above-mentioned JP-A No. 215272/1987, pages 39 to 72, which compounds are preferably used. Further, 5-arylamino-1,2,3,4-thiatriazole compounds (whose aryl residues have at least one electron-attracting group respectively) described in EP 0447647 can also be preferably used.

The spectral sensitization is carried out for the purpose of spectrally sensitizing each emulsion layer of the photographic material of the present invention to a desired wavelength region of light.

In the photographic material of the present invention, as spectral sensitizing dyes used for spectral sensitization for blue, green, and red regions, for example, those described by F. M. Harmer in *Heterocyclic compounds-Cyanine dyes and related compounds* (published by John Wiley & Sons [New York, London], 1964) can be mentioned. As specific examples of the compounds and the spectral sensitization, those described in the above-mentioned JP-A No. 215272/1987, page 22 (the right upper column) to page 38, are preferably used. As the red-sensitive spectral sensitizing dyes for high-silver-chloride emulsion grains high in silver chloride content, spectral sensitizing dyes described in JP-A No. 123340/1991 are very preferable in view, for example, of the stability, the strength of the adsorption, and the temperature dependence of the exposure.

In the case wherein the photographic material of the present invention is to be spectral sensitized effectively in the infrared region, sensitizing dyes described in JP-A No. 15049/1991, page 12 (the left upper column) to page 21 (the left lower column); in JP-A No. 20730/1991, page 4 (the left lower column) to page 15 (the left lower column); in EP-0.420.011, page 4, line 21, to page 6, line 54; in EP-0.420.012, page 4, line 12, to page 10, line 33; in EP-0.443.466; and in U.S. Pat. No. 4,975,362 are preferably used.

To incorporate these spectral sensitizing dyes into the silver halide emulsion, they may be directly dispersed into the emulsion, or after they are dissolved in a solvent or a combination of solvents, such as water, methanol, ethanol, propanol, methyl Cellosolve, and 2,2,3,3-tetrafluoropropanol, the solution may be added to the emulsion. Also the spectral sensitizing dye may be formed together with an acid or a base into an aqueous solution, as described in JP-B Nos. 23389/1969, 27555/1969, and 22089/1982, or the spectral sensitizing dye may be formed together with a surface-active agent into an aqueous solution or a colloid dispersion, as described in U.S. Pat. Nos. 3,822,135 and 4,006,025, and the obtained aqueous solution or colloid dispersion may be added to the emulsion. Also after the spectral sensitizing dye may be dissolved in a solvent substantially immiscible with water, such as phenoxyethanol, the solution is dispersed in water or a hydrophilic colloid and is added to the emulsion. The spectral sensitizing dye may be directly dispersed in a hydrophilic colloid, as described in JP-A Nos. 102733/1978 and 105141/1983, and the dispersion is added to the emulsion. The time at which the dispersion or solution is added to the emulsion may be at any stage of the preparation of the emulsion, which time is hitherto known and considered useful. That is, the dispersion or the solution may be added before or during the formation of grains of the silver halide emulsion, or during the period from immediately after the formation of grains till the washing step, or before or during the chemical sensitization, or during the period from immediately after the chemical sensitization till the cooling and solidifying of the emulsion, or at the time the coating solution is prepared. Although generally the addition of the dispersion or the solution is carried out in a period after the completion of the chemical sensitization and before the application, the dispersion or the solution may be added together with a chemical sensitizer to carry out spectral sensitization and chemical sensitization at the same time, as described in U.S. Pat. Nos. 3,628,969 and 4,225,666; or the addition may be carried out before chemical sensitization, as described in JP-A No. 113928/1983; or the dispersion or the solution may be added before the completion of the precipitation of the silver halide grains, to allow the spectral sensitization to start. Further, as taught in U.S. Pat. No. 4,225,666, it is possible that the spectrally sensitizing dye may be divided into two portions and added: one portion is added prior to chemical sensitization, and the other is added after the chemical sensitization. As shown in U.S. Pat. No. 4,183,756, the dispersion or the solution may be added at any time during the formation of silver halide grains. In particular, the sensitizing dye is preferably added before the washing step of the emulsion or before chemical sensitization of the emulsion.

The amount of these spectral sensitizing dyes to be added varies widely depending on the case and is preferably in the range of $0.5\times10^{-6}$ to $1.0\times10^{-2}$ mol, more preferably $1.0\times10^{-6}$ to $5.0\times10^{-3}$ mol, per mol of the silver halide.

In the present invention, if a sensitizing dye has spectral sensitization sensitivity particularly in from the red region to the infrared region, it is preferable to use additionally a compound described in JP-A No. 157749/1990, page 13 (the right upper column) to page 22 (the right lower column). By using these compounds, the preservability of the photographic material, the stability of the processing, and the supersensitizing effect can be increased specifically. In particular, additional use of compounds of general formulae (IV), (V), and (VI) in that patent is particularly preferable. These compounds are used in an amount of $0.5\times10^{-5}$ mol to $5.0\times10^{-2}$ mol, preferably $5.0\times10^{-5}$ mol to $5.0\times10^{-3}$ mol, per mol of the silver halide and the advantageous amount is in the range of 0.1 to 10,000, preferably 0.5 to 5,000, times one mol of the sensitizing dye.

The photosensitive material of the present invention is used in a print system using usual negative printers, and also it is preferably used for digital scanning exposure that uses monochromatic high-density light, such as a second harmonic generating light source (SHG) that comprises a combination of a nonlinear optical crystal with a semiconductor laser or a solid state laser using a semiconductor laser as an excitation light source, a gas laser, a light-emitting diode, or a semiconductor laser. To make the system compact and inexpensive, it is preferable to use a semiconductor laser or a second harmonic generating light source (SHG) that comprises a combination of a nonlinear optical crystal with a semiconductor laser or a solid state laser. Particularly, to design an apparatus that is compact, inexpensive, long in life, and high in stability, the use of a semiconductor laser is preferable, and it is desired to use a semiconductor laser for at least one of the exposure light sources.

If such a scanning exposure light source is used, the spectral sensitivity maximum of the photographic material of the present invention can arbitrarily be set by the wavelength of the light source for the scanning exposure to be used. In an SHG light source obtained by combining a nonlinear optical crystal with a semiconductor laser or a solid state laser that uses a semiconductor laser as an excitation light source, since the emitting wavelength of the laser can be halved, blue light and green light can be obtained. Therefore, the spectral sensitivity maximum of the photographic material can be present in each of the blue region, the green region, and the red region. In order to use a semiconductor laser as a light source to make the apparatus inexpensive, high in stability, and compact, preferably each of at least two layers has a spectral sensitivity maximum at 670 nm or over. This is because the emitting wavelength range of the available, inexpensive, and stable III–V group semiconductor laser is present now only in from the red region to the infrared region. However, on the laboratory level, the oscillation of a II–VI group semiconductor laser in the green or blue region is confirmed and it is highly expected that these semiconductor lasers can be used inexpensively and stably if production technique for the semiconductor lasers is developed. In that event, the necessity that each of at least two layers has a spectral sensitivity maximum at 670 nm or over becomes lower.

In such scanning exposure, the time for which the silver halide in the photographic material is exposed is the time for which a certain very small area is required to be exposed. As the very small area, the minimum unit that controls the quantity of light from each digital data is generally used and is called a picture element. Therefore, the exposure time per picture element is changed depending on the size of the picture element. The size of the picture element is dependent on the density of the picture element, and the actual range is from 50 to 2,000 dpi. If the exposure time is defined as the time for which a picture size is exposed with the density of the picture element being 400 dpi, preferably the exposure time is $10^{-4}$ sec or less, more preferably $10^{-6}$ sec or less. The lower limit is not particularly restricted, but it is preferably $10^{-10}$ sec. More preferably, the exposure time is in a range between $10^{-10}$ to $10^{-4}$ sec.

In the photographic material according to the present invention, for the purpose of preventing irradiation or halation or of improving, for example, safelight immunity, preferably a dye, which can be decolored by processing (in particular, an oxonol dye or a cyanine dye), as described in European Patent EP 0337490A2, pages 27 to 76, is added to the hydrophilic colloid layer.

Some of these water-soluble dyes deteriorate the color separation or the safelight immunity if the amount thereof to be used is increased. As a dye that can be used without deteriorating the color separation, a water-soluble dye described in Japanese Patent Application No. 310143/1991, 310189/1991, or 310139/1991 is preferable.

In the present invention, instead of or in combination with the water-soluble dye, a colored layer capable of being decolored by processing is used. The colored layer used that can be decolored by processing may be arranged in contact with the emulsion layer directly or through an intermediate layer containing a processing color-mix inhibitor, such as gelatin and hydroquinone. This colored layer is preferably located under the emulsion layer (on the side of the support) that will form a primary color which is the same as that of the colored layer. Colored layers corresponding to respective primary colors may all be arranged, or only some of them may be arbitrarily selected and arranged. A colored layer that has been colored to correspond to several primary color regions can also be arranged. The optical reflection density of the colored layer is preferably such that the value of the optical density at the wavelength at which the optical density is highest in the wavelength region used for the exposure (in the visible light region of 400 run to 700 nm in a usual printer exposure and in the wavelength of the scanning exposure light source to be used in the case of scanning exposure) is 0.2 or higher but 3.0 or lower, more preferably 0.5 or higher but 2.5 or lower, and particularly preferably 0.8 or higher but 2.0 or lower.

To form the colored layer, conventionally known methods can be applied. For instance, a method wherein a dye described in JP-A No. 282244/1990, page 3 (the right upper column) to page 8, or a dye described in JP-A No. 7931/1991, page 3 (the right upper column) to page 11 (the left lower column), is brought into the form of a solid fine particle dispersion and is allowed to be contained in a hydrophilic colloid layer; a method wherein an anionic dye is fixed to a cationic polymer; a method wherein a dye is adsorbed to fine particles, for example, of a silver halide and is fixed into a layer; or a method wherein colloidal silver is used as described in JP-A No. 239544/1989; can be mentioned. As the method for dispersing a fine powder of a dye in the solid state, for example, a method is described in JP-A No. 308244/1990, pages 4 to 13, wherein a fine powder dye, which is substantially insoluble in water at a pH of at least 6 or below, but which is substantially soluble in water at a pH of at least 8, is incorporated. Further, a method wherein an anionic dye is fixed to a cationic polymer is described in JP-A No. 84637/1990, pages 18 to 26. Methods for preparing colloidal silver as a light-absorbing agent are described in U.S. Pat. Nos. 2,688,601 and 3,459,563. Out of these methods, the method wherein a fine powder dye is incorporated, and the method wherein colloidal silver is used, are preferred.

Preferably the white pigment fine particles are uniformly dispersed in the reflective layer without forming clusters or the like, and the magnitude of its distribution can be found by measuring the occupied area ratio (%) (Ri) of the fine particles projected on a unit area. The deviation coefficient of the occupied area ratio (%) can be found by the ratio s/R of the standard deviation s of Ri to the average value (R) of Ri. In the present invention, preferably the deviation coefficient of the occupied area ratio (%) of the fine particles of the pigment is 0.15 or less, more preferably 0.12 or less, and particularly preferably 0.08 or less.

As a binder or protective colloid that can be used in the photographic material according to the present invention, gelatin is advantageously used, but some other hydrophilic colloid can be used alone or in combination with gelatin. As a gelatin, preferably low-calcium gelatin having a calcium content of 800 ppm or less, more preferably 200 ppm or less, is used. In order to prevent various fungi or bacteria from propagating in the hydrophilic colloid layer to deteriorate the image quality, preferably a mildew-proofing agent, as described in JP-A No. 271247/1988, is added.

When the photographic material of the present invention is subjected to printer exposure, preferably a band strip filter described in U.S. Pat. No. 4,880,726 is used. Thus, light color mixing is eliminated and color reproduction is remarkably improved.

An exposed photographic material can be subjected to conventional color development processing, and, in the case of the color photographic material of the present invention, to make the processing rapid, preferably after it is color-developed, it is bleach-fixed. Particularly, when the above high-silver-chloride emulsion is used, the pH of the bleach-fix solution is preferably about 6.5 or below, more preferably 6 or below, for the purpose, for example, of accelerating desilvering.

As the silver halide emulsion to be applied to the photographic material of the present invention and the other materials (e.g., additives) and the photographic constitutional layers (including the arrangement of the layers) to be applied thereto and the processing method and additives used in the processing of the photographic material of the present invention, those described in the below-mentioned patent gazettes, particularly in European Patent EP 0,355,660A2 (JP-A No. 139544/1990), are preferably used.

| Element constituting photographic material | JP-A No. 215272/1987 | JP-A No. 33144/1990 | EP 0,335,660A2 |
|---|---|---|---|
| Silver halide emulsion | p. 10 upper right column line 6 to p. 12 lower left column line 5, and p. 12 lower right column line 4 from the bottom to p. 13 upper left column line 17 | p. 28 upper right column line 16 to p. 29 lower right column line 11 and p. 30 lines 2 to 5 | p. 45 line 53 to p. 47 line 3 and p. 47 lines 20 to 22 |
| Solvent for silver halide | p. 12 lower left column lines 6 to 14 and p. 123 upper left column line 3 from the bottom to p. 18 lower left column last line | — | — |
| Chemical sensitizing agent | p. 12 lower left column line 3 from the bottom to lower right column line 5 from the bottom and p. 18 lower right column line 1 to p. 22 upper right column line 9 from the bottom | p. 29 lower right column line 12 to last line | p. 47 lines 4 to 9 |
| Spectral sensitizing agent (method) | p. 22 upper right column line 8 from the bottom to p. 38 last line | p. 30 upper left column lines 1 to 13 | p. 47 lines 10 to 15 |
| Emulsion stabilizer | p. 39 upper left column line 1 to p. 72 upper right column last line | p. 30 upper left column line 14 to upper right column line 1 | p. 47 lines 16 to 19 |
| Developing accelerator | p. 72 lower left column line 1 to p. 91 upper right column line 3 | — | — |
| Color coupler (Cyan, Magenta, and Yellow coupler) | p. 91 upper right column line 4 to p. 121 upper left column line 6 | p. 3 upper right column line 14 to p. 18 upper left column last line and p. 30 upper right column line 6 to p. 35 lower right column line 11 | p. 4 lines 15 to 27 p. 5 line 30 to p. 28 last line, p. 45 lines 29 to 31 and p. 47 line 23 to p. 63 line 50 |
| Color Formation-strengthen agent | p. 121 upper left column line 7 to p. 125 upper right column line 1 | — | — |
| Ultraviolet absorbing agent | p. 125 upper right column line 2 to p. 127 lower left column last line | p. 37 lower right column line 14 tto p. 38 upper left column line 11 | p. 65 lines 22 to 31 |

-continued

| Element constituting photographic material | JP-A No. 215272/1987 | JP-A No. 33144/1990 | EP 0,335,660A2 |
|---|---|---|---|
| Discoloration inhibitor (Image-dye stabilizer) | p. 127 lower right column line 1 to p. 137 lower left column line 8 | p. 36 upper right column line 12 to p. 37 upper left column line 19 | p. 4 line 30 to p. 5 line 23, p. 29 line 1 to p. 45 line 25 p. 45 lines 33 to 40 and p. 65 lines 2 to 21 |
| High-boiling and/or low-boiling solvent | p. 137 lower left column line 9 to p. 144 upper right column last line | p. 35 lower right column line 14 to p. 36 upper left column line 4 from the bottom | p. 64 lines 1 to 51 |
| Method for dispersing additives for photograph | p. 144 lower left column line 1 to p. 146 upper right column line 7 | p. 27 lower right column line 10 to p. 28 upper left column last line and p. 35 lower right column line 12 to p. 36 upper right column line 7 | p. 63 line 51 to p. 64 line 56 |
| Film Hardener | p. 146 upper right column line 8 to p. 155 lower left column line 4 | — | — |
| Developing Agent precursor | p. 155 lower left column line 5 to p. 155 lower right column line 2 | — | — |
| Compound releasing development inhibitor | p. 155 lower right column lines 3 to 9 | — | — |
| Constitution of photosensitive layer | p. 156 upper left column line 15 to p. 156 lower right column line 14 | p. 28 upper right column lines 1 to 15 | p. 45 lines 41 to 52 |
| Dye | p. 156 lower right column line 15 to p. 184 lower right column last line | p. 38 upper left column line 12 to upper right column line 7 | p. 66 lines 18 to 22 |
| Color-mix inhibitor | p. 185 upper left column line 1 to p. 188 lower right column line 3 | p. 36 upper right column lines 8 to 11 | p. 64 line 57 to p. 65 line 1 |
| Gradation controller | p. 188 lower right column lines 4 to 8 | — | — |
| Stain inhibitor | p. 188 lower right column line 9 to p. 193 lower right column line 10 | p. 37 upper left column last line to lower right column line 13 | p. 65 line 32 to p. 66 line 17 |
| Surface-active agent | p. 201 lower left column line 1 to p. 210 upper right column last line | p. 18 upper right column line 1 to p. 24 lower right column last line and p. 27 lower left column line 10 from the bottom to lower right column line 9 | — |
| Fluorine-containing agent (As Antistatic agent, coating aid, lubricant, adhesion inhibitor, or the like) | p. 210 lower left column line 1 to p. 222 lower left column line 5 | p. 25 upper left column line 1 to p. 27 lower right column line 9 | — |
| Binder (Hydrophilic colloid) | p. 222 lower left column line 6 to p. 225 upper left column last line | p. 38 upper right column line 8 to 18 | p. 66 lines 23 to 28 |
| Thickening agent | p. 225 upper right column line 1 to p. 227 upper right column line 2 | — | — |
| Antistatic agent | p. 227 upper right column line 3 to p. 230 upper left column line 1 | — | — |
| Polymer latex | p. 230 upper left column line 2 to p. 239 last line | — | — |
| Matting agent | p. 240 upper left column line 1 to p. 240 upper right column last line | — | — |
| Photographic processing method (processing process, additive, etc.) | p. 3 upper right column line 7 to p. 10 upper right column line 5 | p. 39 upper left column line 4 to p. 42 upper left column last line | p. 67 line 14 to p. 69 line 28 |

Note: In the cited part of JP-A No. 215272/1987, amendment filed on March 16, 1987 is included.

In the yellow coupler, it is possible to use the yellow coupler described in the above Table being combined with yellow couplers of the present invention.

Preferably, the cyan, magenta, and yellow couplers are impregnated into loadable latex polymers (e.g., loadable latex polymers described in U.S. Pat. No. 4,203,716) in the presence or absence of a high-boiling organic solvent listed in the above table, or they are dissolved together with water-insoluble and organic solvent-soluble polymers and are emulsified and dispersed into hydrophilic colloid aqueous solution.

As water-insoluble and organic solvent-soluble polymers that can be preferably used, homopolymers or copolymers described in U.S. Pat. No. 4,857,449, the seventh column to the fifteenth column, and in International Publication No. WO 88/00723, pages 12 to 30, can be mentioned. More preferably, methacrylate-type polymers or acrylamide-type polymers, particularly acrylamide-type polymers, are used in view of color image stability and the like.

In the photographic material according to the present invention, color image preservability improving compounds as described in European Patent EP 0277589A2 are preferably used together with couplers, particularly, together with pyrazoloazole couplers and pyrrolotriazole couplers.

That is, the use of a compound described in the above-mentioned patent specifications that combines with the aromatic amine developing agent remaining after the color development processing to form a chemically inactive and substantially colorless compound and/or a compound described in the above-mentioned patent specifications that combines with the oxidized product of the aromatic amine color developing agent remaining after the color development processing to form a chemically inactive and substantially colorless compound simultaneously or singly is preferable, because, for example, the occurrence of stain or other side effects due to the formation of color formed dyes by the reaction of the color developing agent or its oxidized product remaining in the film during the storage after the processing with couplers can be prevented.

Further, as the cyan couplers, in addition to diphenylimidazole series cyan couplers described in JP-A No. 33144/1990, 3-hydroxypyridine series cyan couplers described in European Patent EP 0333185A2 (particularly, that formed by attaching a chlorine coupling-off group to the 4-equivalent coupler of Coupler (42) to make it to be 2-equivalent and Couplers (6) and (9) which are listed as specific examples are preferable), cyclic active methylene series cyan couplers described in JP-A No. 32260/1989 (particularly Coupler Examples 3, 8, and 34 that are listed as specific examples are preferable), pyrrolopyrazole series cyan couplers described in European Patent EP 0456226A1, pyrroloimidazole series cyan couplers described in European Patent EP 0484909, and pyrrolotirazole series cyan couplers described in European Patents EP 0488248 and EP 491197A1 are preferably used. Among them, pyrrolotriazole series cyan couplers are particularly preferably used.

As the magenta couplers used in the present invention, 5-pyrazolone series magenta coupler and pyrazoloazole series magenta couplers as described in the known literature shown in the above table are used, but in particular, in view, for example, of the hue, the stability of images, and the color forming properties, pyrazolotriazole couplers wherein a secondary or tertiary alkyl group is bonded directly to the 2-, 3-, or 6-position of the pyrazolotriazole ring as described in JP-A No. 65245/1986, pyrazoloazole couplers containing a sulfonamido group in the molecule as described in JP-A No. 65246/1986, pyrazoloazole couplers having an alkoxyphenylsulfonamido ballasting group as described in JP-A No. 147254/1986, and pyrazoloazole couplers having an alkoxy group or an aryloxy group in the 6-position as described in European Patent Nos. 226,849A and 294,785A are preferably used.

As the method for processing the color photographic material of the present invention, in addition to the methods listed in the above table, processing materials and processing methods described in JP-A No. 207250/1990, page 26 (the right lower column, line 1) to page 34 (the right upper column, line 9) and JP-A No. 97355/1992, page 5 (the left upper column, line 17) to page 18 (the right lower column, line 20) are preferable.

According to the present invention, a color photograph high in sharpness even with using a small amount of white pigment can be obtained. Thus the photographic material of the present invention can be prepared inexpensively, since the amount of white pigment to be used in the photographic material can be lowered. Further, a color photograph excellent in image quality due to less processing color contamination after bending the photographic material can be obtained.

Next, the present invention will be described in detail in accordance with examples, but the invention is not limited to them.

EXAMPLE 1

(Preparation of support)

To a low-density polyethylene having MRF of 3, titanium dioxide in the respective amounts shown in Table 1, zink stearate of 3 wt % based on titanium dioxide, and ultramarine blue (DV-1, manufactured by Daiichi Kasei Kogyo K.K.) were added, the resulting mixture was kneaded in a Barbury mixer, followed by pelletizing, thereby preparing each masterbatch. The titanium dioxide used had diameter in a range of 0.15 to 0.35 μm, measured by an electonmicroscopy, and had coated-surface with hydrated aluminum oxide of which coated amount was 0.75 wt % based on titanium dioxide in terms of aluminum oxide.

After a paper base having a basis weight of 170 g/m$^2$ was subjected to a 10 kVA corona discharge treatment, polyethylene laminating layer, having respective thicknesses shown in Table 1, was provided on the paper surface by using multilayer extruding dies at 320° Then the surface of polyethylene layer was subjected to a glow discharge treatment.

TABLE 1

| | Constitution of multilayer waterresiating resin layer | | | | | | |
|---|---|---|---|---|---|---|---|
| | Uppermost layer | | Intermediate layer | | Lowermost layer | | Total |
| Support | Content of $TiO_2$ (wt %) | Film thickness (μm) | Content of $TiO_2$ (wt %) | Film thickness (μm) | Content of $TiO_2$ (wt %) | Film thickness (μm) | amount of $TiO_2$ used (g/m$^2$) |
| A | 10 | 30 | — | — | — | — | 3.0 |
| B | 15 | 30 | — | — | — | — | 4.7 |
| C | 25 | 30 | — | — | — | — | 8.6 |
| D | 35 | 30 | — | — | — | — | 13.3 |
| E | 10 | 15 | — | — | 15 | 15 | 3.9 |
| F | 15 | 15 | — | — | 0 | 15 | 2.4 |
| G | 15 | 15 | — | — | 10 | 15 | 3.9 |
| H | 25 | 15 | — | — | 0 | 15 | 4.3 |
| I | 25 | 15 | — | — | 15 | 15 | 6.7 |
| J | 10 | 0.5 | 15 | 29 | 10 | 0.5 | 4.7 |
| K | 10 | 2.0 | 25 | 26 | 10 | 2.0 | 7.9 |

TABLE 1-continued

| Support | Constitution of multilayer waterresiating resin layer: Uppermost layer Content of $TiO_2$ (wt %) | Uppermost layer Film thickness (μm) | Intermediate layer Content of $TiO_2$ (wt %) | Intermediate layer Film thickness (μm) | Lowermost layer Content of $TiO_2$ (wt %) | Lowermost layer Film thickness (μm) | Total amount of $TiO_2$ used ($g/m^2$) |
|---|---|---|---|---|---|---|---|
| L | 10 | 2.0 | 35 | 15 | 0 | 13 | 6.9 |
| M | 35 | 15 | — | — | 0 | 15 | 6.7 |
| N | 35 | 15 | — | — | 15 | 15 | 9.0 |
| O | 35 | 15 | — | — | 25 | 15 | 11.0 |

(Preparation of photographic material 101)

A multilayer color printing paper (101) having layer compositions shown below was prepared by coating various photographic constituting layers on the above-prepared reflective support (A). Coating solutions were prepared as follows:

Preparation of the first layer coating solution 153.0 Grams of yellow coupler (ExY), 15.0 g of image-dye stabilizer (Cpd-1), 7.5 g of image-dye stabilizer (Cpd-2), 16.0 g of image-dye stabilizer (Cpd-3) were dissolved in 25 g of solvent (Solv-1), 25 g of solvent (Solv-2), and 180 ml of ethyl acetate, and the resulting solution was dispersed and emulsified in 1,000 g of 10% aqueous gelatin solution containing 60 ml of 10% sodium dodecylbenzenesulfonate solution and 10 g of citric acid, thereby prepared emulsified dispersion A. Separately, silver chlorobromide emulsion A-1 (cubic grains, 3:7 (silver molar ratio) blend of large size emulsion having 0.88 μm of average grain size and small size emulsion having 0.70 μm of average grain size, and 0.08 and 0.10 of deviation coefficient of grain size distribution, respectively, each in which 0.3 mol % of silver bromide was located at a part of grain surface; and at the inner side of grains and in the silver bromide-localized layer 0.1 mg of potassium hexachloroiridate (IV) and 1 mg of potassium ferrocyanide, each in total amount, were contained) was prepared. Blue-sensitive sensitizing dyes A and B, shown below, were added in amounts of dyes that corresponds to $2.0\times10^{-4}$ mol and $2.5\times10^{-4}$ mol to the large size emulsion and small size emulsion, per mol of silver, respectively, and then the chemical sensitizing of this emulsion was carried out optimumly by adding a sulfur sensitizing agent and a gold sensitizing agent, in the presence of nucleic acid decomposed product. The above-described emulsified dispersion A and this silver chlorobromide emulsion A-1 were mixed together and dissolved to give the composition shown below, thereby preparing the first layer coating solution.

Coating solutions for the second to seventh layers were also prepared in the same manner as the coating solution of first layer. As a gelatin hardener for the respective layers, 1-oxy-3,5-dichloro-s-triazine sodium salt was used.

Further, Cpd-14 and Cpd-15 were added in each layer in such amounts that the respective total amount becomes 25.0 $mg/m^2$ and 50.0 $mg/m^2$.

Silver chlorobromide emulsion in each photosensitive emulsion layer was controlled in size of grains and in silver halide composition, in the same manner as the above described silver chlorobromide emulsion A-1, and spectral sensitizing dyes shown below were used in respective layers.

Blue-sensitive emulsion layer:

Sensitizing dye A

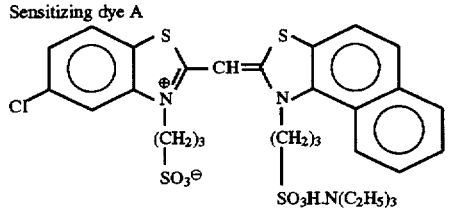

and

Sensitizing dye B

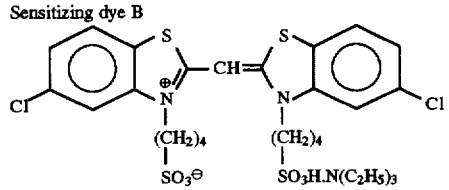

(each $2.0\times10^{-4}$ mol to the large size emulsion and $2.5\times10^{-4}$ mol to the small size emulsion, per mol of silver halide.)

Green-sensitive emulsion layer:

Sensitizing dye C

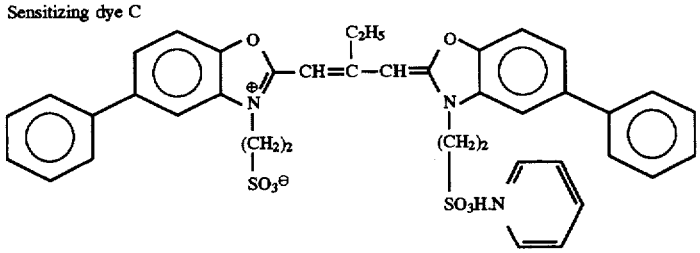

($4.0\times10^{-4}$ mol to the large size emulsion and $5.6\times10^{-4}$ mol to the small size emulsion, per mol of silver halide)

and

Sensitizing dye D

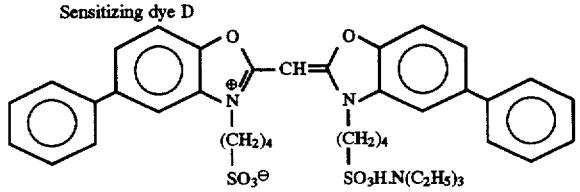

($7.0\times10^{-5}$ mol to the large size emulsion and $1.0\times10^{-4}$ mol to the small size emulsion, per mol of silver halide)

Red-sensitive emulsion layer:

Sensitizing dye E

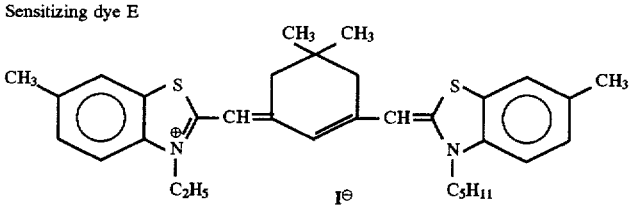

(0.9×10$^{-4}$ mol to the large size emulsion and 1.1×10$^{-4}$ mol to the small size emulsion, per mol of silver halide)

To the red-sensitive emulsion layer, the following compound was added in an amount of 2.6×10$^{-3}$ mol per mol of silver halide:

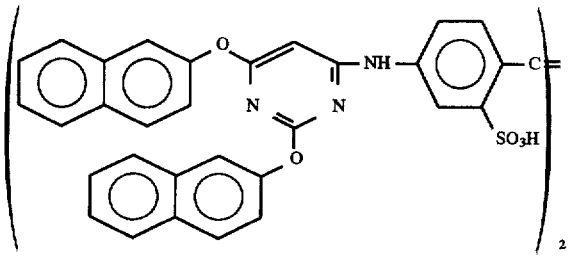

Further, 1-(5-methylureidophenyl)-5-mercaptotetrazole was added to the blue-sensitive emulsion layer, the green-sensitive emulsion layer, and the red-sensitive emulsion layer in amount of 8.5×10$^{-5}$ mol, 3.0×10$^{-3}$ mol, and 2.5×10$^{-4}$ mol, per mol of silver halide, respectively.

Further, 4-hydroxy-6-methyl-1,3,3a,7-tetrazaindene was added to the blue-sensitive emulsion layer and the green-sensitive emulsion layer in amount of 1×10$^{-4}$ mol and 2×10$^{-4}$ mol, per mol of silver halide, respectively.

The dyes shown below (figure in parentheses represents coating amount) were added to the emulsion layers for prevention of irradiation (since these dyes are water-soluble, they diffuse into all photographic constitutional layers).

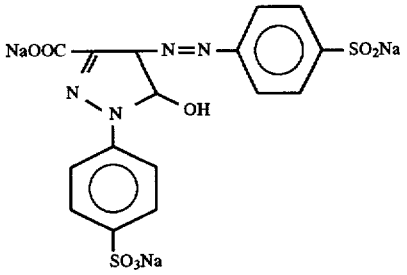

(10 mg/m²)

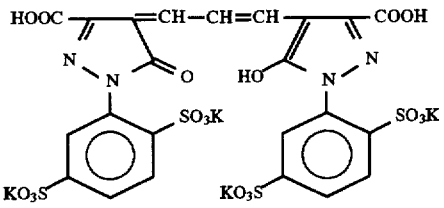

(10 mg/m²)

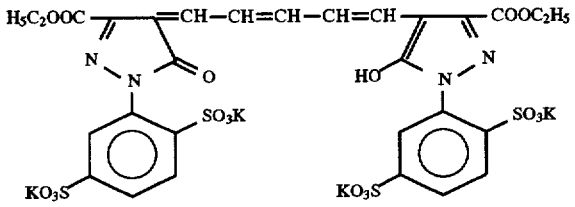

(40 mg/m²)

and

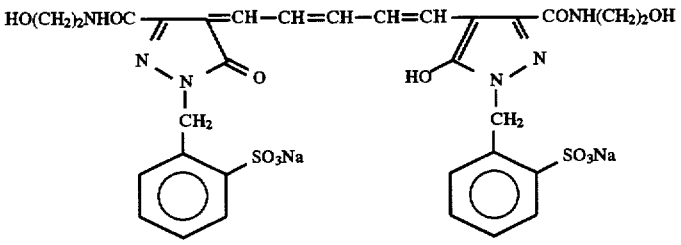

(20 mg/m²)

(Composition of Layers)

The composition of each layer is shown below. The figures represent coating amount (g/m²). The coating amount of each silver halide emulsion is given in terms of silver.

Support (A)

A bluish dye (ultramarine) was included in the first layer side of the resin layer.

| | |
|---|---|
| First Layer (Blue-sensitive emulsion layer) | |
| The above described silver chlorobromide emulsion A-1 | 0.27 |
| Gelatin | 1.26 |
| Yellow coupler (ExY) | 0.79 |
| Image-dye stabilizer (Cpd-1) | 0.08 |
| Image-dye stabilizer (Cpd-2) | 0.04 |
| Image dye stabilizer (Cpd-3) | 0.08 |
| Solvent (Solv-1) | 0.13 |
| Solvent (Solv-2) | 0.13 |
| Second Layer (Color-mix preventing layer) | |
| Gelatin | 0.90 |
| Color mix inhibitor (Cpd-4) | 0.06 |

-continued

| | |
|---|---|
| Solvent (Solv-2) | 0.25 |
| Solvent (Solv-3) | 0.25 |
| Solvent (Solv-7) | 0.03 |
| Third Layer (Green-sensitive emulsion layer) | |
| Silver chlorobromide emulsion B-1 (cubic grains, 1:3 (Ag molar ratio) blend of large size emulsion having average grain size of 0.55 μm and small size emulsion having average grain size of 0.39 μm, whose deviation coefficient of grain size distribution is 0.08 and 0.06, respectively, each in which emulsion 0.8 mol % of silver bromide was located at a part of surface of grains being silver chloride as substrate; at the inner side of grains and in the silver bromide-localized layer 0.1 mg of potassium hexachloroiridate (IV) and 1 mg of potassium ferrocyanide, each in total amount per mol of silver, were contained.) | 0.13 |
| Gelatin | 1.45 |
| Magenta coupler (ExM) | 0.16 |
| Image-dye stabilizer (Cpd-2) | 0.03 |
| Image-dye stabilizer (Cpd-5) | 0.15 |
| Image-dye stabilizer (Cpd-6) | 0.01 |
| Image-dye stabilizer (Cpd-7) | 0.01 |
| Image-dye stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (Color-mix preventing layer) | |
| Gelatin | 0.70 |
| Color-mix inhibitor (Cpd-4) | 0.04 |
| Solvent (Solv-2) | 0.18 |
| Solvent (Solv-3) | 0.18 |
| Solvent (Solv-7) | 0.02 |
| Fifth Layer Red-sensitive emulsion layer) | |
| Silver chlorobromide emulsion C-1 (cubic grains, 1:4 (Ag molar ratio) blend of large size emulsion having average grain size of 0.50 μm and small size emulsion having average grain size of 0.41 μm, whose deviation coefficient of grain size distribution is 0.09 and 0.11, respectively, each in which emulsion 0.8 mol % of silver bromide was located at a part of surface of grains being silver chloride as substrate; at the inner side of grains and in the silver bromide-localized layer 0.3 mg of potassium hexachloroiridate (IV) and 1.5 mg of potassium ferrocyanide, each in total amount per mol of silver, were contained.) | 0.18 |
| Gelatin | 0.80 |
| Cyan coupler (ExC) | 0.33 |
| Ultraviolet absorber (UV-2) | 0.18 |
| Image-dye stabilizer (Cpd-1) | 0.33 |
| Image-dye stabilizer (Cpd-2) | 0.03 |
| Image-dye stabilizer (Cpd-6) | 0.01 |
| Image-dye stabilizer (Cpd-8) | 0.01 |
| Image-dye stabilizer (Cpd-9) | 0.01 |
| Image-dye stabilizer (Cpd-10) | 0.01 |
| Image-dye stabilizer (Cpd-11) | 0.01 |
| Solvent (Solv-1) | 0.01 |
| Solvent (Solv-6) | 0.22 |
| Sixth Layer (Ultraviolet absorbing layer) | |
| Gelatin | 0.48 |
| Ultraviolet absorber (UV-1) | 0.38 |
| Image-dye stabilizer (Cpd-5) | 0.02 |
| Image-dye stabilizer (Cpd-12) | 0.15 |
| Seventh Layer (Protective layer) | |
| Gelatin | 1.10 |
| Acryl-modified copolymer of polyvinyl alcohol (modification degree: 17%) | 0.05 |
| Liquid paraffin | 0.02 |
| Image-dye stabilizer (Cpd-13) | 0.01 |

-continued
Compounds used were as follows:
(ExY) Yellow coupler
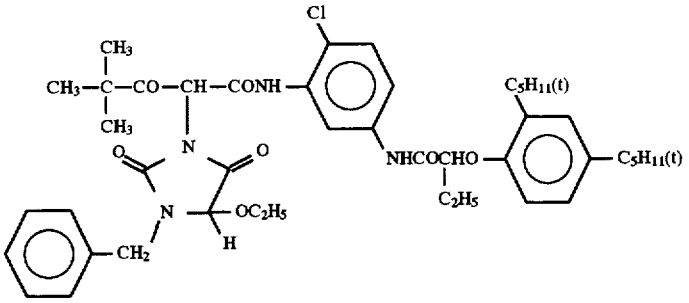
(ExM) Magenta coupler
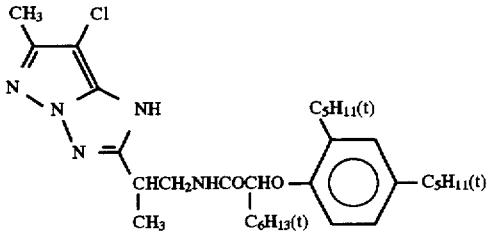
(ExC) Cyan coupler
Mixture (3:7 in molar ratio) of
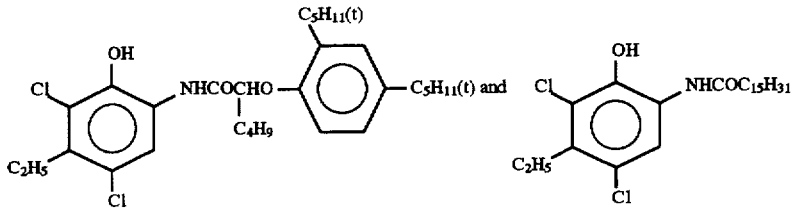
(Cpd-1) Image-dye stabilizer
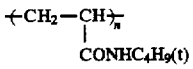
Av. molecular weight: 60,000
(Cpd-2) Image-dye stabilizer
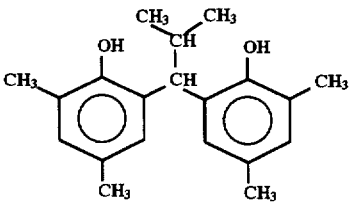
(Cpd-3) Image-dye stabilizer
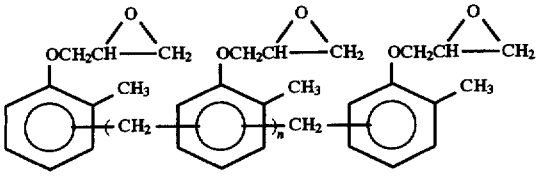
n = 7–8 (in average)

-continued
(Cpd-4) Color-mix inhibitor
Mixture (1:1 in weight ratio) of (1) and (2)
(1)
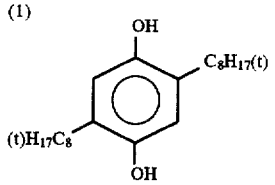
(2)
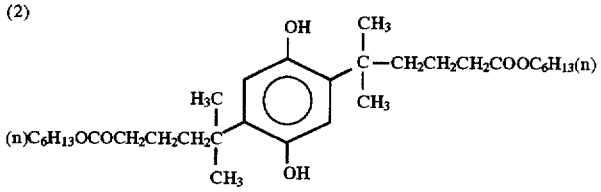
(Cpd-5) Image-dye stabilizer
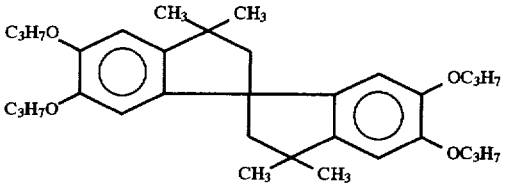
(Cpd-6) Image-dye stabitizer
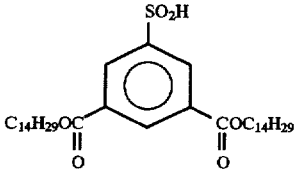
(Cpd-7) Image-dye stabilizer
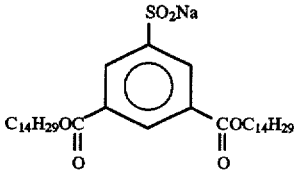
(Cpd-8) Image-dye stabitizer
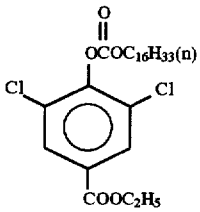
(Cpd-9) Image-dye stabitizer
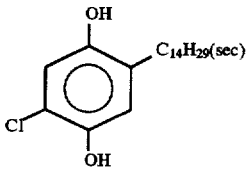
(Cpd-10) Additive
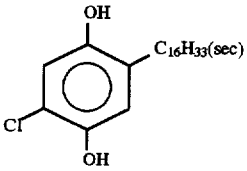
(Cpd-11) Additive
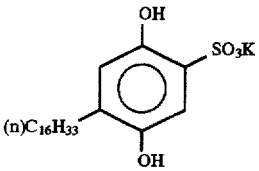
(Cpd-12) Image-dye stabilizer
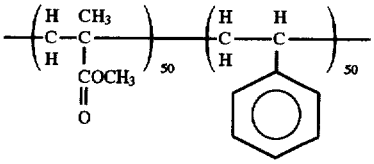

-continued
Av. molecular weight: 60,000
(Cpd-13) Image-dye stabilizer
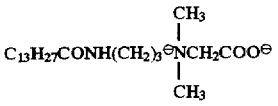
(Cpd-14) Antiseptic
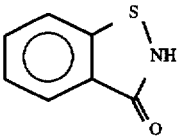
(Cpd-15) Antiseptic
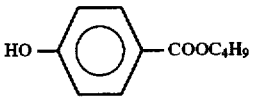
(UV-1) Ultraviolet ray absorber
Mixture of (1), (2), (3), and (4) (1:5:10:5 in weight ratio)
(1)
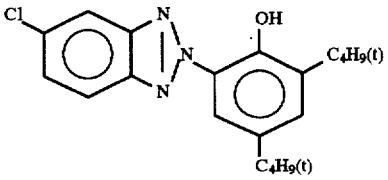
(2)
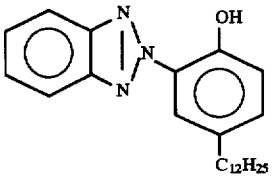
(3)
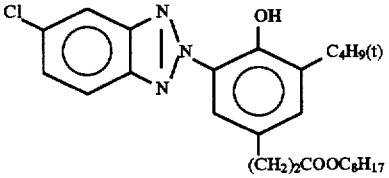
(4)
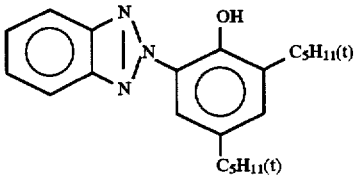
(UC-2) Ultraviolet ray absorber
Mixture of (1), (2), and (3) (1:2:2 in weight ratio)
(1)
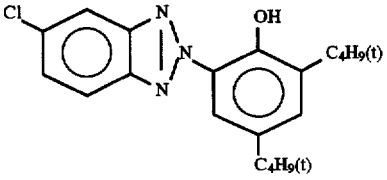
(2)
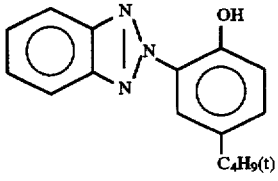
(3)
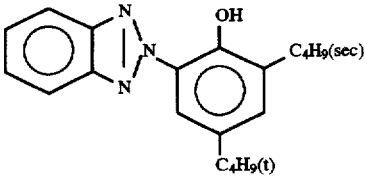
(Solv-1) Solvent
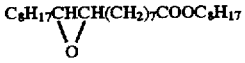

-continued (Solv-2) Solvent

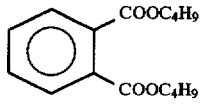

(Solv-3) Solvent

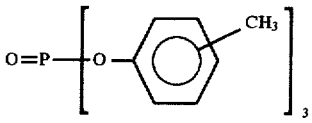

(Solv-4) Solvent

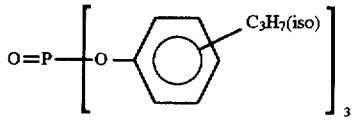

(Solv-5) Solvent

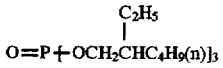

(Solv-6) Solvent

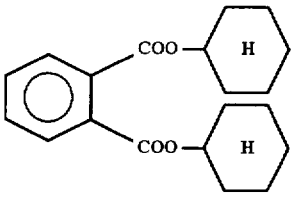

(Solv-7) Solvent

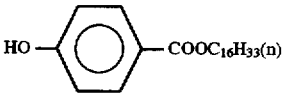

Similar samples 102 to 145 to sample 101 were prepared in the same manner, except that the yellow coupler in the first layer (blue-sensitive emulsion layer) was changed to equimolar coupler, shown in the below Table 2, respectively, and the combination with support was changed.

The prepared photographic materials, after the hardening reaction being completed, was subjected to the following evaluation test.

The photographic material was exposed uniformly to blue light, in such a quantity that the yellow-color-formed density of the photographic material might be 1.5 through a blue filter by using a sensitometer (FWH model, manufactured by Fuji Photo Film Co., Ltd.; color temperature of the light source: 3200 K), and then the photographic material was folded as follows.

(Method of folding)

A jig composed of two foldable metal plates, a photographic material holder, and a metal rod 1 mm in diameter was prepared; the metal rod was applied to the undersurface of the photographic material (where no photographic material was applied), and they were folded through an angle of 135° with the photographic material on the outside.

The folded sample was subjected to development processing in the below-shown processing steps. The density of the magenta of the folded sample was measured normally to the folded line, using a microdensity-measuring apparatus with an aperture diameter of 50 microns. The difference (ΔD=Dmagenta(folded)−Dmagenta) between the density of the magenta at the folded part (Dmagenta (folded)) and the density of the magenta at the unfolded part (Dmagenta) was found, and it was used as a scale indicating degree of processing color contamination of the photographic material due to the folding.

Further, in order to evaluate the sharpness of the photographic material, the photographic material was brought in close contact with an optical wedge having rectangular patterns of various frequencies and was exposed to light from a light source of a sensitometer (manufactured by Fuji Photo Film Co., Ltd.) through a vapor-deposited interference filter 470 nm and thereby the resolution of the yellow color formation was found. As the index of the resolution, the frequency C (line/m) was found at which the CFT value becomes 0.5. (The CFT value is the ratio $\Delta D_c/\Delta D_0$, in which $\Delta D_0$ represents the difference in density between the high-density part and the low-density part at the time when continuous exposure to light over very wide areas of the large quantity part of light and the small quantity part of light is made with the frequency being 0; that is, with no repetition of the rectangular pattern, and $\Delta D_c$ represents the difference in density between the high-density part and the low-density part at the time similar to the above with the frequency of the rectangular pattern being C (line/mm)). (It is meant that the greater the value of C is, the higher the resolution is).

| Processing step | Temperature | Time | Replenisher* | Tank Volume |
|---|---|---|---|---|
| Color developing | 35° C. | 45 sec | 161 ml | 10 liter |
| Bleach-fixing | 30–35° C. | 45 sec | 215 ml | 10 liter |
| Rinse (1) | 30–35° C. | 20 sec | — | 5 liter |
| Rinse (2) | 30–35° C. | 20 sec | — | 5 liter |
| Rinse (3) | 30–35° C. | 20 sec | 350 ml | 5 liter |
| Drying | 70–80° C. | 60 sec | | |

Note: *Replenisher amount per $m^2$ of photographic material.
Rinsing steps were carried out in 3-tanks countercurrent mode from the tank of rinsing (3) toward the tank of rinsing (1).

The composition of each processing solution is as followed, respectively:

| | Tank Solution | Replenisher |
|---|---|---|
| Color-developer | | |
| Water | 800 ml | 800 ml |
| Ethylenediamine-N,N,N',N'-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| N,N-Bis(carboxymethyl)hydrazine | 4.0 g | 5.0 g |
| Monosodium N,N-di(sulfoethyl) hydroxylamine | 4.0 g | 5.0 g |
| Fluorescent whitening agent (WHITEX-4B, made by Sumitomo Chemical Ind.) | 1.0 g | 2.0 g |
| Water to make | 1000 ml | 1000 ml |
| pH (25° C.) | 10.05 | 10.45 |

-continued

| | Tank Solution | Replenisher |
|---|---|---|
| Bleach-fixing solution | | |
| (Both tank solution and replenisher) | | |
| Water | 400 ml | |
| Ammonium thiosulfate (700 g/l) | 100 ml | |
| Sodium sulfite | 17 g | |
| Iron (III) ammonium ethylenediaminetetraacetate | 55 g | |
| Disodium ethylenediaminetetraacetate | 5 g | |
| Ammonium bromide | 40 g | |
| Water to make | 1000 ml | |
| pH (25° C.) | 6.0 | |

Rinse solution (Both tank solution and replenisher) Ion-exchanged water (calcium and magnesium each are 3 ppm or below)

Results obtained are shown in Table 2.

TABLE 2

| Photographic material | Support | Yellow coupler | CTF C (line/mm) | Color contamination (ΔD) | Cost (Support) | Remarks |
|---|---|---|---|---|---|---|
| 101 | A | ExY | 10.3 | 0.03 | ◎ | Comparative Example |
| 102 | B | " | 14.2 | 0.03 | ○ | " |
| 103 | " | Y-3 | 14.3 | 0.03 | ○ | " |
| 104 | " | Y-4 | 14.1 | 0.03 | ○ | " |
| 105 | " | 2 | 14.5 | 0.03 | ○ | " |
| 106 | C | ExY | 18.2 | 0.03 | Δ | " |
| 107 | D | " | 21.6 | 0.04 | x | " |
| 108 | " | Y-3 | 21.8 | 0.03 | x | " |
| 109 | " | Y-4 | 21.9 | 0.03 | x | " |
| 110 | " | Y-27 | 21.7 | 0.02 | x | " |
| 111 | " | YO-1 | 21.5 | 0.03 | x | " |
| 112 | " | 2 | 22.0 | 0.03 | x | " |
| 113 | " | 39 | 21.4 | 0.03 | x | " |
| 114 | F | ExY | 14.1 | 0.11 | ◎ | " |
| 115 | " | Y-3 | 14.2 | 0.03 | ◎ | This Invention |
| 116 | " | Y-4 | 14.0 | 0.03 | ◎ | " |
| 117 | " | 2 | 14.1 | 0.02 | ◎ | " |
| 118 | G | ExY | 14.2 | 0.10 | ◎ | Comparative Example |
| 119 | " | Y-3 | 14.2 | 0.03 | ◎ | This Invention |
| 120 | H | ExY | 18.1 | 0.12 | ◎ | Comparative Example |
| 121 | " | Y-3 | 18.0 | 0.03 | ◎ | This Invention |
| 122 | " | Y-4 | 17.9 | 0.02 | ◎ | " |
| 123 | H | 2 | 18.0 | 0.03 | ◎ | This Invention |
| 124 | I | ExY | 18.2 | 0.11 | ○ | Comparative Example |
| 125 | " | Y-3 | 18.1 | 0.03 | ○ | This Invention |
| 126 | K | ExY | 18.0 | 0.11 | ○ | Comparative Example |
| 127 | " | Y-3 | 17.8 | 0.03 | ○ | This Invention |
| 128 | L | ExY | 21.3 | 0.13 | ○ | " |
| 129 | " | Y-3 | 21.2 | 0.02 | ○ | " |
| 130 | " | Y-4 | 21.4 | 0.03 | ○ | " |
| 131 | " | Y-27 | 21.3 | 0.03 | ○ | " |
| 132 | " | YO-1 | 21.1 | 0.03 | ○ | " |
| 133 | " | 2 | 21.1 | 0.03 | ○ | " |
| 134 | " | 39 | 21.2 | 0.02 | ○ | " |
| 135 | M | ExY | 21.4 | 0.13 | ○ | Comparative Example |
| 136 | " | Y-3 | 21.4 | 0.02 | ○ | This Invention |
| 137 | " | Y-4 | 21.5 | 0.03 | ○ | " |
| 138 | " | Y-27 | 21.5 | 0.03 | ○ | " |
| 139 | " | YO-1 | 21.3 | 0.03 | ○ | " |
| 140 | " | 2 | 21.3 | 0.02 | ○ | " |
| 141 | " | 39 | 21.6 | 0.02 | ○ | " |
| 142 | N | ExY | 21.6 | 0.12 | Δ | Comparative Example |
| 143 | " | Y-3 | 21.7 | 0.03 | Δ | This Invention |
| 144 | O | ExY | 21.7 | 0.11 | Δ | Comparative Example |

TABLE 2-continued

| Photo-graphic material | Support | Yellow coupler | CTF C (line/mm) | Color contami-nation (ΔD) | Cost (Support) | Remarks |
|---|---|---|---|---|---|---|
| 145 | " | Y-3 | 21.8 | 0.03 | Δ | This Invention |

The prime cost of support was evaluated the low degree relatively as follows.

◎ Excellent

○ Good

Δ little bad x Bad

The obtained results demonstrate that, since the used amount of titanium oxide is low, Sample 101 is relatively excellent in view of the prime cost of the support, but it is low in sharpness accordingly. On the other hand, when Samples 102 to 105 and 114 to 119, which are higher in sharpness than Sample 101, and whose sharpness is approximately equal among the samples, are compared, it can be understood that Samples 114 to 119, in which multi-layer-laminate supports are used, are lower in the used amount of titanium oxide than Samples 102 to 105, in which single-layer-laminate supports are used, and samples 114 to 119 are relatively excellent in view of the cost of the support. However, Samples 114 and 118, in which yellow couplers falling outside the present invention are used, are conspicuous in color contamination of magenta. Similarly, since Samples 120 to 127, whose sharpness is approximately equal among the samples, use multi-layer-laminate supports in which the amount of titanium oxide is small, the cost of the support ranges from good to excellent, but Samples 120, 124, and 126, in which yellow couplers falling outside the present invention are used, are conspicuous in color contamination of magenta.

Further, in Samples 128 to 145, whose sharpness is approximately equal, Samples 128, 135, 142 and 144, in which yellow couplers falling outside the present invention are used, are conspicuous in color contamination of magenta.

According to the above, it can be found that it can be achieved to provide a photographic material which is inexpensive, high in sharpness, improved in processing color contamination after folding the photographic material, by the constitution of the present invention.

EXAMPLE 2

Photographic material 201 was prepared in the same manner as photographic material 101 prepared in Example 1, except that the compositions of the second layer, the third layer, and the fourth layer were changed as shown below.

| | |
|---|---|
| Second Layer (Color-mix preventing layer) | |
| Gelatin | 0.99 |
| Color mix inhibitor (Cpd-A) | 0.04 |
| Color mix inhibitor (Cpd-B) | 0.04 |
| Solvent (Solv-2) | 0.16 |
| Solvent (Solv-3) | 0.08 |
| Solvent (Solv-10) | 0.03 |
| Third Layer (Green-sensitive emulsion layer) | |
| Silver chlorobromide emulsion B-1 | 0.13 |
| Gelatin | 1.24 |

-continued

| | |
|---|---|
| Magenta coupler (M-A) | 0.26 |
| Image-dye stabilizer (Cpd-8) | 0.03 |
| Image-dye stabilizer (Cpd-5) | 0.04 |
| Image-dye stabilizer (Cpd-6) | 0.02 |
| Image-dye stabilizer (Cpd-2) | 0.02 |
| Solvent (Solv-8) | 0.30 |
| Solvent (Solv-9) | 0.15 |
| Fourth Layer (Color-mix preventing layer) | |
| Gelatin | 0.70 |
| Color-mix inhibitor (Cpd-A) | 0.03 |
| Color-mix inhibitor (Cpd-B) | 0.03 |
| Solvent (Solv-2) | 0.11 |
| Solvent (Solv-3) | 0.06 |
| Solvent (Solv-10) | 0.02 |

(Cpd-A)

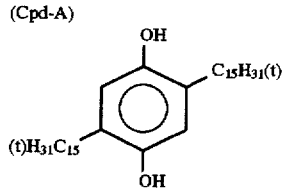

(Cpd-B)

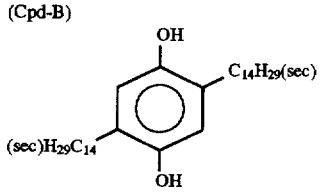

(M-A)

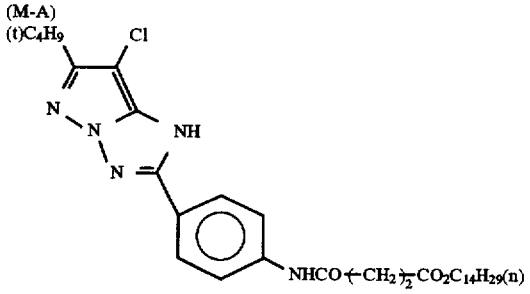

(Solv-8)

$O{=}P\leftarrow OC_{16}H_{13}(n))_3$ (Solv-9)

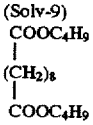

(Solv-10)

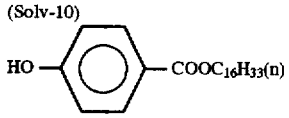

Photographic Materials 201 to 245, in which the support and the yellow coupler were varied, were obtained in the same way as that for Photographic Material 201 in Example 1, and the evaluation of materials 201 to 245 was made in the same way as in Example 1. The obtained results were similar to those of Example 1, and the effect of the constitution according to the present invention was remarkable.

EXAMPLE 3

A color negative film (a), whose support was made of triacetyl cellulose, and a color negative film (b), whose support was made of polyethylene terephthalate and polyethylene naphthalate, were used; a frame of a photographed scene was used to be printed on the photographic materials prepared in Examples 1 and 2 using an automatic printer; and the psychological evaluation of the sharpness of the present invention was carried out. The obtained result of examples 1 and 2 were that the photographic materials that, in Examples 1 and 2, received a sharpness evaluation of scale C (line/mm), also had more excellent sharpness in the practical prints. Further results were that, when the photographing used the color negative film (b), the sharpness in the photographic material of the present invention was more excellent than when the photographing used the color negative film (a).

EXAMPLE 4

With respect to Photographic Materials 101 to 145 and 201 to 245 prepared in Examples 1 and 2, the same processing and evaluation as made in Example 1 were carried out, except that the following exposure to light was conducted. The obtained results were similar to those in Examples 1 and 2.

(Exposure to light)

473 nm taken out by changing the wavelength of a YAG solid state laser (the emitting wavelength: 946 nm) using as a light source an excited semiconductor laser GaAlAs (the emitting wavelength: 808.5 nm) by an SHG crystal of $KNbO_3$, 532 nm taken out by changing the wavelength of a $YVO_4$ solid state laser (the emitting wavelength: 1064 nm) using as a light source an excited semiconductor laser GaAlAs (the emitting wavelength: 808.7 nm) by an SHG crystal of KPT, and AlGaInP (the emitting wavelength: about 670 nm; Type No. TOLD9211 manufactured by Toshiba) were used. The apparatus can carry out the exposure in such a manner that laser beams can scan successively a color photographic printing paper moving normally to the direction of the scanning by respective rotating polyhedrons. Using this apparatus to change the quantity of light, the relationship D—log E between the density (D) of the photographic material and the quantity of light (E) was determined, to carry out exposure to light to make yellow-color density being 1.5. At that time, the quantities of the lights of laser beams having wavelength of 473 nm and 532 nm among the above three laser beams were modulated by using an external modulator to control the exposure amount. Also, the quantities of the lights of laser beam having wavelength of 670 nm were controlled by changing both the amount and time of emission of semiconductor laser. The scanning exposure was carried out at 400 dpi and the average exposure time per picture element was about $5\times10^{-8}$ sec. The temperature of the semiconductor laser was kept by using a Peltier device to prevent the quantity of light from being changed by temperature.

EXAMPLE 5

Photographic materials similar to photographic materials 107, 108, 112, 135, 136, and 140 of Example 1 were prepared in the same manner as in Example 1, except that additives Cpd-2 and Cpd-3 for use in the first layer (blue-sensitive layer) were changed as shown in Table 3. The thus-prepared photographic materials were subjected to the same evaluation test as in Example 1. Results are summarized in Table 3.

As the combination of additives, the followings were used.

| | | |
|---|---|---|
| (1) | Cpd-2 (Exemplified compound B-2) | 0.04 g |
| | Cpd-3 (Exemplified compound E-21) | 0.08 g |
| (2) | Cpd-2 | 0.04 g |
| (3) | Cpd-3 | 0.08 g |
| (4) | P-1 | 0.04 g |
| | H-6 | 0.04 g |
| (5) | A-26 | 0.04 g |
| (6) | None | — |

TABLE 3

| Photographic material | Support | Yellow coupler | Additive | Color contamination (ΔD) | Cost (Support) | Remarks |
|---|---|---|---|---|---|---|
| 107 | D | ExY | (1) | 0.04 | x | Comparative Example |
| 107-2 | " | " | (2) | 0.04 | x | Comparative Example |
| 107-3 | " | " | (3) | 0.04 | x | Comparative Example |
| 107-4 | " | " | (5) | 0.04 | x | Comparative Example |
| 107-5 | " | " | (5) | 0.04 | x | Comparative Example |
| 107-6 | " | " | (6) | 0.05 | x | Comparative Example |
| 108 | " | Y-3 | (1) | 0.03 | x | Comparative Example |
| 108-2 | " | " | (2) | 0.03 | x | Comparative Example |
| 108-3 | " | " | (3) | 0.03 | x | Comparative Example |
| 108-4 | " | " | (5) | 0.03 | x | Comparative Example |
| 108-5 | " | " | (5) | 0.03 | x | Comparative Example |
| 108-6 | " | " | (6) | 0.04 | x | Comparative Example |
| 112 | " | 2 | (1) | 0.03 | x | Comparative Example |
| 112-2 | " | " | (2) | 0.03 | x | Comparative Example |
| 112-3 | " | " | (3) | 0.03 | x | Comparative Example |
| 112-4 | " | " | (5) | 0.03 | x | Comparative Example |
| 112-5 | " | " | (5) | 0.03 | x | Comparative Example |
| 112-6 | " | " | (6) | 0.04 | x | Comparative Example |
| 135 | M | ExY | (1) | 0.13 | ○ | Comparative Example |
| 135-2 | " | " | (2) | 0.13 | ○ | Comparative Example |
| 135-3 | " | " | (3) | 0.12 | ○ | Comparative Example |
| 135-4 | " | " | (5) | 0.13 | ○ | Comparative Example |
| 135-5 | " | " | (5) | 0.13 | ○ | Comparative Example |
| 135-6 | " | " | (6) | 0.14 | ○ | Comparative Example |
| 136 | " | Y-3 | (1) | 0.02 | ○ | This Invention |
| 136-2 | " | " | (2) | 0.03 | ○ | This |

TABLE 3-continued

| Photo-graphic material | Support | Yellow coupler | Addi-tive | Color contami-nation (ΔD) | Cost (Support) | Remarks |
|---|---|---|---|---|---|---|
| 136-3 | " | " | (3) | 0.04 | ○ | Invention This Invention |
| 136-4 | " | " | (5) | 0.03 | ○ | This Invention |
| 136-5 | " | " | (5) | 0.04 | ○ | This Invention |
| 136-6 | " | " | (6) | 0.05 | ○ | This Invention |
| 140 | " | 2 | (1) | 0.02 | ○ | This Invention |
| 140-2 | " | " | (2) | 0.04 | ○ | This Invention |
| 140-3 | " | " | (3) | 0.03 | ○ | This Invention |
| 140-4 | " | " | (4) | 0.02 | ○ | This Invention |
| 140-5 | " | " | (5) | 0.03 | ○ | This Invention |
| 140-6 | " | " | (6) | 0.05 | ○ | This Invention |

As is apparent from the results in Table 3, when the compound represented by formula (IV), (V), (VI), (VII), or (VIII) is used in the photographic materials 136 and 140 in which a combination of support and yellow coupler of the present invention is used, the processing color contamination after folding the photographic material is improved. Further, the effect is more remarkably attained in the combination use of compounds represented by formulae (IV) and (VII).

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic material having, on a reflective support, at least one yellow color-forming coupler-containing silver halide emulsion layer, at least one magenta color-forming coupler-containing silver halide emulsion layer and at least one cyan color-forming coupler containing silver halide emulsion layer, said silver halide emulsion layers each having different color sensitivity, wherein the reflective support comprises a base and two or more water-resisting resin covering layers, located on the side of the base where photographic layers are applied, wherein the water-resisting resin covering layers have different contents of a white pigment and the water-resisting resin covering layer nearest to the base is lower in content of the white pigment than at least one water-resisting resin covering layer located on the same side of the base but farther away from the base, and wherein a silver halide emulsion layer containing a yellow color-forming coupler comprises at least one dye-forming coupler represented by the following formula (I) or (II):

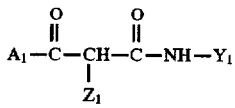

formula (I)

-continued

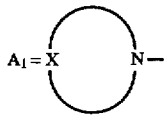

wherein X represent an organic residue required to form a nitrogen-containing heterocyclic ring together with the nitrogen atom, $Y_1$ represents an aromatic group or a heterocyclic group, and $Z_1$ represents a group capable of being released upon coupling reaction of the coupler represented by formula (I) with an oxidized product of a developing agent,

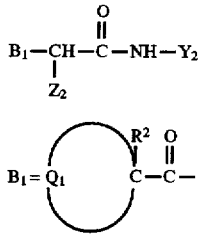

formula (II)

wherein $R_2$ represents a monovalent group excluding a hydrogen atom, $Q_1$ represents a group of nonmetallic atoms required to form together with the carbon atom a 3- to 5-membered cyclic hydrocarbon group or a 3- to 6-membered heterocyclic ring that has at least one heteroatom selected from N, O, S, and P in the ring, $R_2$ may be bonded to $Q_1$ to form a bicyclic or a higher polycyclic ring, $Z_2$ represents a hydrogen atom or a group capable of being released upon coupling reaction of the coupler represented by formula (II) with an oxidized product of an aromatic primary amine developing agent, and $Y_2$ has the same meaning as that of $Y_1$ of formula (I).

2. The silver halide color photographic material as claimed in claim 1, wherein the support comprises a base and three water-resisting resin covering layers located on the side of the base where photographic layers are applied.

3. The silver halide color photographic material as claimed in claim 1, wherein the water-resisting resin covering layer nearest to a photosensitive layer has the highest content of the white pigment.

4. The silver halide color photographic material as claimed in claim 1, wherein the water-resisting resin covering layers of the reflective support that are different in content of a white pigment are made up of at least three layers and any one of such layers located between the water-resisting resin covering layer that is located nearest to a photosensitive layer and the water-resisting resin covering layer that is located nearest to the base has the highest content of the white pigment.

5. The silver halide color photographic material as claimed in claim 1, wherein the white pigment in the water-resisting resin covering layers of the reflective support is titanium oxide, and the weight ratio of the titanium oxide to the resin in the water-resisting resin covering layer having the highest content of the white pigment is 9/91 (titanium oxide/resin) or over.

6. The silver halide color photographic material as claimed in claim 1, wherein the ratio of white pigment contents (wt %) in the layer having the highest content to that in the layer of lowest content, in the water-resisting resin covering layers, is 1.2 or more.

7. The silver halide color photographic material as claimed in claim 1, wherein at least one of the silver halide emulsion layers comprises a high-silver-chloride emulsion whose silver chloride content is 95 mol % or more.

8. The silver halide color photographic material as claimed in claim 1, wherein the water-resisting resin is polyolefin.

9. The silver halide color photographic material as claimed in claim 1, wherein the white pigment is selected from the group consisting of titanium dioxide, barium sulfate, lithopone, aluminum oxide, calcium carbonate, silicon oxide, antimony trioxide, titanium phosphate, zinc oxide, white lead, zirconium oxide, and finely pulverized powder of polystyrene polymer or styrene/divinylbenzene copolymer.

10. The silver halide color photographic material as claimed in claim 1, wherein the content of white pigment in the water-resisting resin layer is 0 to 45 wt %.

11. The silver halide color photographic material as claimed in claim 1, wherein the amount of yellow coupler represented by formula (I) or (II) to be added is 0.1 to 10 mmol per $m^2$ of the silver halide color photographic material.

12. A silver halide color photographic material having, on a reflective support, at least one yellow color-forming coupler-containing silver halide emulsion layer, at least one magenta color-forming coupler-containing silver halide emulsion layer and at least one cyan color-forming coupler containing silver halide emulsion layer, said silver halide emulsion layers each having different color sensitivity, wherein the reflective support comprises a base and two or more water-resisting resin covering layers, located on the side of the base where photographic layers are applied, have different contents of a white pigment and the water-resisting resin covering layer nearest to the base is lower in content of the white pigment than at least one water-resisting resin covering layer located on the same side of the base but farther away from the base, and wherein a silver halide emulsion layer containing a yellow color-forming coupler comprises at least one yellow-dye-forming coupler represented by the following formula (I) or (II) and at least one compound represented by the following formula (IV), (V), (VI), (VII), or (VIII):

formula (I)

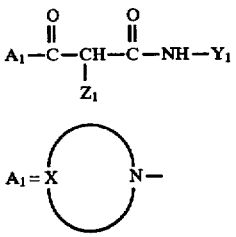

wherein X represents an organic residue required to form a nitrogen-containing heterocyclic ring together with the nitrogen atom, $Y_1$ represents an aromatic group or a heterocyclic group, and $Z_1$ represents a group capable of being released upon coupling reaction of the coupler represented by formula (I) with an oxidized product of a developing agent, formula (II)

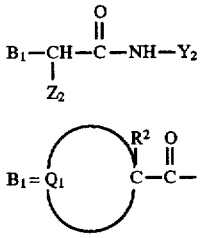

wherein $R_2$ represents a monovalent group excluding a hydrogen atom, $Q_1$ represents a group of nonmetallic atoms required to form together with the carbon atom a 3- to 5-membered cyclic hydrocarbon group or a 3- to 6-membered heterocyclic ring that has at least one heteroatom selected from N, O, S, and P in the ring, $R_2$ may be bonded to $Q_1$ to form a bicyclic or a higher polycyclic ring, $Z_2$ represents a hydrogen atom or a group capable of being released upon coupling reaction of the coupler represented by formula (II) with an oxidized product of an aromatic primary amine developing agent, and $Y_2$ has the same meaning as that of $Y_1$ of formula (I), formula (IV)

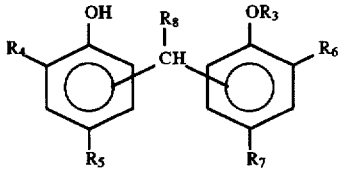

wherein $R_3$ represents a hydrogen atom, an alkyl group, an acyl group, an aryl group, or an alkenyl group, $R_4$, $R_5$, $R_6$, and $R_7$ each represent independently an alkyl group, $R_8$ represents a hydrogen atom or an alkyl group, the methylene group joining the two benzene rings joins them at the ortho position, the meta position, or the para position to the oxygen atom of the respective rings, and if they are joined at the para positions, $R_5$ or $R_7$ represents the linking methylene group itself, and in that case an alkyl group may further be present on the benzene ring, formula (V)

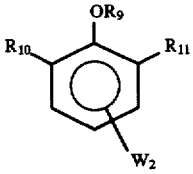

wherein $R_9$ represents a hydrogen atom, an alkyl group, an alkyl group, or an acyl group, $R_{10}$ and $R_{11}$ each represent independently an alkyl group or alkoxy group, and $W_2$ represents a monovalent group capable of substitution on the benzene ring, formula (VI)

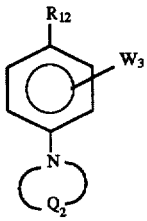

wherein $Q_2$ represents a divalent group for forming a 5- to 7-membered heterocyclic ring together with the nitrogen atom and an alkylene group, $R_{12}$ represents an alkyl group, an alkoxy group, an aryloxy group, or an acyloxy group, and $W_3$ represents a monovalent group capable of substitution on the benzene ring.

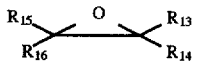

formula (VII)

wherein $R_{13}$, $R_{14}$, $R_{15}$, and $R_{16}$ each represent a hydrogen atom, an aliphatic group, an aromatic group, an aliphatic oxycarbonyl group, an aromatic oxycarbonyl group, or a carbamoyl group, provided that all of $R_{13}$, $R_{14}$, $R_{15}$, and $R_{16}$ do not represent hydrogen atoms at the same time, and the number of the epoxy groups represented by formula (VII) may be 1 to 60 groups in the same molecule.

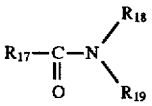

formula (VIII)

wherein $R_{17}$, $R_{18}$, and $R_{19}$ each represent independently an alkyl group or an aryl group, if $R_{18}$ and $R_{19}$ each represent an alkyl group, they may bond together to form a 5- to 7-membered ring, and one of $R_{18}$ and $R_{19}$ may be a hydrogen atom.

13. The silver halide color photographic material as claimed in claim 12, wherein the support comprises a base and three water-resisting resin covering layers located on the side of the base where photographic layers are applied.

14. The silver halide color photographic material as claimed in claim 12, wherein the ratio of white pigment contents (wt %) in the layer having the highest content to that in the layer of lowest content, in the water-resisting resin covering layers, is 1.2 or more.

15. The silver halide color photographic material as claimed in claim 12, wherein both a compound represented by formula (IV) and a compound represented by formula (VII) are contained in the yellow-coupler-containing layer.

16. The silver halide color photographic material as claimed in claim 12, wherein both at least one compound represented by formula (IV) or (V), and at least one compound represented by formula (VI) or (VII), are contained in the yellow-coupler-containing layer.

17. The silver halide color photographic material as claimed in claim 12, wherein at least one of the silver halide emulsion layers comprises a high-silver-chloride emulsion whose silver chloride content is 95 mol % or more.

18. The silver halide color photographic material as claimed in claim 12, wherein the water-resisting resin is polyolefin.

19. The silver halide color photographic material as claimed in claim 12, wherein the white pigment is selected from the group consisting of titanium dioxide, barium sulfate, lithopone, aluminum oxide, calcium carbonate, silicon oxide, antimony trioxide, titanium phosphate, zinc oxide, white lead, zirconium oxide, and finely pulverized powder of polystyrene polymer or styrene/divinylbenzene copolymer.

20. The silver halide color photographic material as claimed in claim 12, wherein the content of white pigment in the water-resisting resin layer is 0 to 45 wt %.

21. The silver halide color photographic material as claimed in claim 12, wherein the amount of yellow coupler represented by formula (I) or (II) to be added is 0.1 to 10 mmol per $m^2$ of the silver halide color photographic material.

22. The silver halide color photographic material as claimed in claim 12, wherein the amount of compound represented by formula (IV), (V), (VI), (VII), or (VIII) to be added is 1 to 200 wt % based on the weight of coupler.

* * * * *